US012392331B2

(12) United States Patent
Hughes et al.

(10) Patent No.: US 12,392,331 B2
(45) Date of Patent: Aug. 19, 2025

(54) HYDRAULIC PUMP WITH TWO-STAGE OPERATION

(71) Applicant: Enerpac Tool Group Corp., Milwaukee, WI (US)

(72) Inventors: Nathan Adam Hughes, Cottage Grove, WI (US); Curtis L. Van Weelden, Waukesha, WI (US)

(73) Assignee: Enerpac Tool Group Corp., Milwaukee, WI (US)

( * ) Notice: Subject to any disclaimer, the term of this patent is extended or adjusted under 35 U.S.C. 154(b) by 313 days.

(21) Appl. No.: 17/889,051

(22) Filed: Aug. 16, 2022

(65) Prior Publication Data

US 2023/0039274 A1 Feb. 9, 2023

Related U.S. Application Data

(63) Continuation of application No. 15/981,869, filed on May 16, 2018, now Pat. No. 11,415,119.

(Continued)

(51) Int. Cl.
*F04B 1/04* (2020.01)
*F04B 23/02* (2006.01)

(Continued)

(52) U.S. Cl.
CPC ..... *F04B 1/04* (2013.01); *F04B 39/10* (2013.01); *F04B 17/06* (2013.01); *F04B 23/025* (2013.01)

(58) Field of Classification Search
CPC ..... F04B 9/045; F04B 17/06; F04B 17/03; F04B 1/00; F04B 49/08; F04B 23/025; F04B 39/10; F04B 2205/05; F04B 1/04
See application file for complete search history.

(56) References Cited

U.S. PATENT DOCUMENTS 1,850,083 A 3/1932 Noltein
3,053,186 A * 9/1962 Gondek ..... F04B 23/106 417/252

(Continued)

FOREIGN PATENT DOCUMENTS

CN 1131233 A 9/1996
CN 201836150 5/2011

(Continued)

OTHER PUBLICATIONS

International Search Report and Written Opinion for PCT/US2018/033060 dated Sep. 24, 2018.

(Continued)

*Primary Examiner* — Nathan C Zollinger
(74) *Attorney, Agent, or Firm* — Andrus Intellectual Property Law, LLP

(57) ABSTRACT

A pump may generally include a frame including a reservoir. The reservoir stores a hydraulic fluid. The pump may also include a motor assembly supported by the frame and a pump assembly operably driven by the motor assembly. The pump assembly is in fluid communication with the reservoir and configured to dispense the hydraulic fluid out of the frame. The pump assembly includes a first piston and a second piston, wherein the first piston dispenses hydraulic fluid out of the frame between a first pressure and a second pressure greater than the first pressure, and the second piston dispenses hydraulic fluid out of the frame between the first pressure and a third pressure, the third pressure being greater than the second pressure.

16 Claims, 48 Drawing Sheets

Related U.S. Application Data

(60) Provisional application No. 62/507,130, filed on May 16, 2017.

(51) Int. Cl.
*F04B 39/10* (2006.01)
*F04B 17/06* (2006.01)

(56) References Cited

U.S. PATENT DOCUMENTS

| | | | | |
|---|---|---|---|---|
| 3,487,431 | A | 12/1969 | Forkner | |
| 3,992,133 | A | 11/1976 | Brunner | |
| 4,597,717 | A * | 7/1986 | Mohr | F04B 17/03 417/267 |
| 4,692,104 | A | 9/1987 | Hansen | |
| 4,791,838 | A | 12/1988 | Bickford et al. | |
| 4,834,632 | A | 5/1989 | Gatecliff et al. | |
| 4,864,903 | A | 9/1989 | Bickford et al. | |
| 5,094,599 | A | 3/1992 | Budecker | |
| 5,113,949 | A | 5/1992 | Ohkubo et al. | |
| D327,075 | S | 6/1992 | Tiedemann | |
| 5,121,788 | A | 6/1992 | Carollo | |
| 5,181,837 | A | 1/1993 | Niemiec | |
| 5,261,796 | A | 11/1993 | Niemiec et al. | |
| 5,320,501 | A | 6/1994 | Langosch et al. | |
| 5,421,240 | A | 6/1995 | Ohta et al. | |
| 5,435,698 | A | 7/1995 | Phillips | |
| 5,668,328 | A | 9/1997 | Steber et al. | |
| D447,148 | S | 8/2001 | Antony et al. | |
| 6,863,502 | B2 | 3/2005 | Bishop et al. | |
| 7,036,892 | B2 | 5/2006 | Suzuki et al. | |
| D536,705 | S | 2/2007 | Griffin et al. | |
| 7,200,992 | B2 | 4/2007 | Wagner | |
| 7,296,407 | B2 | 11/2007 | Rose | |
| D557,708 | S | 12/2007 | Carpenter et al. | |
| D573,609 | S | 7/2008 | Bilger | |
| D604,746 | S | 11/2009 | Nishido et al. | |
| 7,743,673 | B2 | 6/2010 | Wagner | |
| 7,762,790 | B2 | 7/2010 | Steinfels et al. | |
| 7,878,765 | B2 | 2/2011 | Gonnella et al. | |
| 7,931,448 | B2 | 4/2011 | Achor et al. | |
| 8,056,426 | B2 | 11/2011 | Hohmann et al. | |
| 8,220,380 | B2 | 7/2012 | Andres et al. | |
| 8,305,019 | B2 | 11/2012 | Tobari et al. | |
| D707,719 | S | 6/2014 | Kamijyo | |
| D712,933 | S | 9/2014 | DeOreo et al. | |
| D713,860 | S | 9/2014 | Pedrollo | |
| 8,899,378 | B2 | 12/2014 | Wood et al. | |
| 8,997,904 | B2 | 4/2015 | Cryer et al. | |
| 9,115,720 | B2 | 8/2015 | Rosinski et al. | |
| 9,193,046 | B2 | 11/2015 | Landrum | |
| 9,193,049 | B2 | 11/2015 | Gareis | |
| 9,212,655 | B2 | 12/2015 | Neumair | |
| 9,435,324 | B2 | 9/2016 | Richardson et al. | |
| 9,476,414 | B2 | 10/2016 | Wallis | |
| 9,562,534 | B2 | 2/2017 | Rosinski et al. | |
| 9,587,639 | B2 | 3/2017 | Rosinski et al. | |
| D785,679 | S | 5/2017 | Hartung | |
| D786,939 | S | 5/2017 | Nelson et al. | |
| 9,670,942 | B2 | 6/2017 | Karlsson et al. | |
| D810,145 | S | 2/2018 | Sinico | |
| D822,718 | S | 7/2018 | Hartung | |
| D826,282 | S | 8/2018 | Mead et al. | |
| D826,283 | S | 8/2018 | Mead et al. | |
| D838,746 | S | 1/2019 | Gan | |
| D847,266 | S | 4/2019 | Korankye | |
| D850,490 | S | 6/2019 | Janardhan et al. | |
| 10,564,657 | B2 | 2/2020 | Chu | |
| D878,423 | S | 3/2020 | Andersson et al. | |
| 10,851,909 | B2 | 12/2020 | Neumair et al. | |
| 11,053,954 | B2 * | 7/2021 | Loerner | F04B 49/03 |
| 11,157,208 | B2 | 10/2021 | Connor | |
| 11,162,482 | B2 | 11/2021 | Dawson et al. | |
| 11,193,508 | B2 | 12/2021 | Hughes et al. | |
| 11,415,119 | B2 | 8/2022 | Hughes et al. | |
| 11,451,119 | B2 * | 9/2022 | Aso | H02K 1/146 |
| 11,572,900 | B2 | 2/2023 | Hughes et al. | |
| 2003/0012672 | A1 | 1/2003 | Sowa et al. | |
| 2004/0045729 | A1 | 3/2004 | Lehnert et al. | |
| 2005/0207899 | A1 | 9/2005 | Furuta | |
| 2005/0210872 | A1 | 9/2005 | Wagner | |
| 2007/0214921 | A1 | 9/2007 | Fechter et al. | |
| 2007/0217928 | A1 | 9/2007 | Isobe et al. | |
| 2008/0265844 | A1 | 10/2008 | Smith et al. | |
| 2009/0000397 | A1 | 1/2009 | Wagner et al. | |
| 2010/0021313 | A1 | 1/2010 | Devan et al. | |
| 2010/0116508 | A1 | 5/2010 | Oglesby | |
| 2011/0206537 | A1 | 8/2011 | Simpson | |
| 2013/0098239 | A1 | 4/2013 | Rodrigues | |
| 2013/0115108 | A1 | 5/2013 | Segal et al. | |
| 2013/0315758 | A1 | 11/2013 | Olson | |
| 2014/0328704 | A1 * | 11/2014 | Neumair | F04B 39/066 417/410.1 |
| 2015/0033720 | A1 | 2/2015 | Mate et al. | |
| 2015/0078924 | A1 | 3/2015 | Zhang et al. | |
| 2015/0147953 | A1 | 5/2015 | Park et al. | |
| 2015/0300138 | A1 | 10/2015 | Michel | |
| 2015/0345489 | A1 | 12/2015 | Fink | |
| 2016/0366824 | A1 | 12/2016 | Richardson et al. | |
| 2017/0058923 | A1 | 3/2017 | Boehler et al. | |
| 2017/0107804 | A1 | 4/2017 | Krug et al. | |
| 2017/0356438 | A1 | 12/2017 | Hughes | |
| 2018/0313342 | A1 | 11/2018 | Dawson et al. | |
| 2021/0156369 | A1 | 5/2021 | Sassi et al. | |
| 2022/0049729 | A1 | 2/2022 | Abe et al. | |
| 2022/0250214 | A1 | 8/2022 | Stickley | |

FOREIGN PATENT DOCUMENTS

| | | | | |
|---|---|---|---|---|
| CN | 101900153 | | 7/2012 | |
| DE | 2424391 | A * | 12/1975 | B06B 1/183 |
| DE | 102007046660 | A1 | 4/2009 | |
| DE | 102013002187 | A1 * | 8/2014 | F04B 17/03 |
| EP | 2110205 | | 11/2017 | |
| EP | 3259477 | | 7/2021 | |
| EP | 3653888 | | 1/2023 | |
| EP | 4191077 | | 6/2023 | |
| GB | 534847 | | 3/1941 | |
| GB | 648716 | | 1/1951 | |
| JP | 2000-274377 | | 10/2000 | |
| RU | 1830114 | | 7/1993 | |
| WO | WO 9420753 | | 9/1994 | |
| WO | WO-9420753 | A2 * | 9/1994 | F04B 1/053 |
| WO | WO 2008029624 | | 3/2008 | |
| WO | WO 2016133874 | | 8/2016 | |
| WO | WO 2017060777 | | 4/2017 | |

OTHER PUBLICATIONS

Atlas Copco AB, "SP700 Smart Pump", Product Brochure, https://www.atlascopco.com/content/dam/atlas-copco/industrial-technique/general/documents/brochures-leaflets/hydraulic-tools/SP-01_SmartTorquePump_2018-09-03.pdf, 4 Pages.

Atlas Corp., "SP700 Smart Pump", Youtube video (https://www.youtube.com/watch?v=ZvysvFfl_BE), dated Aug. 2, 2019, 4 Screenshots.

Extended Search Report issued from the European Patent Office for related Application No. 19208915.9 dated Mar. 31, 2020 ( 11 Pages ) .

Office Action issued from the US Patent Office for related U.S. Appl. No. 16/682,991 dated Mar. 3, 2021 ( 11 pages ).

Examination Report issued from the European Patent Office for related Application No. 18729247.9 dated Mar. 15, 2022 ( 4 Pages ).

Exam Report issued for European Patent Application No. 23195553.5, dated Oct. 14, 2024.

European Application No. 23195553.5, European Searh Report dated Dec. 20, 2023 (5 pages).

* cited by examiner

HYDRAULIC PUMP WITH TWO-STAGE OPERATION

CROSS-REFERENCE TO RELATED APPLICATION

The present application is a continuation of U.S. Non-Provisional patent application Ser. No. 15/981,869, filed on May 16, 2018, which claims the benefit of U.S. Provisional Patent Application No. 62/507,130, filed May 16, 2017, the entire contents of each of which are hereby incorporated by reference.

FIELD

The present disclosure generally relates to hydraulic pumps, and particularly to a variable displacement pump for providing substantially constant power output.

SUMMARY

In some independent aspects, a constant power and variable displacement hydraulic pump may be provided. In some existing pumps, variable displacement of a pump assembly may be provided by mechanical features or components to change the stroke of a pumping piston, for example, by varying the offset of an eccentric cam driving the piston.

Another existing pump uses a single-stage pump and a variable speed motor. In such a pump, a gear pump precharged the single-stage pump, and the motor speed was varied manually to attempt to maintain a constant power output. However, practical differences in flow rates for high flow versus high pressure cannot be achieved with variable speed on a single stage alone.

In one independent aspect, a pump may generally include a two-stage pump assembly operable to dispense fluid under pressure; and a brushless motor assembly operable to drive the motor assembly, the motor assembly being controlled to operate at a substantially constant power as fluid pressure increases in each stage of the pump assembly.

In another independent aspect, a pump may generally include a pump assembly operable to dispense fluid, the pump assembly including a pump housing supporting a rotating pump member; a motor operable to drive the pump assembly, the motor including a stator and a rotor supported for rotation relative to the stator; and a shaft connected directly to each of the rotor to the pump member and being operable to transmit power from the rotor to the pump member.

In yet another independent aspect, a pump may generally include a pump assembly operable to dispense fluid, the pump assembly including a pump housing supporting a pump mechanism; and a motor operable to drive the pump assembly, the motor including a stator connected directly to the pump housing, a rotor supported for rotation relative to the stator, and a shaft connected to the rotor and operable to transmit power to the pump assembly.

In a further independent aspect, a pump may generally include a pump assembly operable to dispense fluid, the pump assembly including a pump housing supporting a pump mechanism; and a motor operable to drive the pump assembly, the motor including a stator including a plurality of laminations encapsulated in electrically-insulating material and connected directly to the pump housing and windings wound on the encapsulated lamintations, a rotor including a plurality of permanent magnets encapsulated in electrically-insulating material and supported for rotation relative to the stator, and a shaft connected to the encapsulated rotor and operable to transmit power to the pump assembly.

In another independent aspect, a pump may generally include a pump assembly operable to dispense fluid; a reservoir including a housing defining a container for storing fluid, the housing defining a plurality of channels passing through the container, each channel having an inlet and an outlet; and a fan operable to cause air flow through the channels to cool fluid in the reservoir.

In yet another independent aspect, a pump may generally include a housing, a pump assembly supported by the housing and operable to dispense fluid, a pendant operable to control the pump assembly to dispense fluid; and retainer assembly operable to selectively removably retain the pendant on the housing. In some constructions, the housing may include a handle engageable by a user to transport the pump, the handle defining a receptacle to selectively removably retain the pendant.

In a further independent aspect, a pump may generally include an electric motor connectable to a power source by a cord, a pump assembly driven by the motor assembly to dispense fluid, and a housing supporting the motor assembly and the pump assembly, the housing including a cord wrap formed integrally with a portion of the housing. The housing may have a base and define an outer periphery extending in a vertical direction, the cord wrap being within the outer periphery.

In another independent aspect, a method of operating a pump may be provided. The pump may include a housing, a motor assembly supported by the housing, and a pump assembly supported by the housing, the pump assembly including a plurality of pistons. The method may generally include operating the motor assembly to drive the pump assembly; dispensing fluid under pressure with the plurality of pistons; after a pressure threshold is reached, unloading fewer than all of the plurality of pistons; after unloading, operating the motor assembly to drive the pump assembly; dispensing fluid under pressure with remaining pistons of the plurality of pistons until a selected pressure is reached.

In another independent aspect, a pump may generally include a frame including a reservoir. The reservoir stores a hydraulic fluid. The pump may also include a motor assembly supported by the frame and a pump assembly operably driven by the motor assembly. The pump assembly is in fluid communication with the reservoir and configured to dispense the hydraulic fluid out of the frame. The pump assembly includes a first piston and a second piston, wherein the first piston dispenses hydraulic fluid out of the frame between a first pressure and a second pressure greater than the first pressure, and the second piston dispenses hydraulic fluid out of the frame between the first pressure and a third pressure, the third pressure being greater than the second pressure.

In another independent aspect, a pump may generally include a frame with a first side, a second side, and an end positioned between the first side and the second side, wherein the frame defines a compartment. A motor assembly and a pump assembly are positioned within the compartment. The pump may also include a radial fan positioned within the compartment and adjacent the end of the frame, an inlet positioned on one of the first side and the second side of the frame, and an outlet positioned on one of the first side or the second side of the frame, wherein the outlet is spaced apart from the inlet. The radial fan is configured to force air over the motor assembly and the pump assembly in order to reduce a temperature of the motor assembly and a temperature of the pump assembly. The radial fan draws air through the inlet and exhausting air through the outlet.

In another independent aspect, a pump may generally include a frame with a compartment, a motor assembly and a pump assembly positioned within the compartment. A handle is positioned adjacent the frame and a control device removably coupled to the handle. The control device has at least one switch and is in communication with a controller supported by the frame, wherein actuating the switch sends a signal to the controller. The control device includes a motor, wherein actuating the switch actuates the motor, the motor providing an output configured to be sensed by a user.

In another independent aspect, a pump may generally include a frame with a reservoir and an internal compartment, where a motor assembly and a pump assembly are positioned within the internal compartment. The pump includes an external cavity, an aperture, and a viewing lens. A surface of the frame separates the compartment from the cavity. The aperture provides fluid communication from the reservoir to the cavity. The viewing lens covers the cavity and the viewing lens is flush with the surface of the frame. Measurement markings are positioned on a surface of the viewing lens, wherein the measurement markings allows a user to determine a level of fluid in the reservoir.

In another independent aspect, a pump may generally include a frame housing a reservoir and a pump assembly. A fluid inlet provides fluid communication between the reservoir and the pump assembly. First feet are positioned on a first surface of the frame and second feet positioned on a second surface of the frame, the second surface is adjacent to the first surface. The fluid inlet is positioned proximate an edge of the frame at which the first surface and the second surface intersect, wherein the pump is operable when supported by either the first feet or the second feet.

The method may include operating the motor assembly to produce a substantially constant power output as pressure increases. Operating the motor assembly may include reducing the motor speed as pressure increases. Reducing the motor speed may include employing field weakening.

Independent features and independent advantages may become apparent to those skilled in the art upon review of the detailed description, drawings and claims.

DETAILED DESCRIPTION

Figure 1:
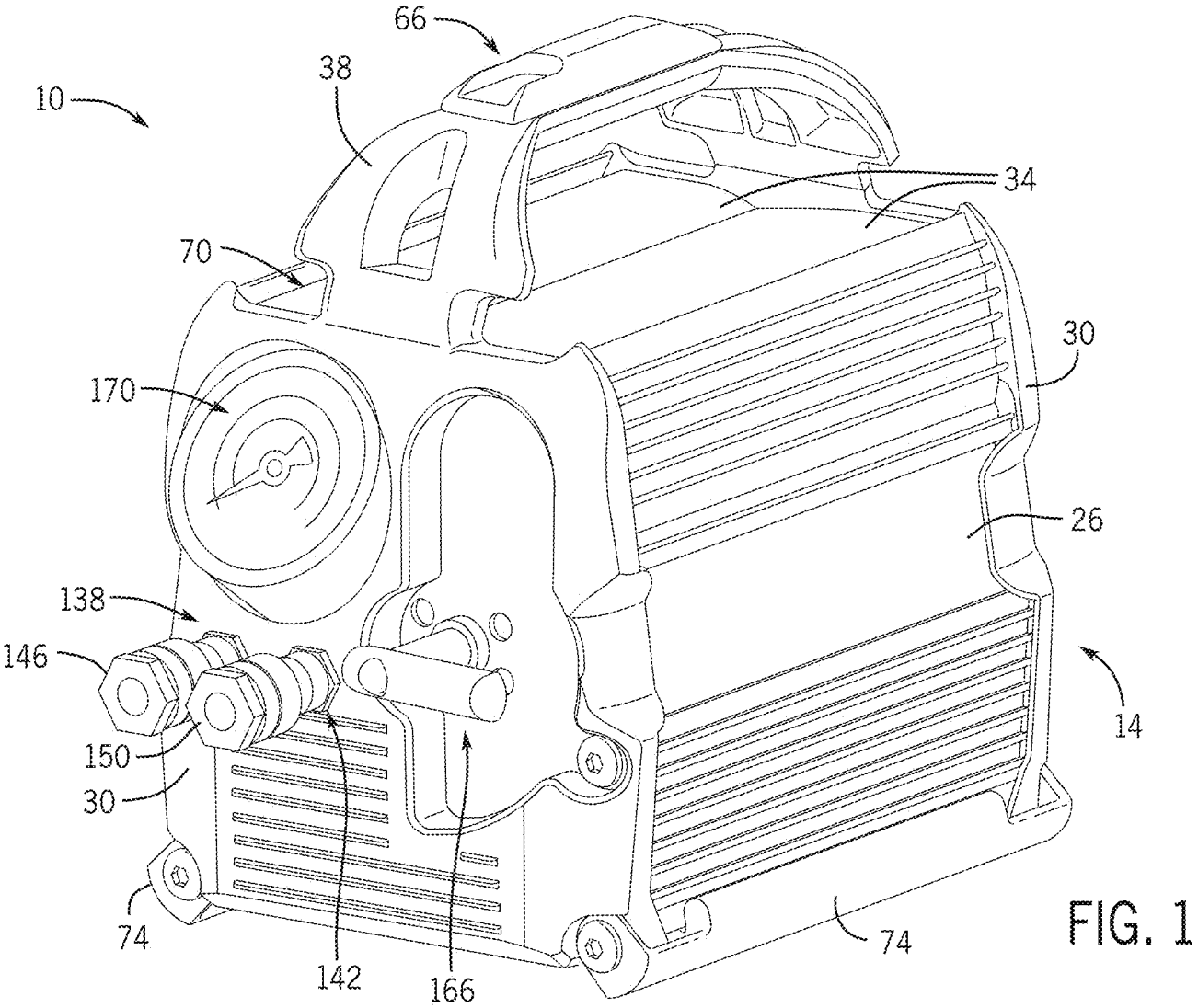
FIG. 1 is a front perspective view of a pump.
Figure 2:
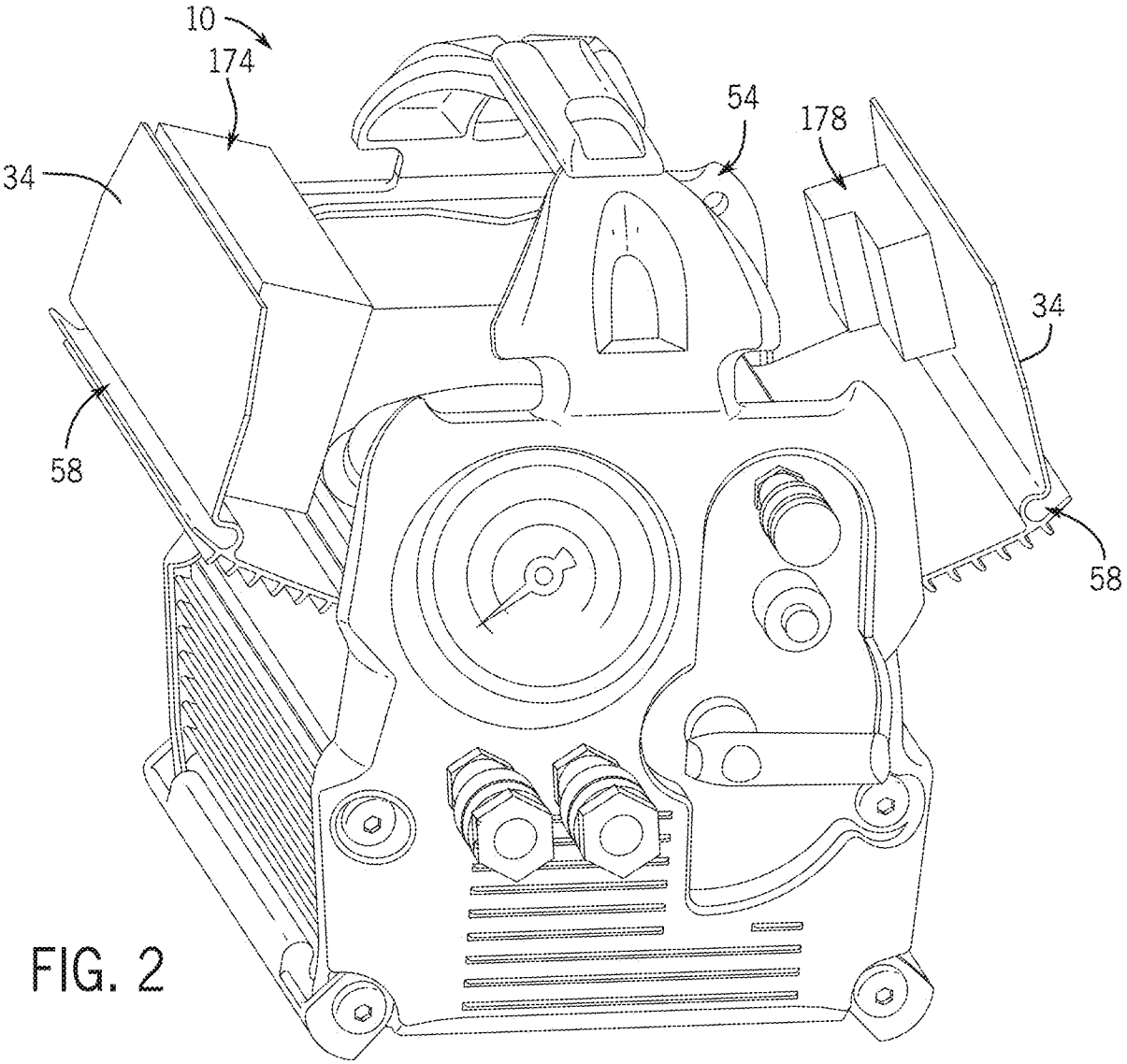
FIG. 2 is a front perspective view of the pump shown in FIG. 1 with the doors open.

Before any independent embodiments are explained in detail, it is to be understood that the disclosure is not limited in its application to the details of construction and the arrangement of components set forth in the following description or illustrated in the following drawings. The disclosure is capable of other independent embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

Also, the functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not listed.

Furthermore, some embodiments described herein may include one or more electronic processors configured to perform the described functionality by executing instructions stored in non-transitory, computer-readable medium. Similarly, embodiments described herein may be implemented as non-transitory, computer-readable medium storing instructions executable by one or more electronic processors to perform the described functionality. As used in the present application, "non-transitory computer-readable medium" comprises all computer-readable media but does not consist of a transitory, propagating signal. Accordingly, non-transitory computer-readable medium may include, for example, a hard disk, a CD-ROM, an optical storage device, a magnetic storage device, a ROM (Read Only Memory), a RAM (Random Access Memory), register memory, a processor cache, or any combination thereof.

Many of the modules and logical structures described are capable of being implemented in software executed by a microprocessor or a similar device or of being implemented in hardware using a variety of components including, for example, application specific integrated circuits ("ASICs"). Terms like "controller" and "module" may include or refer to both hardware and/or software. Capitalized terms conform to common practices and help correlate the description with the coding examples, equations, and/or drawings. However, no specific meaning is implied or should be inferred simply due to the use of capitalization. Thus, the claims should not be limited to the specific examples or terminology or to any specific hardware or software implementation or combination of software or hardware.

FIGS. 1-9 illustrate a pump 10 embodying several independent aspects of the disclosure. The pump 10 generally includes (see FIGS. 1-7) a package or frame assembly 14 supporting (see FIGS. 5-7) a motor 18 operable to drive a pump assembly 22.

In the illustrated construction, the motor 18 includes a brushless permanent magnet synchronous motor (PMSM), a permanent magnet AC motor (PMAC), an electrically-commutated motor (EC), or a brushless DC motor (BLDC). The illustrated pump assembly 22 includes a two-stage hydraulic pump assembly driven by the motor 18 controlled to provide (substantially) constant power and variable displacement for each stage. During operation, the motor speed is adjusted to maintain peak power based motor load/current for improved flow rate throughout the pressure range.

The frame assembly 14 includes (see FIG. 5) a support frame 26, end caps 30 and lids/doors 34 connected and cooperating to define a compartment for the motor assembly 18 and the pump assembly 22. The support frame 26 includes a partition wall 42 defining an opening 46 receiving a portion of the pump assembly 22. A fluid reservoir 48 is defined in the lower section of the support frame 26 below the partition wall.

In the illustrated construction (see FIGS. 2-4), each door 34 is movably supported (e.g., pivotable) about (see FIGS. 4 and 5) a pivot 50 defined between the door 34 and a portion of the support frame 26. A locking assembly 275 is provided to selectively retain each door 34 in a closed position. In the illustrated construction, tie rods or pins 276 are engageable through openings 54 in the rear end cap 30 and into a groove 58 in the door 34. The front end cap 30 may also define a recess (not shown) for receiving the end of the pins 276.

Figure 3:
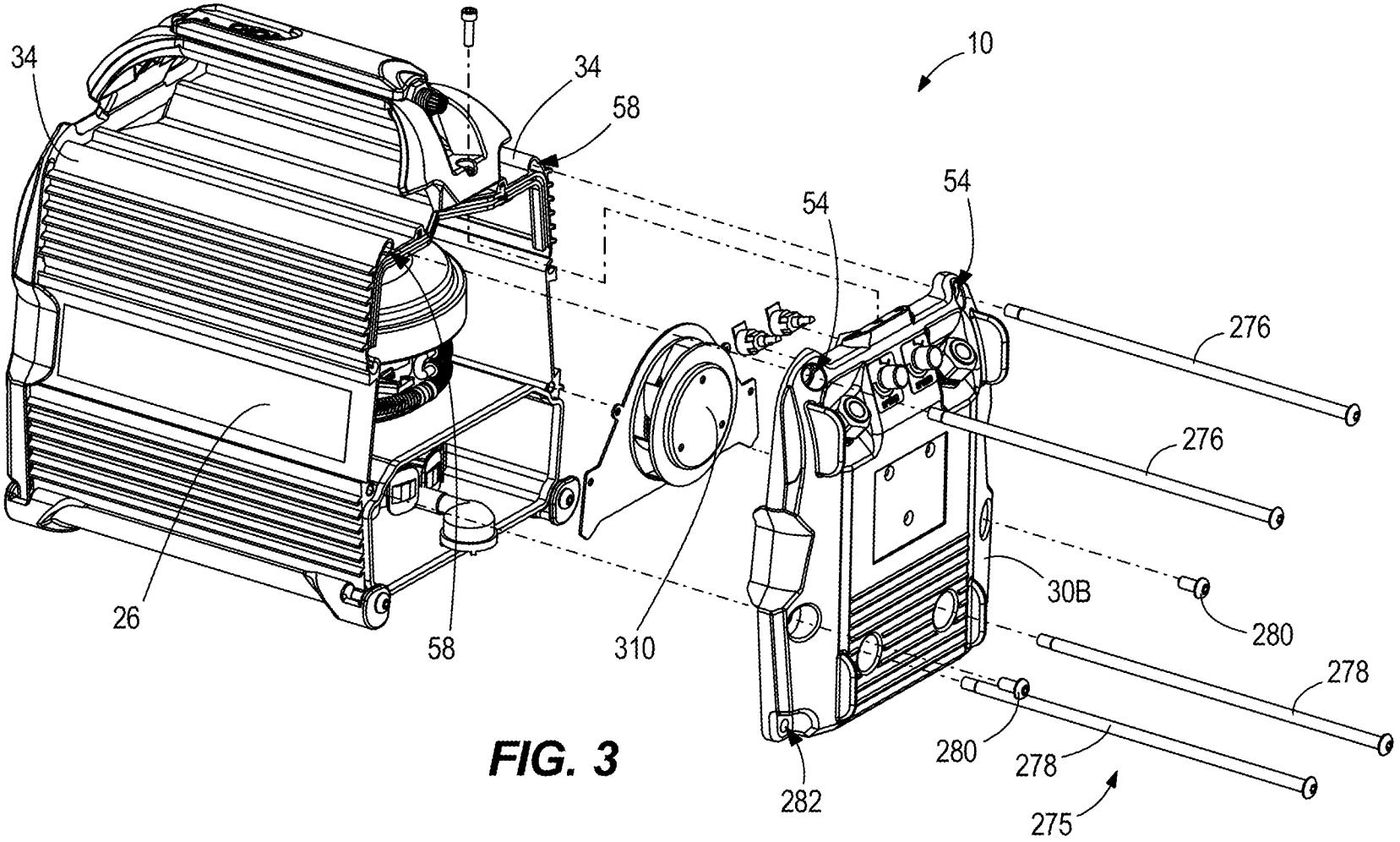
FIG. 3 is a partial exploded view of the pump of FIG. 1, illustrating a locking arrangement.
Figure 4:
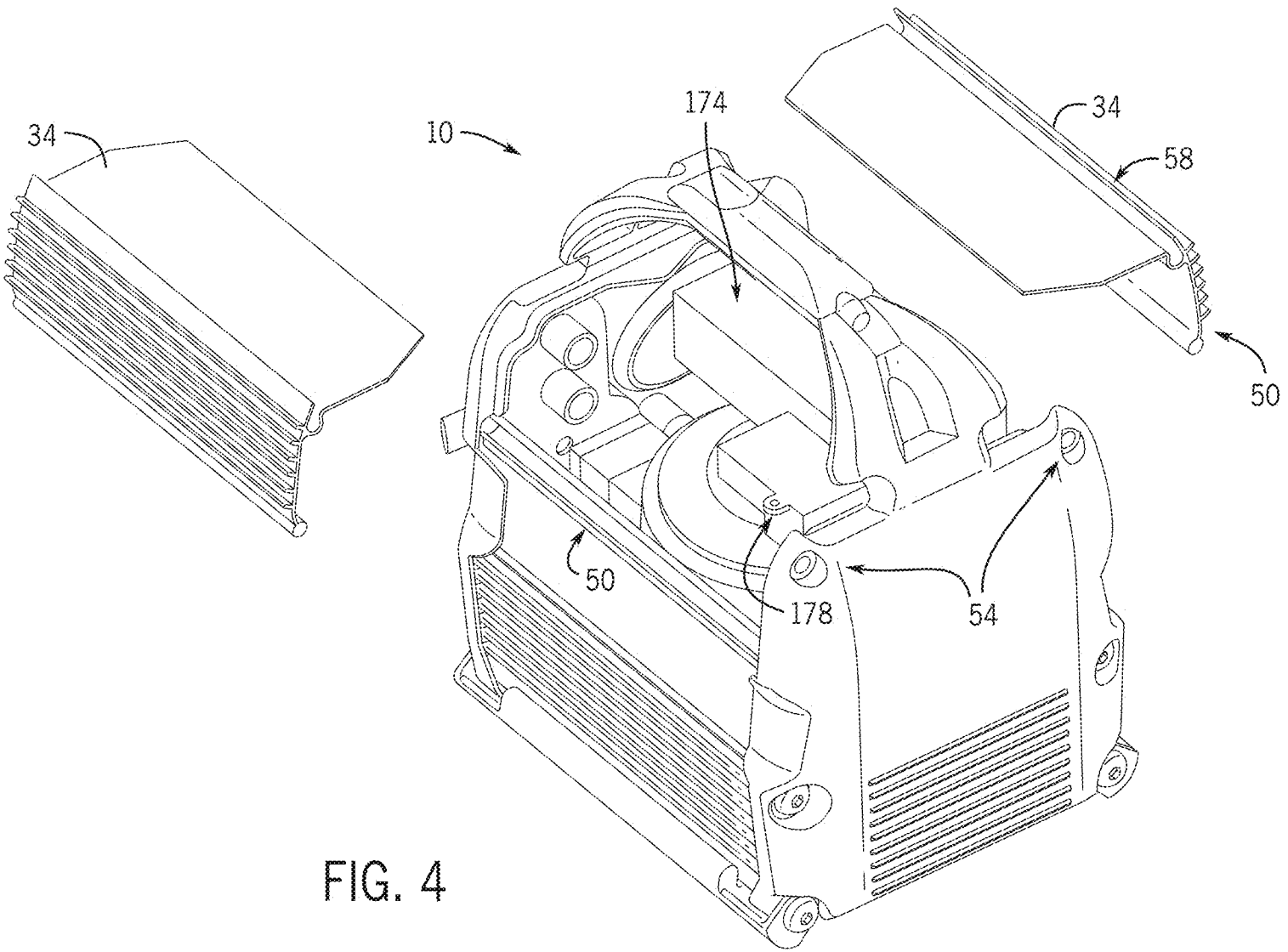
FIG. 4 is a rear perspective view of the pump shown in FIG. 1 with the doors removed.
Figure 5:
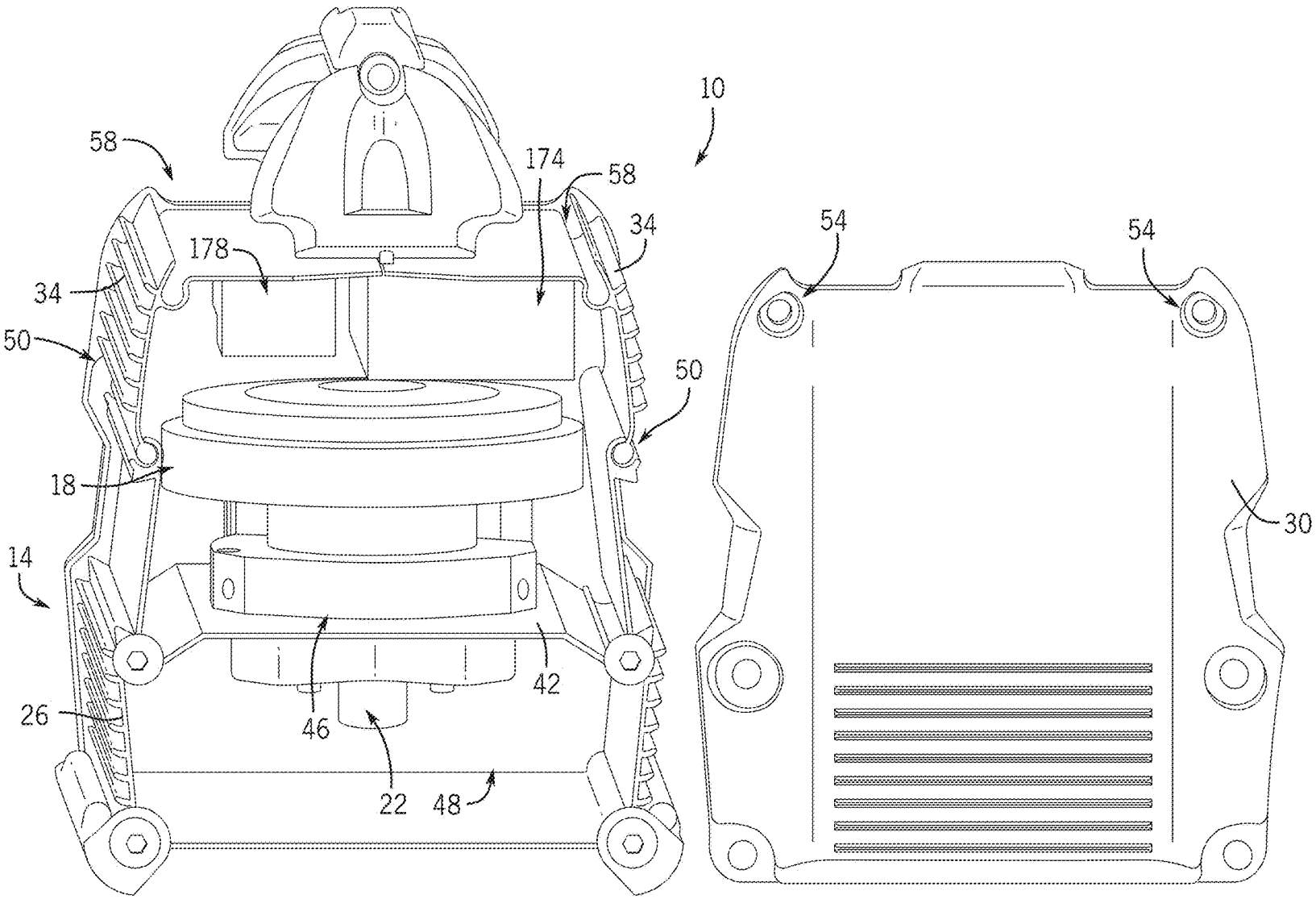
FIG. 5 is a rear perspective view of the pump shown in FIG. 1 with the rear end cap removed.
Figure 6:
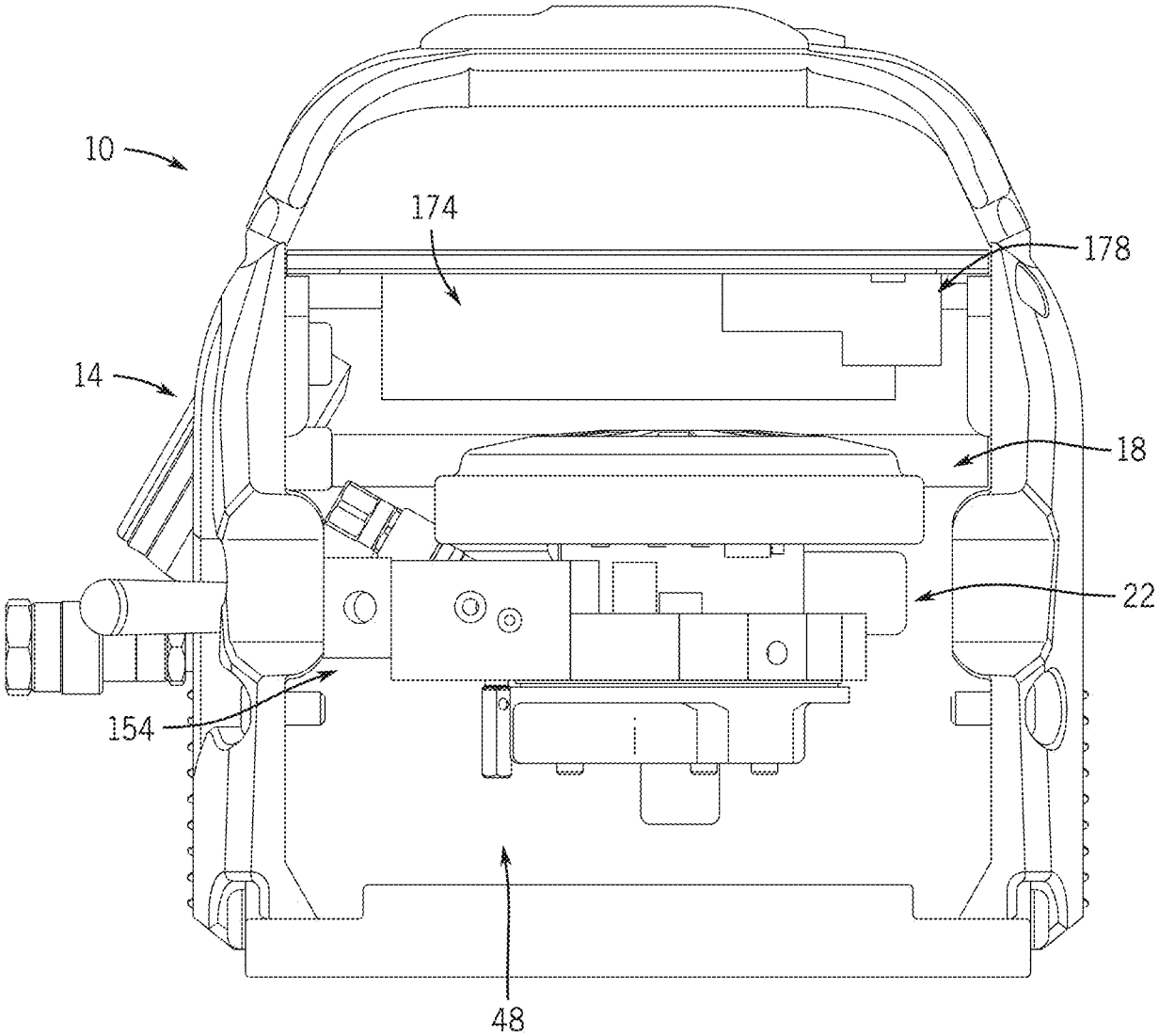
FIG. 6 is a right side view of the pump shown in FIG. 1 with portions of the housing assembly removed.
Figure 7:
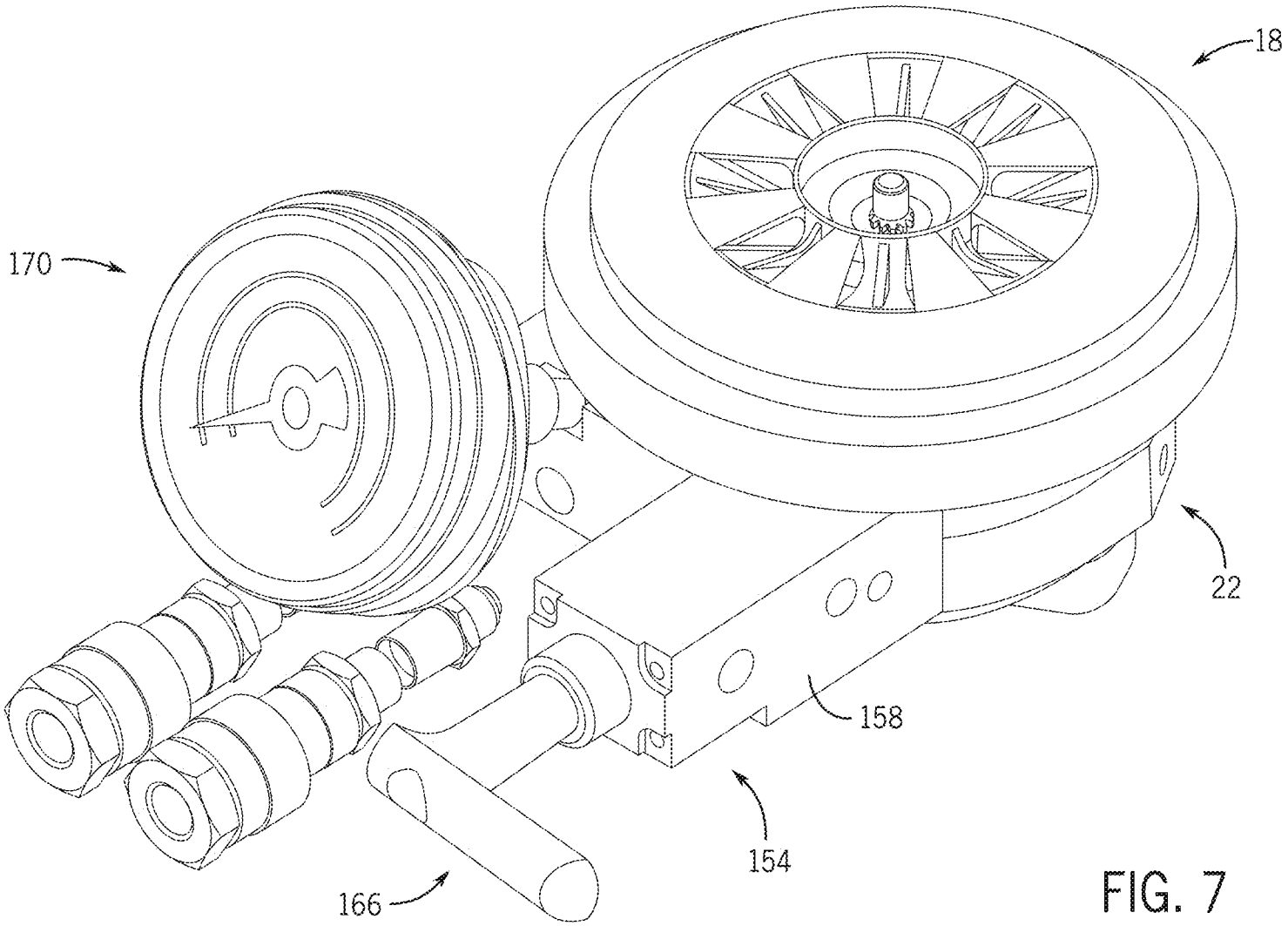
FIG. 7 is a front perspective view of a portion of the pump shown in FIG. 1.
Figure 8:
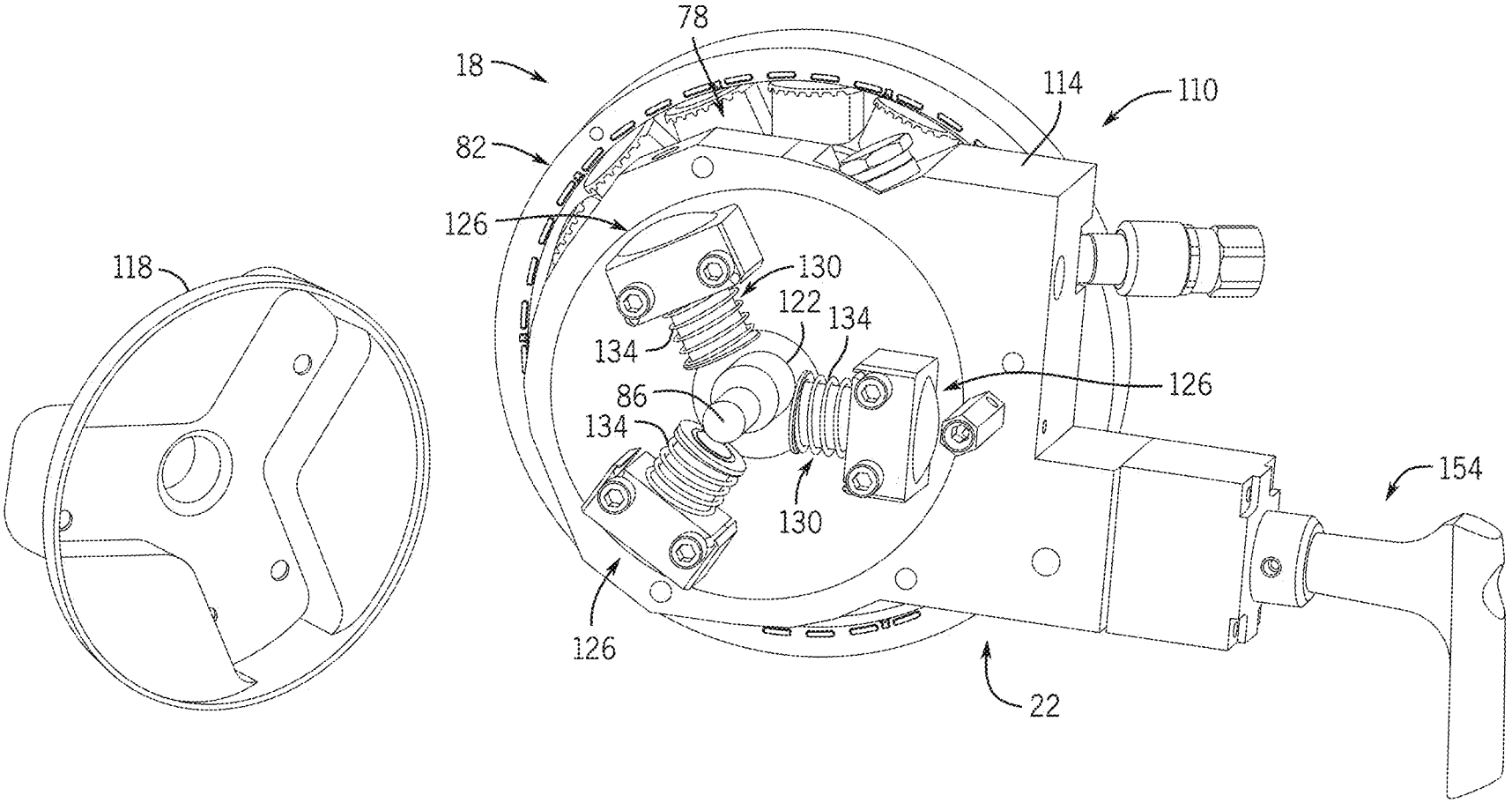
FIG. 8 is a bottom perspective view of the portion of the pump shown in FIG. 1 with the lower housing removed.

As shown in FIG. 3, the pins 276 are engageable through openings 54 in the rear end cap 30B, and each pin 276 into a respective groove 58 in an associated door 34. To open the door 34 (FIG. 2), the pins 276 may be removed from the groove 58B. Additionally, pins 278 and fasteners 280 may be inserted through openings 282 in order to secure the rear end cap 30B to the support frame 26B.

To open the door 34, the pin 276 is removed from the front recess, if provided, and from the door groove 58. In the open position, the pin may be retained in the opening 54 (e.g., by an enlarged head on the pin) or may be removed from the opening 54.

A cord wrap 70 (FIG. 1) is provided on the frame assembly 14 (e.g., between each end of the handle 38 and the associated end cap 30) for the power cord (not shown) of the pump 10 and/or for a cable (not shown) of the pendant 66. Feet 74 are attached to the support frame 26 for supporting the pump 10 on a work surface S. In the illustrated construction, the feet 74 are formed of elastomeric material, such as synthetic rubber (e.g., thermoplastic polyurethane (TPU)), to increase friction with the surface S, absorb impacts on the pump 10, etc. The feet 74 are coupled to the support frame 26 via a snap-fit. Washers are molded onto the feet 74 and assist in transmitting loads from the support frame 26 to the feet 74. The snap-fit allows the feet 74 to be removed from the support frame 26 without having to remove other components (e.g., end caps 30).

As mentioned above, the motor assembly 18 includes a brushless permanent magnet synchronous motor (PMSM), a permanent magnet AC motor (PMAC), an electrically-commutated motor (EC), or a brushless DC motor (BLDC). In the illustrated construction, the electrical components of the motor assembly 18 are electrically isolated from other components of the pump 10, for example, by electrically-insulating material, such as plastic. No metal components of the motor assembly 18 are electrically connected to the controller. The "plastic" motor assembly 18 does not need a ground connector, does not have leakage and is usuable with a GFCI outlet (not shown).

Figure 15:
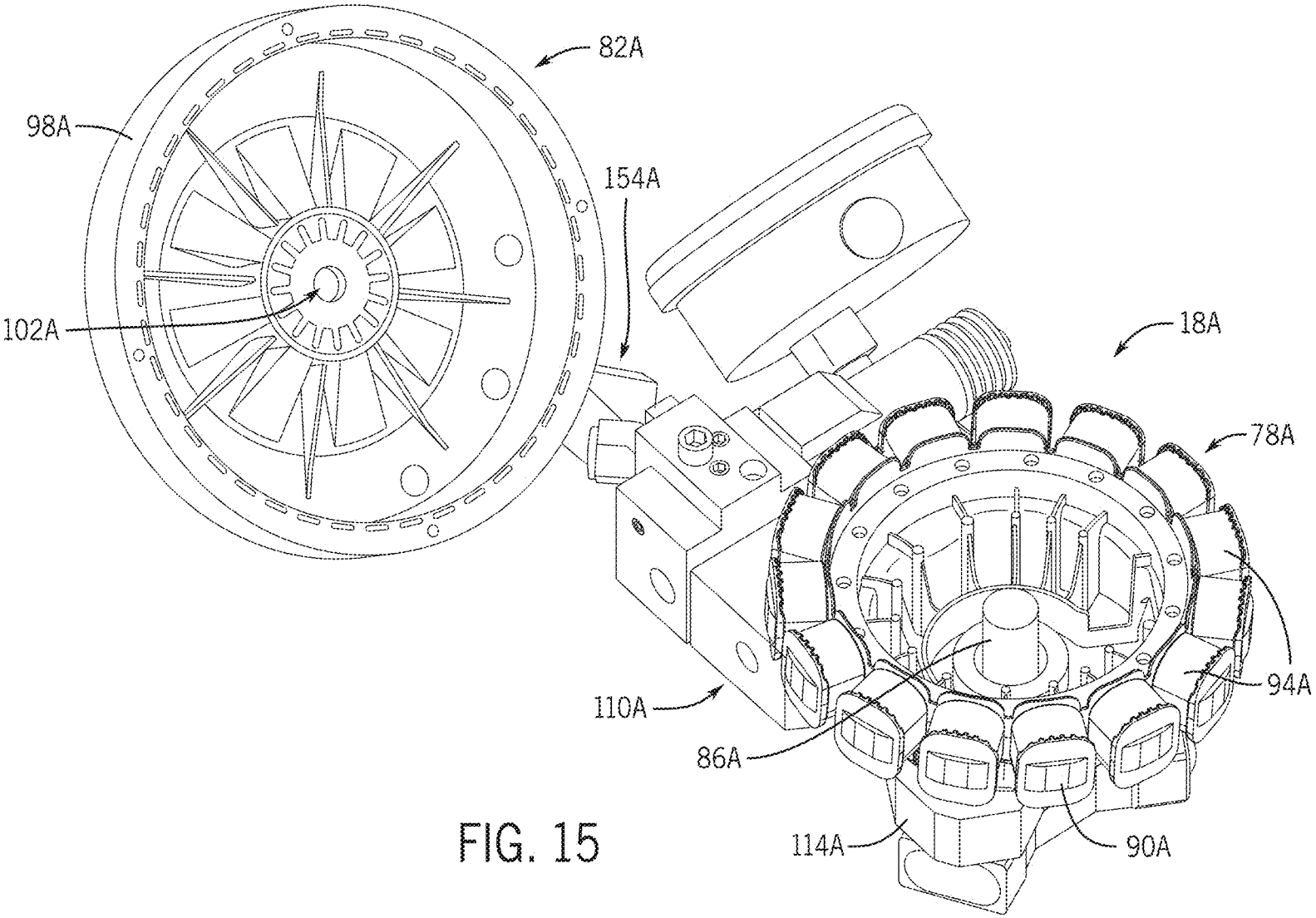
FIG. 15 is a top perspective view of the portion of the pump shown in FIG. 10 with the rotor removed.
Figure 16:
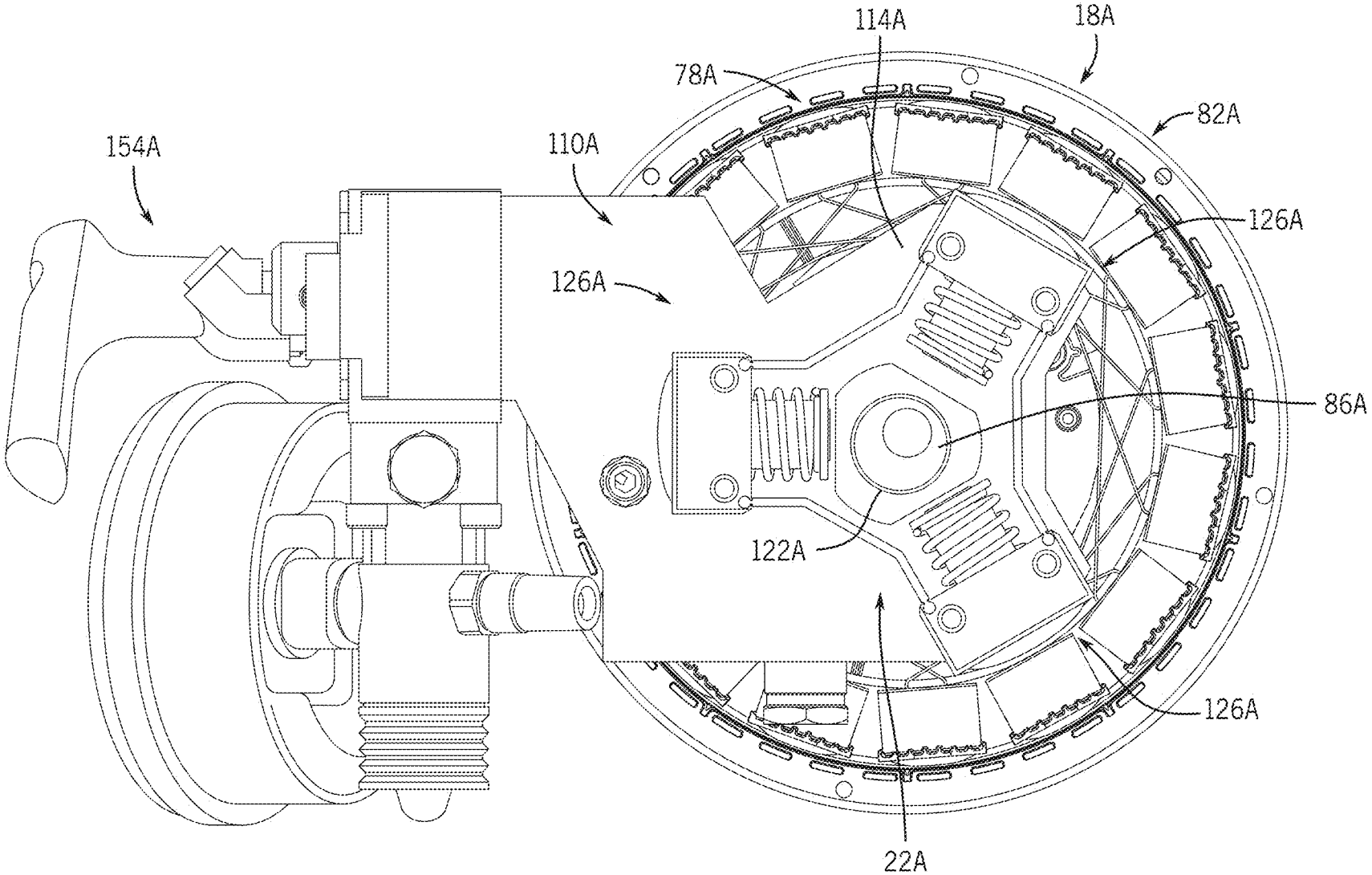
FIG. 16 is a bottom view of the portion of the pump shown in FIG. 10 with the lower housing removed.
Figure 17:
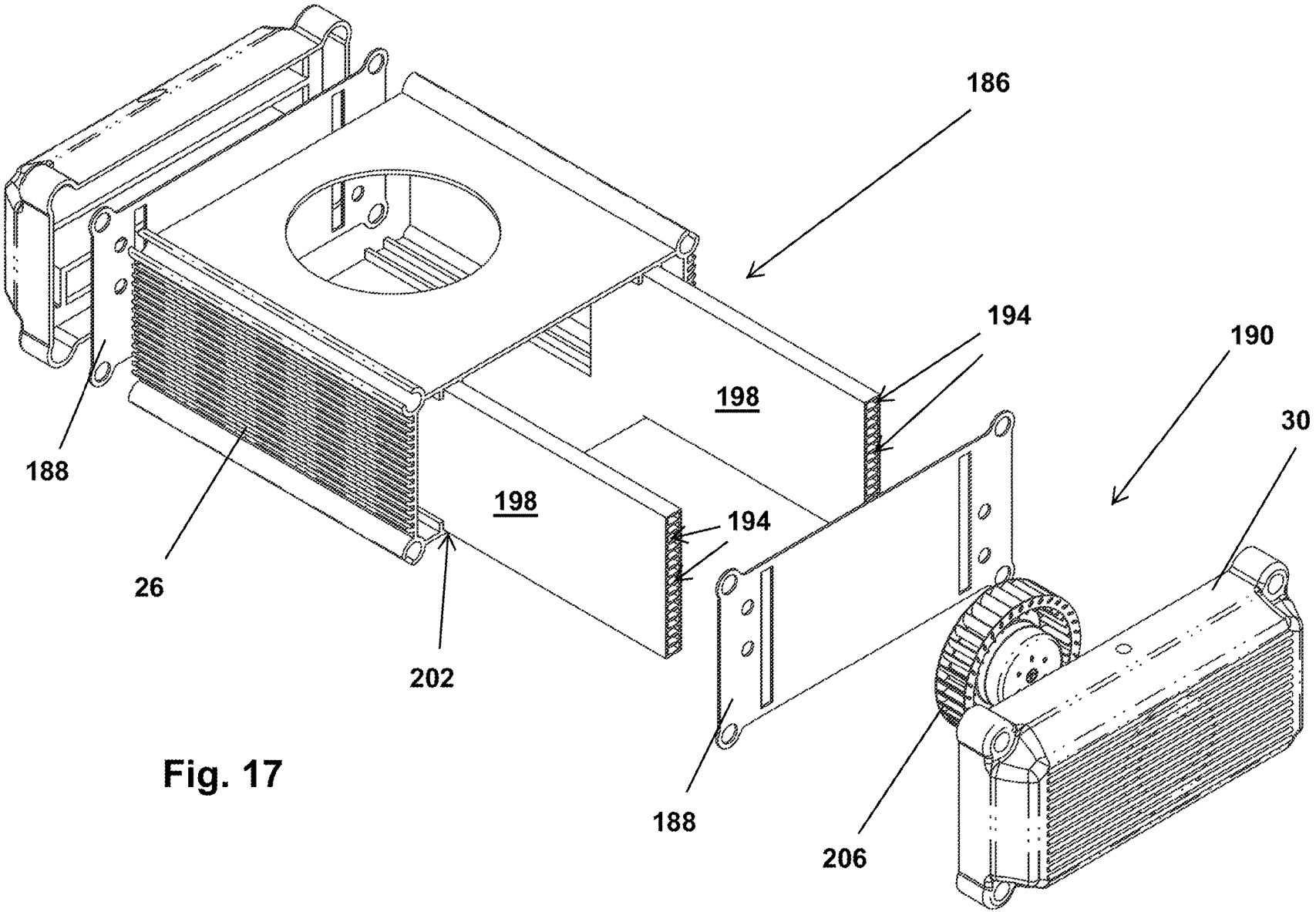
FIG. 17 is an exploded view of an alternative construction of a reservoir including an integrated heat exchanger.
Figure 18:
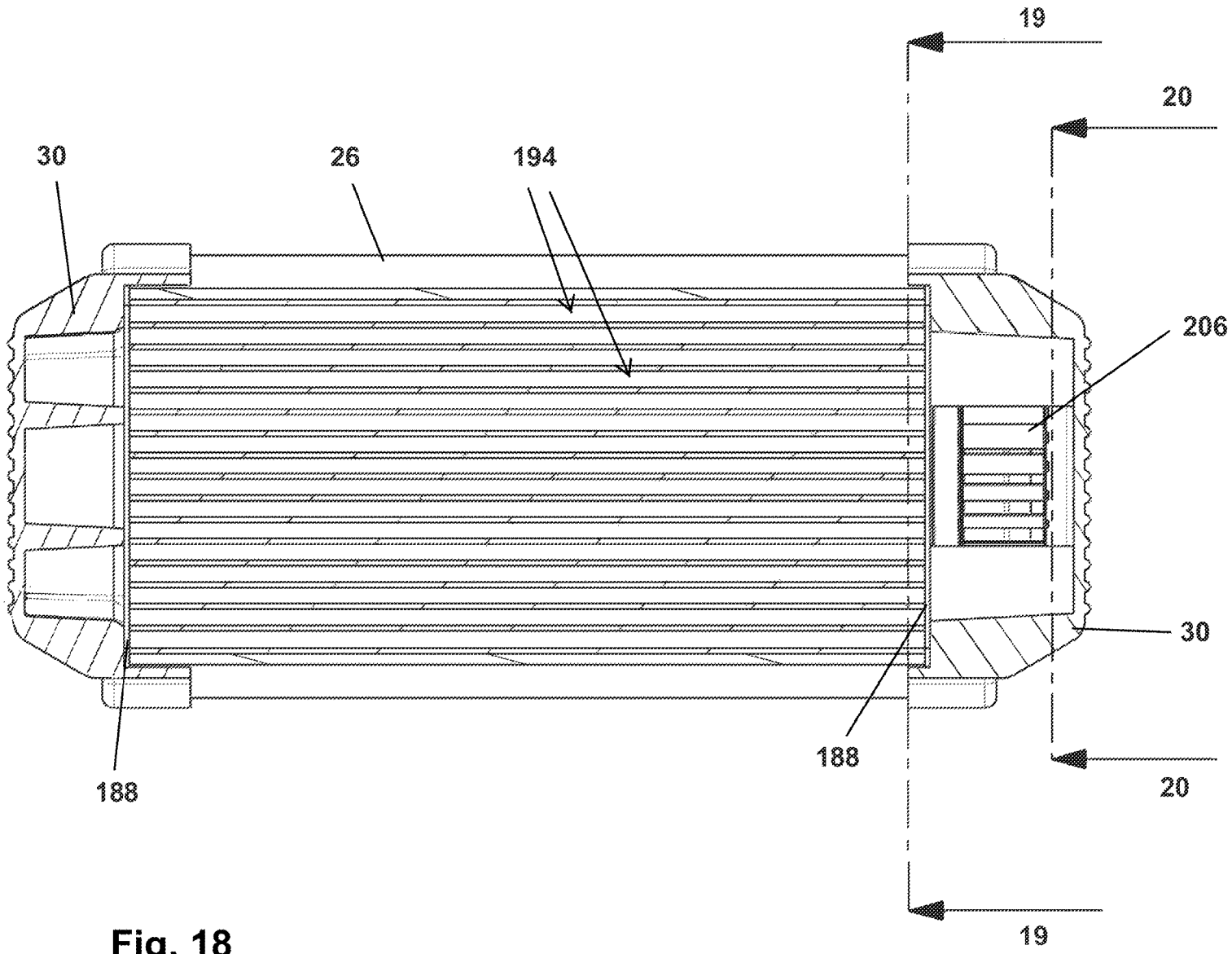
FIG. 18 is a cross-sectional view of the reservoir shown in FIG. 17 taken generally along line 18-18 in FIG. 19.
Figure 19:
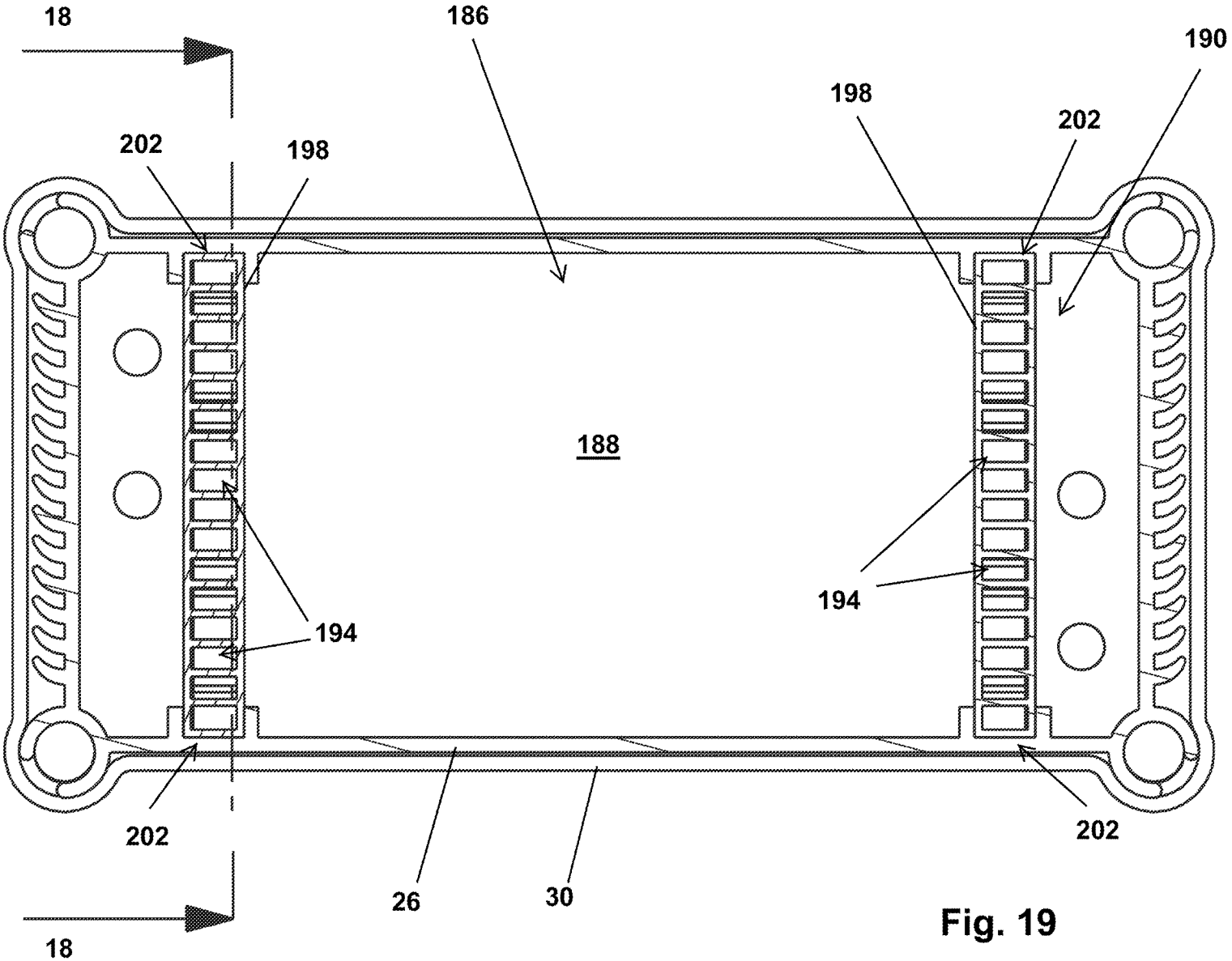
FIG. 19 is a cross-sectional view of the reservoir shown in FIG. 17 taken generally along line 19-19 in FIG. 18.

The motor assembly 18 generally includes (see FIGS. 5-8) a stator 78 and a rotor 82 connected to a drive shaft 86. The stator 78 includes (see FIGS. 8 and 15) laminations 90 encapsulated in electrically-insulating material, such as glass-filled polypropylene or other plastic, supporting windings 94. As discussed below, the stator 78 is fixed directly to the housing of the pump assembly 22. The rotor 82 includes permanent magnets (not shown) encapsulated in a housing 98 formed of electrically-insulating material, such as glass-filled polypropylene or other plastic. A spline 102 is molded into the housing 98 and drivingly engages an end of the shaft 86.

As shown in FIGS. 5-8, the pump assembly 22 is connected to a hydraulic circuit 106 (FIG. 23) and includes a housing assembly 110 formed by a body 114 and a lower housing 118. As mentioned above, the stator 78 is fixed directly to the pump housing assembly 110 (e.g., the pump body 114). The shaft 86 is a common shaft for the motor assembly 18 and the pump assembly 22 and is rotatably supported by the housing assembly 110. The shaft 86 extends through an opening in the stator 78, and, as mentioned above, the rotor 82 connects directly to the shaft 86.

An eccentric member 122 is on the shaft 86 and, during rotation, selectively activates one or more piston and cylinder assemblies (three illustrated) to dispense hydraulic fluid with a desired flow and pressure. Each piston and cylinder assembly incudes a piston 126 supported in a chamber or cylinder 130 defined by the housing assembly 110 (e.g., by the lower housing 118). A return spring 134 is provided for each piston 126 to return the piston 126 to the initial position from an activated position.

As mentioned above, the pump assembly 22 includes a two-stage pump assembly. In the first stage, the eccentric member 122 drives all of the pistons 126 to dispense fluid at a relatively high flow rate (e.g., about 200 $in^3$/min) and relatively low pressure (up to about 3,000 psi to about 4,000 psi). In the second stage, the eccentric member 122 continues to drive all of the pistons 126, but the hydraulic circuit 106 is controlled to unload (e.g., dump to atmosphere) a number of pistons 126 (e.g., two of the three pistons 126). The remaining piston(s) 126 (e.g., the remaining one piston 126) dispense fluid at a lower flow rate (e.g., initially, about 60 $in^3$/min to about 70 $in^3$/min, decreasing to about 30 $in^3$/min as pressure increases) and higher pressure (e.g., from about 3,000 to about 4,000 psi up to about 10,000 psi). In the illustrated construction, the pump assembly 22 thus uses common pistons 126 in both stages.

The circuit 106 includes (see FIGS. 1 and 23) an inlet 138 and an outlet 142 with connectors 146, 150. A valve assembly 154 (see FIGS. 1 and 6-8) is operable to control flow through the circuit 106. The valve assembly 154 includes a valve block 158 with passages (not shown) and an adjustable valve member 162. In the illustrated construction, the valve assembly 154 (FIG. 6) is manually actuated and includes an actuator 166 (e.g., a lever, handle, button, etc.) to direct flow through the valve assembly 154. The illustrated valve assembly 154 is a 4-way, 3-position valve operable between a first "advance" position, a second "retract" position and a neutral position. In the illustrated construction, a gage 170 is connected to the circuit 106 and displays conditions in the circuit 106 (e.g., the pressure).

As shown in FIGS. 2-6, a motor controller 174, an application controller 178, and a power board are each supported in an electronics package mounted, in the illustrated construction, on a pivoting door 34 separate and spaced from the motor assembly 18 and the pump assembly 22. In the illustrated embodiment, trays 420 are mounted to the doors 34. The motor controller 174, the application controller 178, and the power board are potted in the trays 420. A fan (not shown) may be provided to cause air flow through openings in the frame assembly 14 (e.g., through the end caps 30) to cool components of the pump 10 (e.g., the controllers 174, 178, the power board, the motor assembly 18, etc.).

The controllers 174, 178 are operable to, among other things, configure and control operation of the pump 10 and/or of its components. Each controller 174, 178 includes a processing unit (e.g., a microprocessor, a microcontroller, or another suitable programmable device), non-transitory computer-readable media, and an input/output interface. The processing unit, the media, and the input/output interface are connected by one or more control and/or data buses. The computer-readable media stores program instructions and data. The processing unit is configured to retrieve instructions from the media and execute the instructions to perform the control processes and methods described herein. The application controller 178 may also include a socket (not shown). Electronic components (not shown) are configured to be inserted into the socket and electrically connect with the application controller 178. The electrical components provide additional functionality like Bluetooth connectivity, which may allow a user to control the pump 10 using a smartphone or other electronic device. Alternatively or in addition, the electrical component may wirelessly transmit diagnostic data to a user's smartphone or other electronic device.

The input/output interface transmits data from the controller 174, 178 to external systems, networks, and/or devices and receives data from external systems, networks, and/or devices. The input/output interface stores data received from external sources to the media and/or provides the data to the processing unit.

In the illustrated construction, the motor controller 174 operates to control the motor assembly 18 to provide substantially constant power control of motor assembly 18. In the illustrated method, field weakening is employed to achieve the desired speed and torque of the motor assembly 18. The controller 174 is operable to control the motor assembly 18 accordingly. The illustrated controller 174 operates the motor assembly 18 in a sensorless configuration. However, in other constructions (not shown), the controller 174 and the motor assembly 18 would include sensors.

The controller 174 may be programmed to achieve different speeds and target peak efficiency with algorithms for substantially constant power and flow curves. Additional functions, such as, for example, pressure control with a sensor or based on instantaneous motor current and speed, may be added that utilize the "smart control" of the controller 174.

The application controller 178 interfaces with various components of the pump 10. The pendant 66 provides a user-held remote control device communicating with the controller 178 (e.g., via cables or hard-wired connectors such as USB, RS-232, serial or parallel link, and Ethernet cables, or using wireless interfaces such as Bluetooth or IEEE 801.11 compatible devices) to provide user inputs to control operation of the pump 10.

Figure 9:
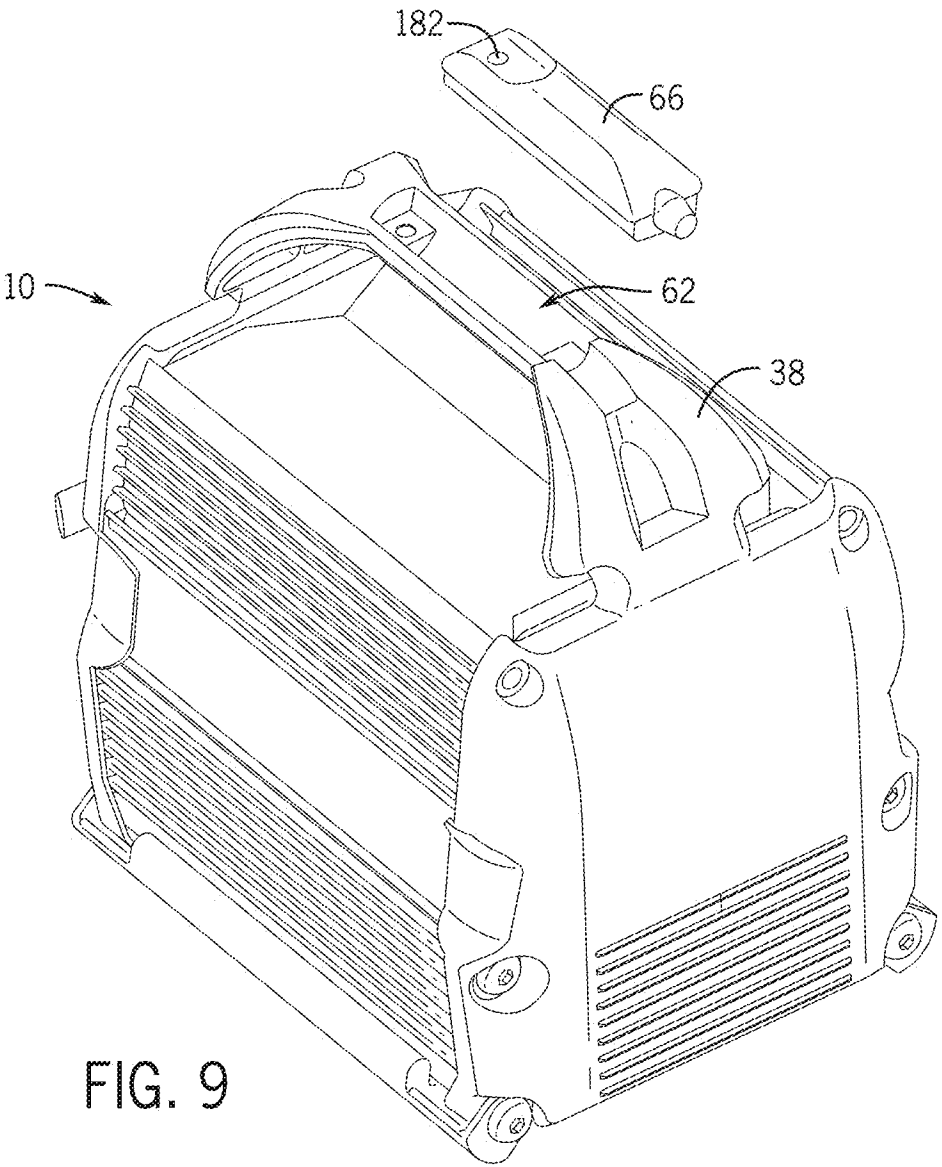
FIG. 9 is a rear perspective view of the pump shown in FIG. 1 with the pendant removed.

As shown in FIG. 9, the handle 38 is constructed to provide storage (e.g., a receptacle 62) for a remote controller, such as a pendant 66. A retainer assembly (not shown) is provided between the handle 38 and the pendant 66. The retainer assembly may include, for example, a detent, a magnet, a strap, etc.

Figure 14:
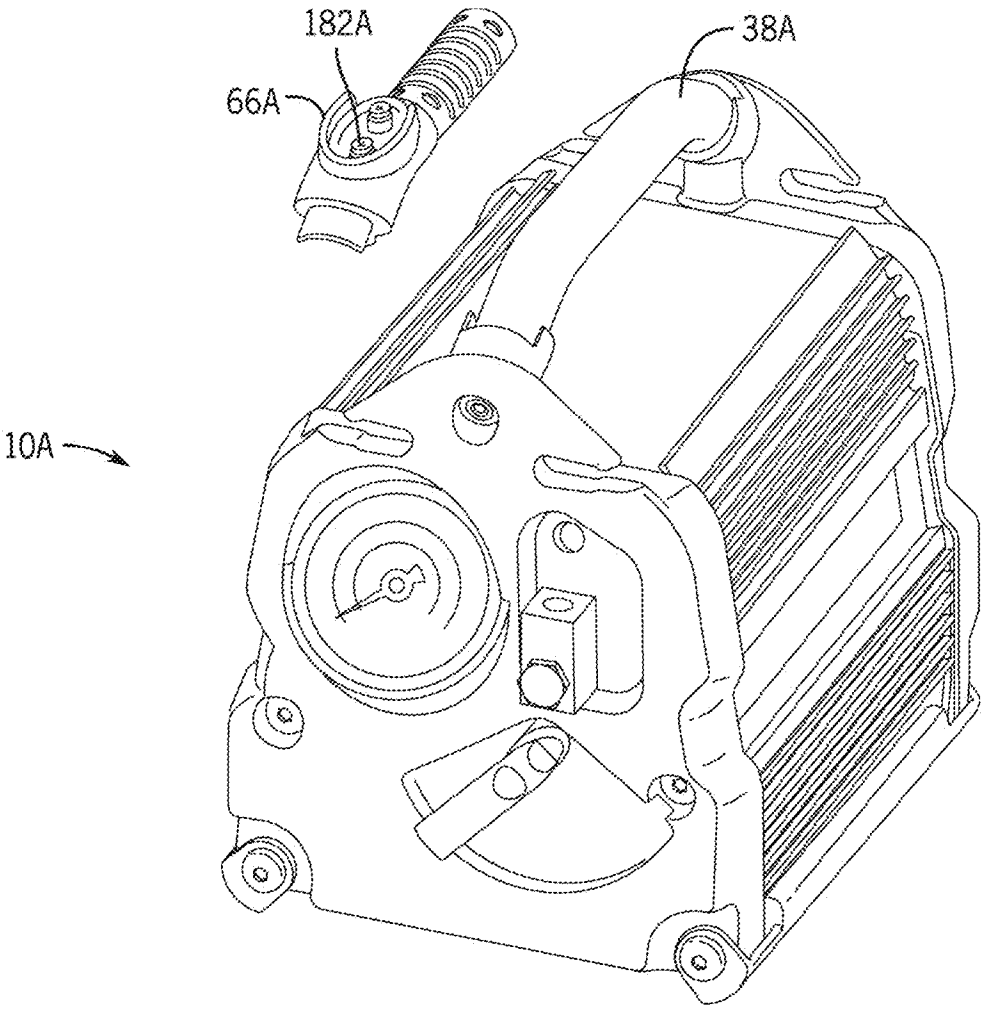
FIG. 14 is a front perspective view of the pump shown in FIG. 10 with the pendant removed.

In the illustrated construction, the pendant 66 includes one switch 182, providing a simple interface for the user. In other embodiments, the pendant 66 may include multiple switches 182 (FIG. 14). Win some embodiments, when a switch 182 is depressed, the application controller 178 sends a signal to the motor controller 174 to turn on and run the motor assembly 18 and, thereby, operates the pump assembly 22 until the switch 182 is released.

The controller 178 receives information from and transmits information to the components of the pump 10 and generally controls operation of the pump 10. For example, the controller 178 receives information regarding the status/characteristics of the components (e.g., the pressure/flow through the pump assembly 22, temperature of the pump 10 and its components, valve position, etc.).

The application controller 178 controls operation of the pump 10 and its components. As mentioned above, based on the signal from the pendant switch 182, the application controller 178 causes the motor controller 174 to operate the motor assembly 18. The application controller 178 may also control, for example, the fan based on sensed temperatures, indicators (e.g., light-emitting diodes (LEDs)) to indicate pump conditions, an electrical valve assembly, etc.).

Figure 23:
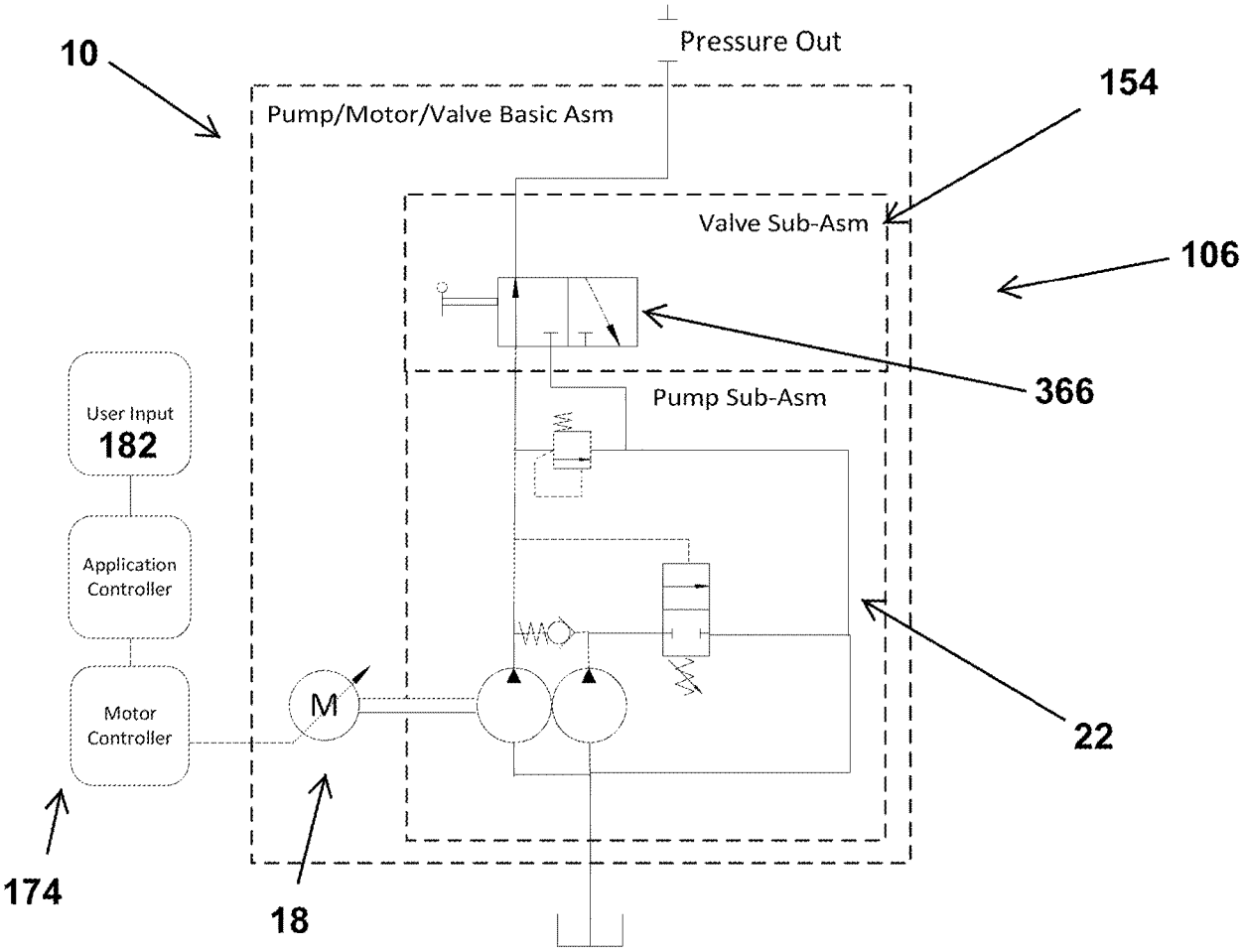
FIG. 23 is a schematic diagram of a circuit of the pump shown in FIG. 1.

FIGS. 17-22 illustrate alternative constructions of a reservoir 186. The reservoir 186 contains hydraulic fluid to be dispensed and communicates with the circuit 106 (FIG. 23). The reservoir 186 is formed within the support frame 26 cooperating with end walls 188. In the illustrated construction, the reservoir 186 includes an integrated heat exchanger 190 to cool the fluid.

The heat exchanger 190 includes channels 194 in the reservoir 186. As shown in FIG. 17-21, the channels 194 are provided by channel members 198 received in the reservoir 186. The channel members 198 are supported in slots 202 in the wall of the reservoir 186.

Figure 20:
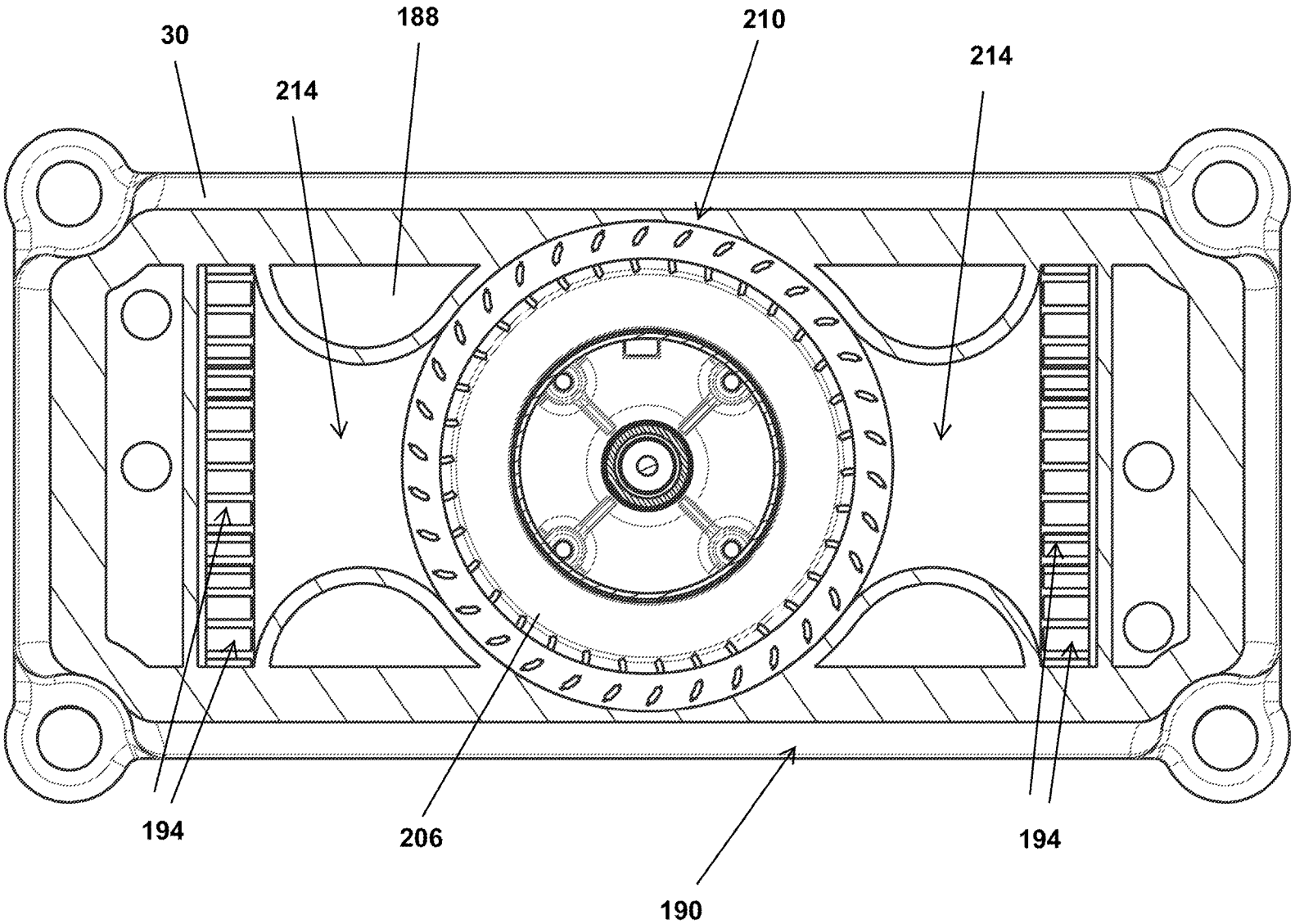
FIG. 20 is a cross-sectional view of the reservoir shown in FIG. 17 taken generally along line 20-20 in FIG. 18.
Figure 21:
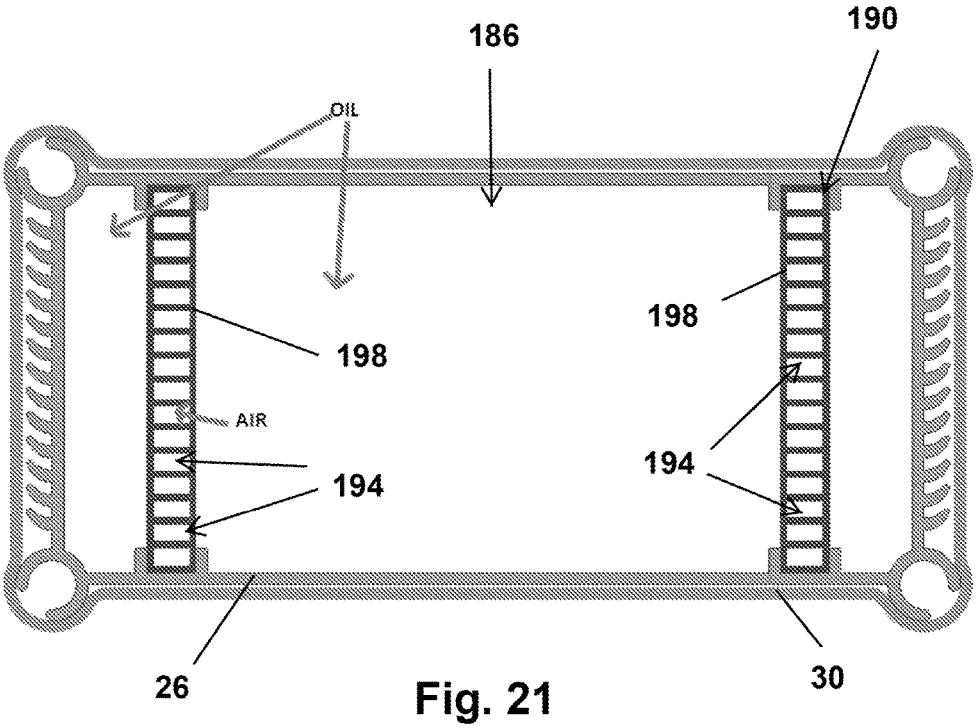
FIG. 21 is another cross-sectional view of the reservoir shown in FIG. 17 similar to FIG. 19.
Figure 22:
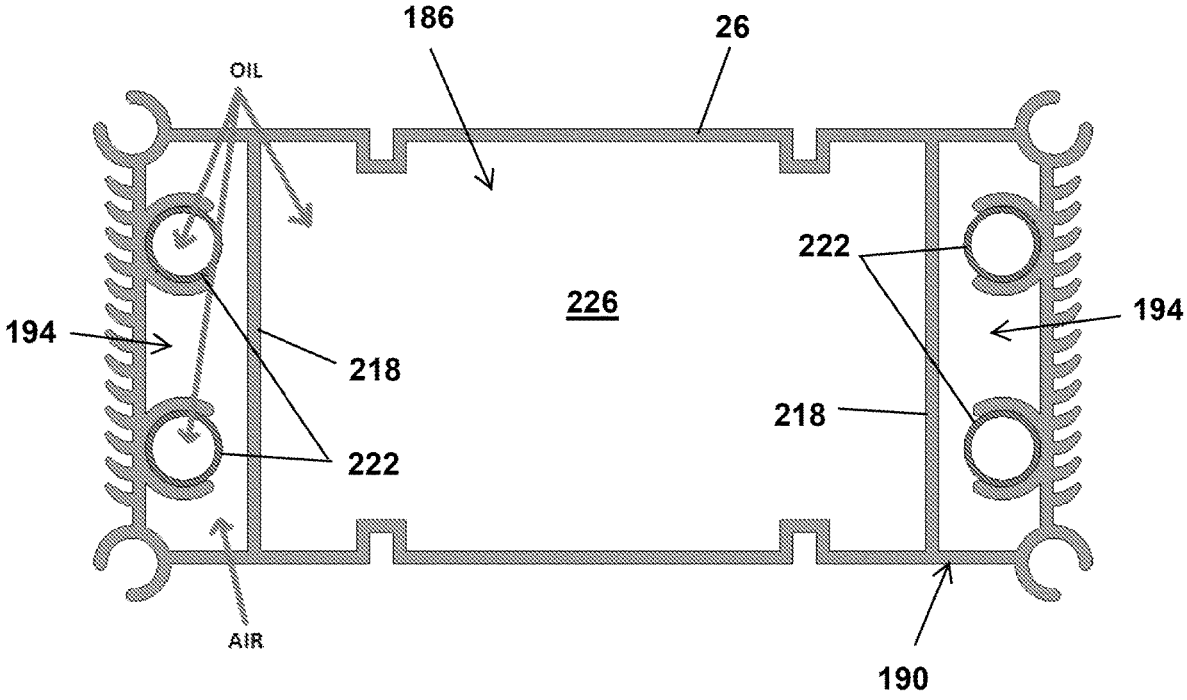
FIG. 22 is a cross-sectional view of an alternative construction of a reservoir including an integrated heat exchanger.

A radial fan 206 is supported by the end cap 30 and blows cooling air through the channels 194 to cool fluid on each side of the channel members 198. As shown in FIG. 20, the end cap 30 defines a chamber 210 and passages 214 to direct air flow to the channels 194.

In an alternate construction shown in FIG. 84, the channels 194 may be formed by partition walls 218 in the reservoir 186. Conduits 222 carry fluid through each channel 194 and back to a main fluid section 226 of the reservoir 186. In this construction, the fan 206 (FIG. 17) is blows cooling air through the channels 194 to cool fluid on each side of the partition walls 218 (e.g., in the conduits 222 or in the main section 226). As shown in FIG. 20, the end cap 30 defines a chamber 210 and passages 214 to direct air flow to the channels 194.

Figure 24:
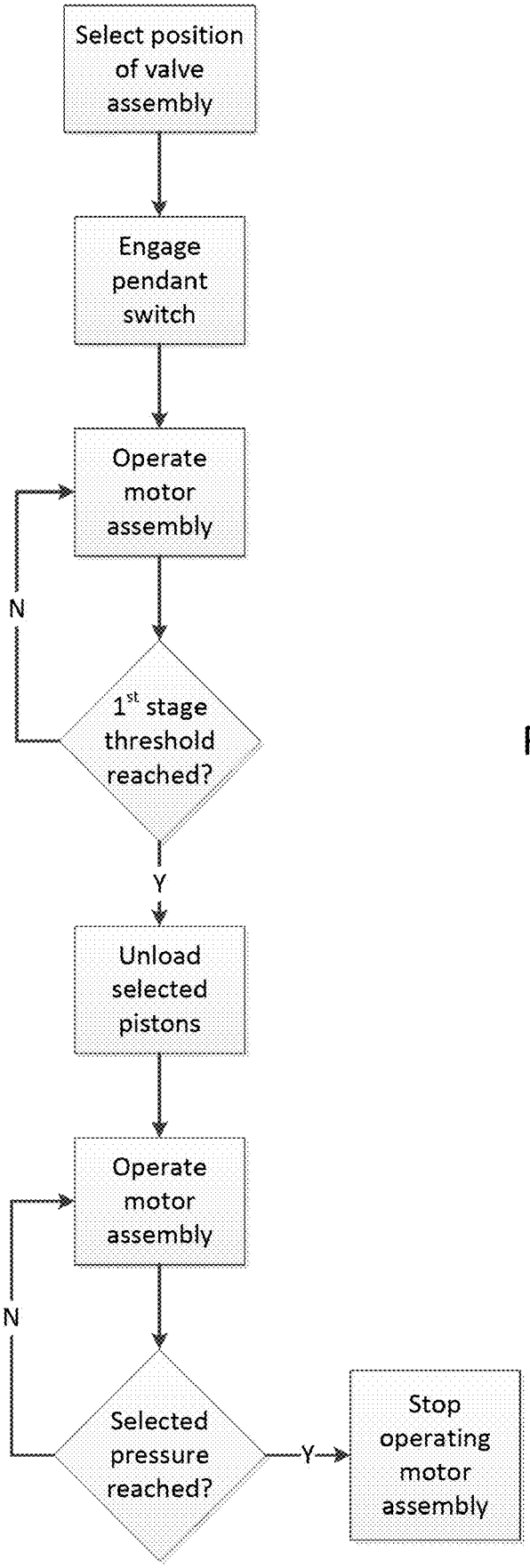
FIG. 24 is a flowchart illustrating a method of operating the pump shown in FIG. 1.
Figure 25:
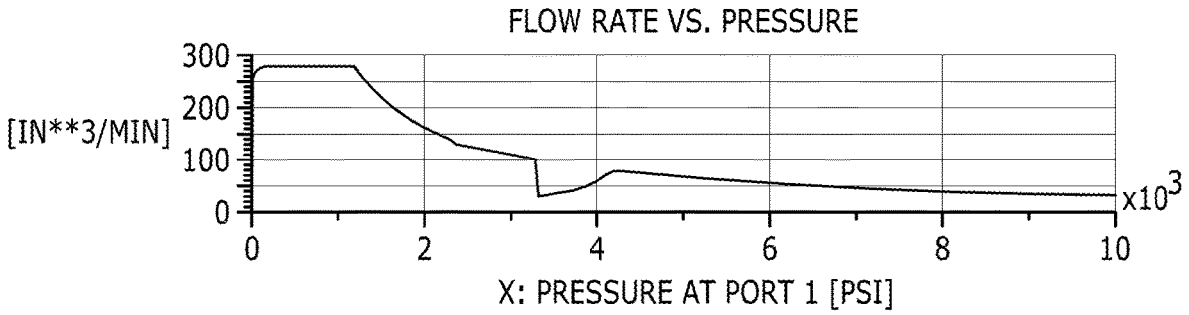
FIG. 25 is a graph of simulated flow (CIM) versus pressure (psi) for the pump of FIG. 1.
Figure 26:
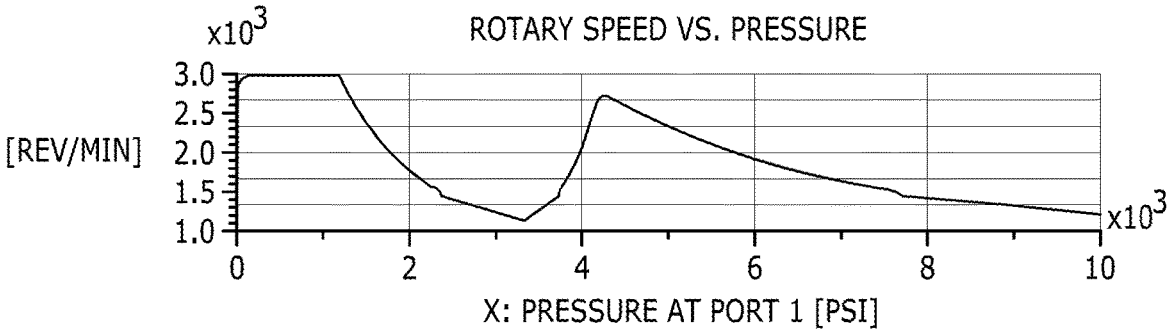
FIG. 26 is a graph of simulated torque (Nm) versus pressure (psi) for the pump of FIG. 1.
Figure 27:
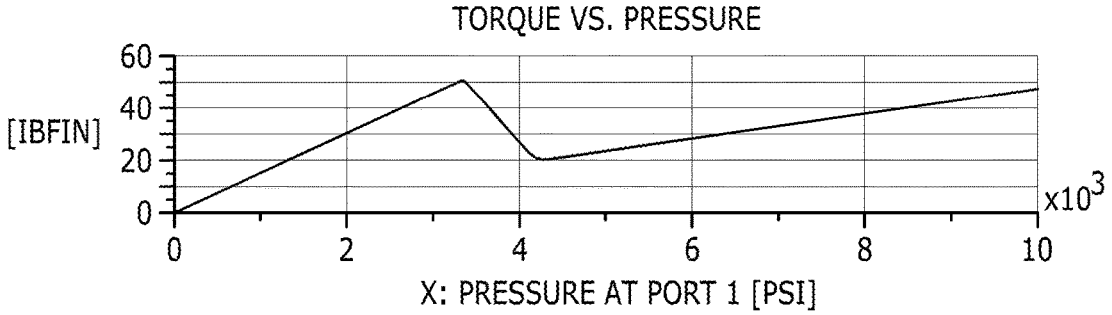
FIG. 27 is a graph of the simulated speed (rpm) versus pressure (psi) for the pump of FIG. 1.

FIG. 24 illustrates a method of operating the pump 10 executed by the controller 174. In operation, the user selects the position of the valve assembly 152 and engages the motor assembly 18 to drive the pump assembly 22 (e.g., by actuating the switch 190). The motor assembly 18 initially operates at maximum speed for a minimum load (and a minimum pressure provided by the pump assembly 22). As the load and the pressure increase, the motor assembly 18 slows. When the load and the pressure reach an upper threshold for the first stage, the circuit 106 is controlled to unload selected pistons 126 (again, two of the three pistons 126 dispense fluid to atmosphere).

The remaining piston(s) 126 (one piston 126) is operated to provide flow and pressure in the second stage. With pistons 126 unloaded, the speed of the motor assembly 18 ramps up to its maximum. As the load and the pressure provided by the remaining piston 126 increases, the speed of the motor assembly 18 decreases. The pump 10 is operated until the desired pressure (up to the maximum) is achieved.

Figure 28:
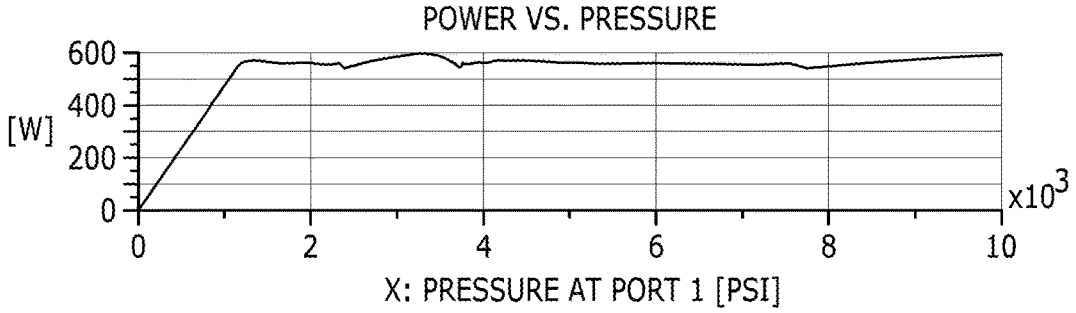
FIG. 28 is a graph of simulated power (W) versus pressure (psi) for the pump of FIG. 1.

FIGS. 26-29 illustrate simulated performance (flow, speed, torque and power versus pressure) of the pump 10 at 3,000 revolutions per minute (RPM). As illustrated in FIG. 28, the pump has a substantially constant power output upon reaching a lower limit of its operating pressure (e.g., between 1,500 and 2,000 psi).

As discussed above, in the illustrated construction, the pump assembly 22 is a two-stage pump assembly. It should be understood that, in other constructions (not shown), this operation could be carried out for any number of stages with the pump assembly 22 being operated as or having an associated multi-stage pump assembly.

In the pump 10, having the motor assembly 18 adjust speed to maintain peak power based on pressure (load) may allow for improved flow rate throughout the pressure range. Thus, a smaller size pump assembly 22/motor assembly 18 may be able to achieve the same or increased performance compared to larger ones.

FIGS. 10-16 illustrate an alternative construction of a pump 10A similar to the pump 10. Common elements have the same reference number "A".

As shown in FIG. 14, the handle 38A is arranged to support and retain the pendant 66A. The pendant 66A includes a number of switches 182A (two illustrated) for communicating with the controller 174A.

Figure 10:
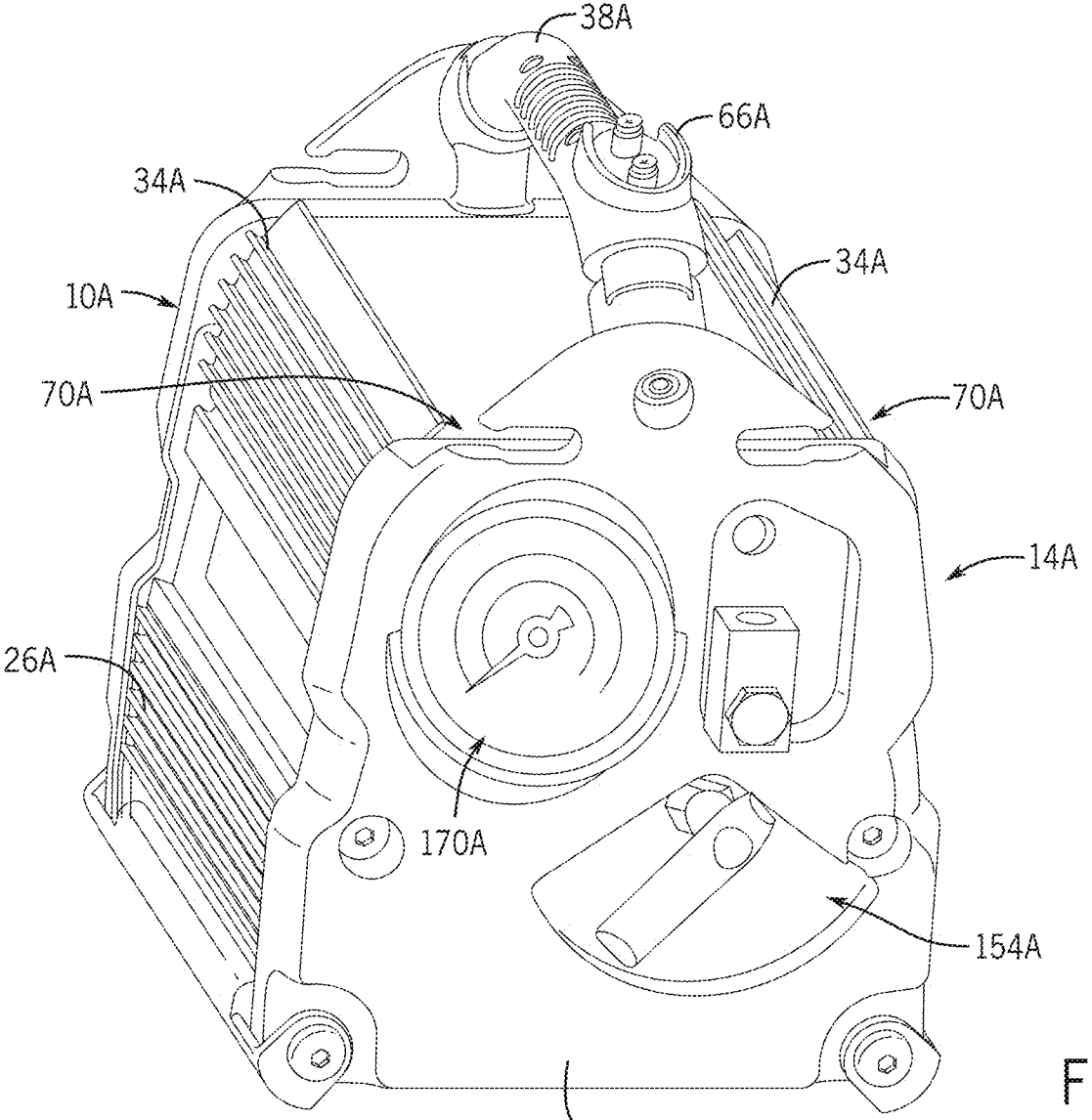
FIG. 10 is a front perspective view of a further alternative construction of a pump.
Figure 11:
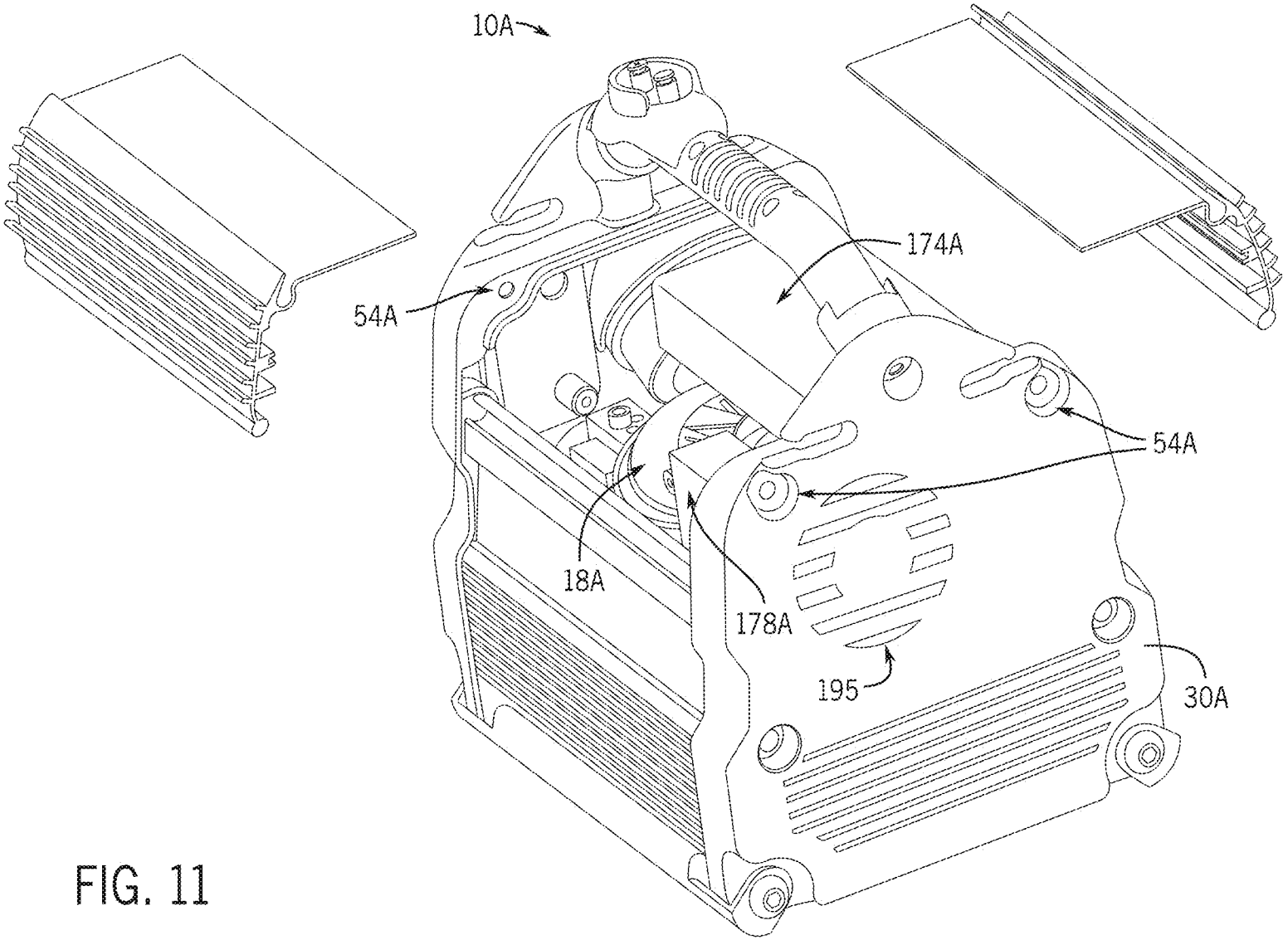
FIG. 11 is a rear perspective view of the pump shown in FIG. 10 with the doors removed.
Figure 12:
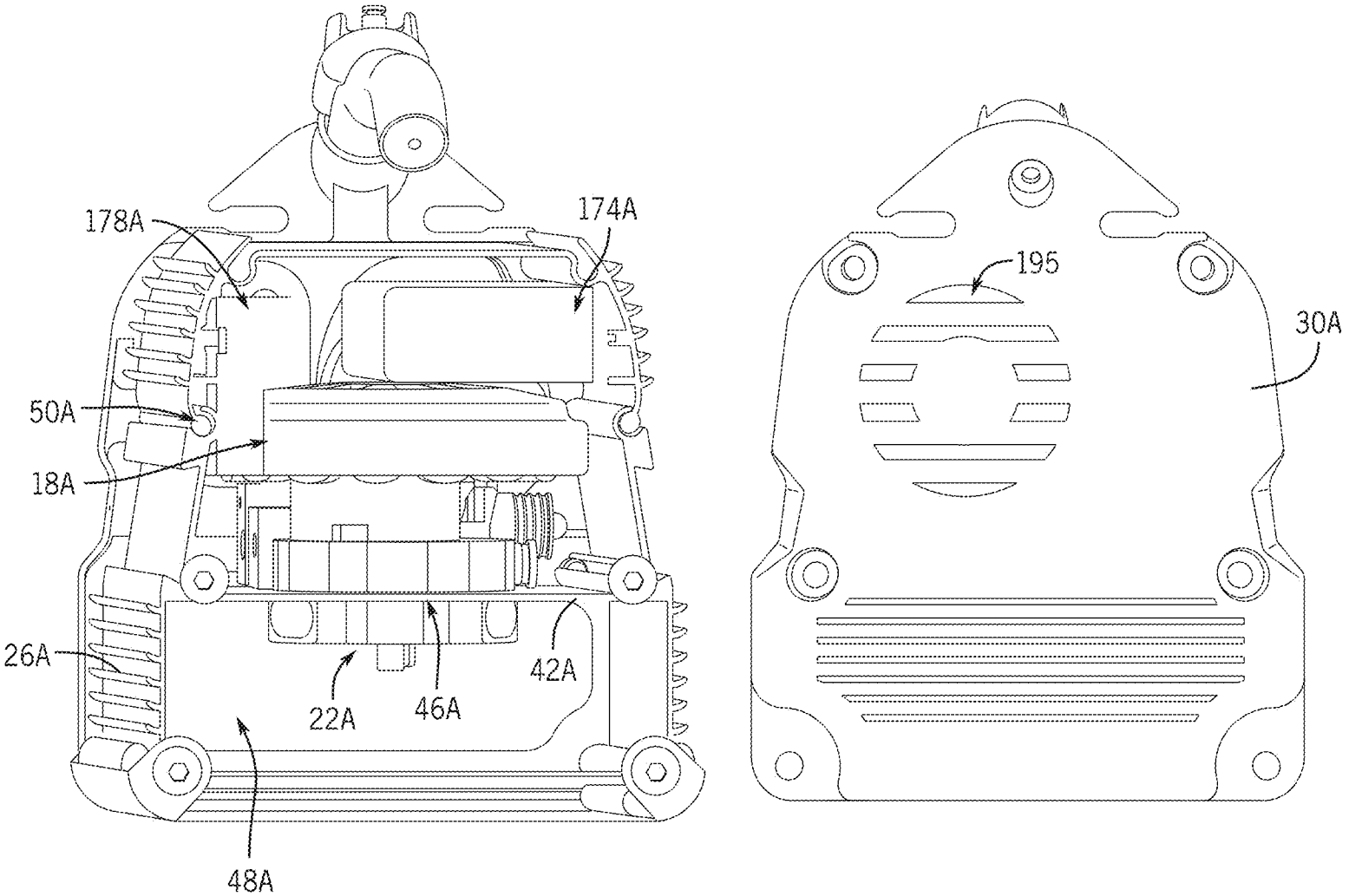
FIG. 12 is a rear perspective view of the pump shown in FIG. 10 with the rear end cap removed.
Figure 13:
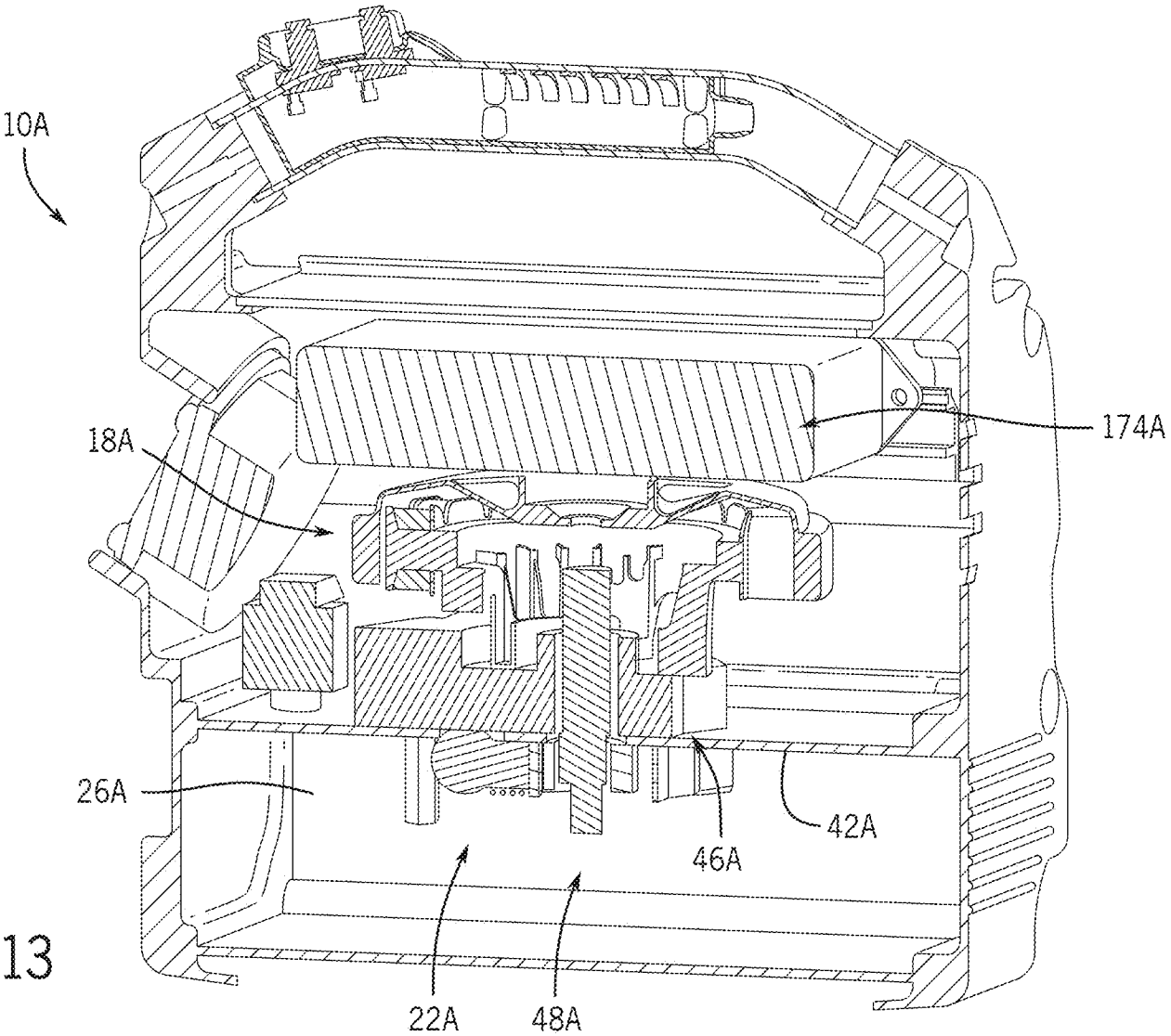
FIG. 13 is a right side cross-sectional view of the pump shown in FIG. 10.

As shown in FIG. 11, the rear end cap 30A defines an opening 195 for air flow for the fan 206. As shown in FIG. 10, each end cap 30A includes a cord wrap portion 70A. The opposite ends of the handle 38A are received by the respective cord wrap portions 70A.

In other constructions, the pump 10, including the motor assembly 18 and the pump assembly 22, may be similar to that described in U.S. Provisional Patent Application No. 62/491,566, filed Apr. 28, 2017, the entire contents of which are hereby incorporated by reference. In such constructions, the pump 10 is battery-powered and includes a high voltage (e.g., having a nominal voltage of 60 V or greater) DC power unit (one or more battery packs), and the pump assembly 22 may include a 3-stage hydraulic pump assembly.

FIGS. 29-47 illustrate a pump 10B according to another embodiment. The pump 10B is similar to the pump 10. Similar features are identified with similar reference numbers, plus the letter "B".

As shown in FIGS. 29-31B, the pump 10B includes a viewing lens or sight glass 230. In the illustrated embodiment, the sight glass 230 is formed via injection molding. The sight glass 230 is positioned adjacent the front end cap 30B and an exterior surface 232 of the sight glass 230 may be substantially flush with a surface of the front end cap 30B.

Figure 30A:
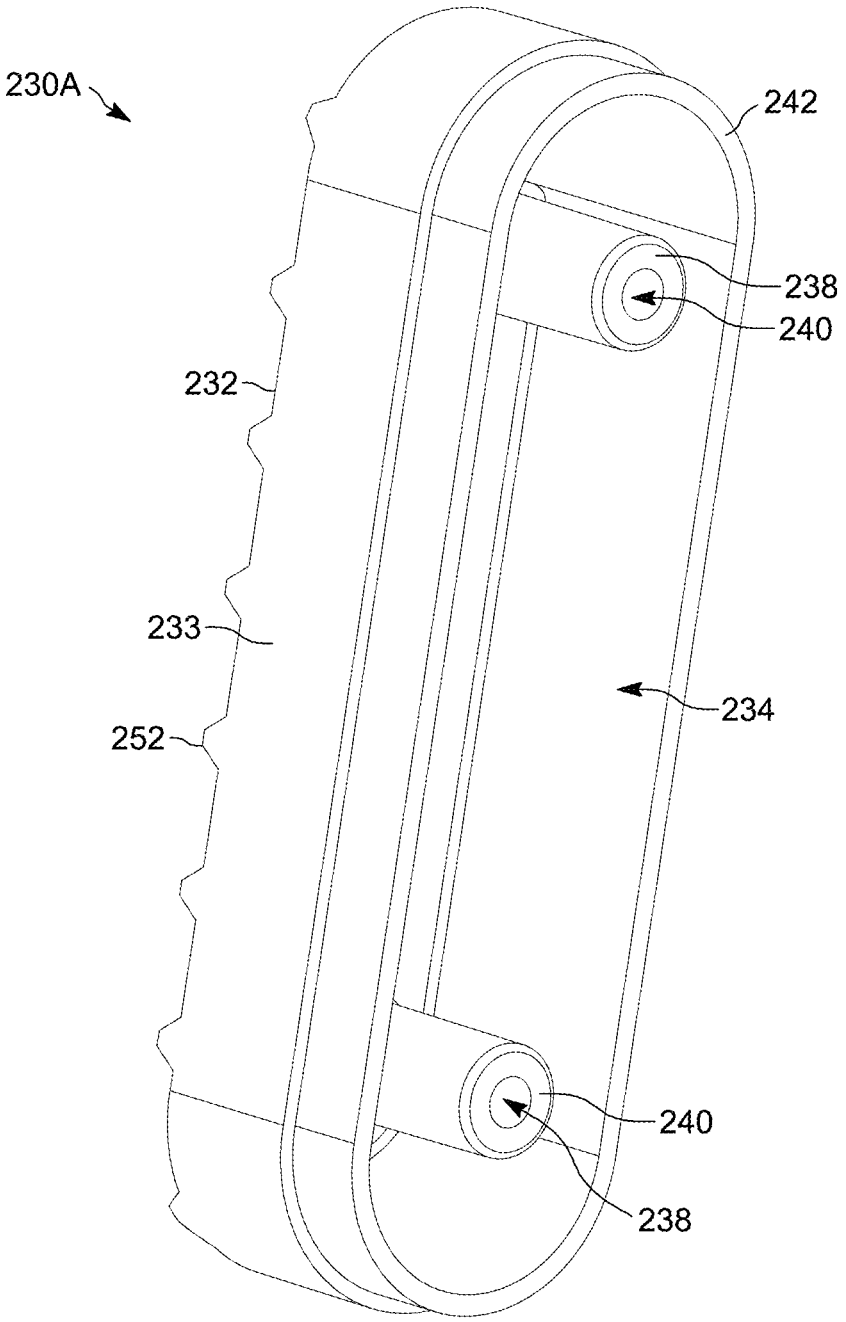
FIG. 30A is a rear perspective view of a viewing lens.

As shown in FIG. 30A, the sight glass 230 is formed as an elongated member including an exterior face 232 and a peripheral wall 233 extending around a cavity 234. When the sight glass 230 is secured to the front end cap 30B (FIG. 31A), the cavity 234 is enclosed between the exterior surface 232, the peripheral wall, and the front end cap 30B. The cavity 234 has a shape similar to the shape of the sight glass 230. In the illustrated embodiment, the sight glass 230 includes two bosses 238 protruding from an inner surface of the exterior face 232 through the cavity 234. The bosses 238 extend and have an end surface substantially co-planar with an edge 242 of the peripheral wall. Each boss 238 includes an opening 240 extending through the end surface.

Figure 30B:
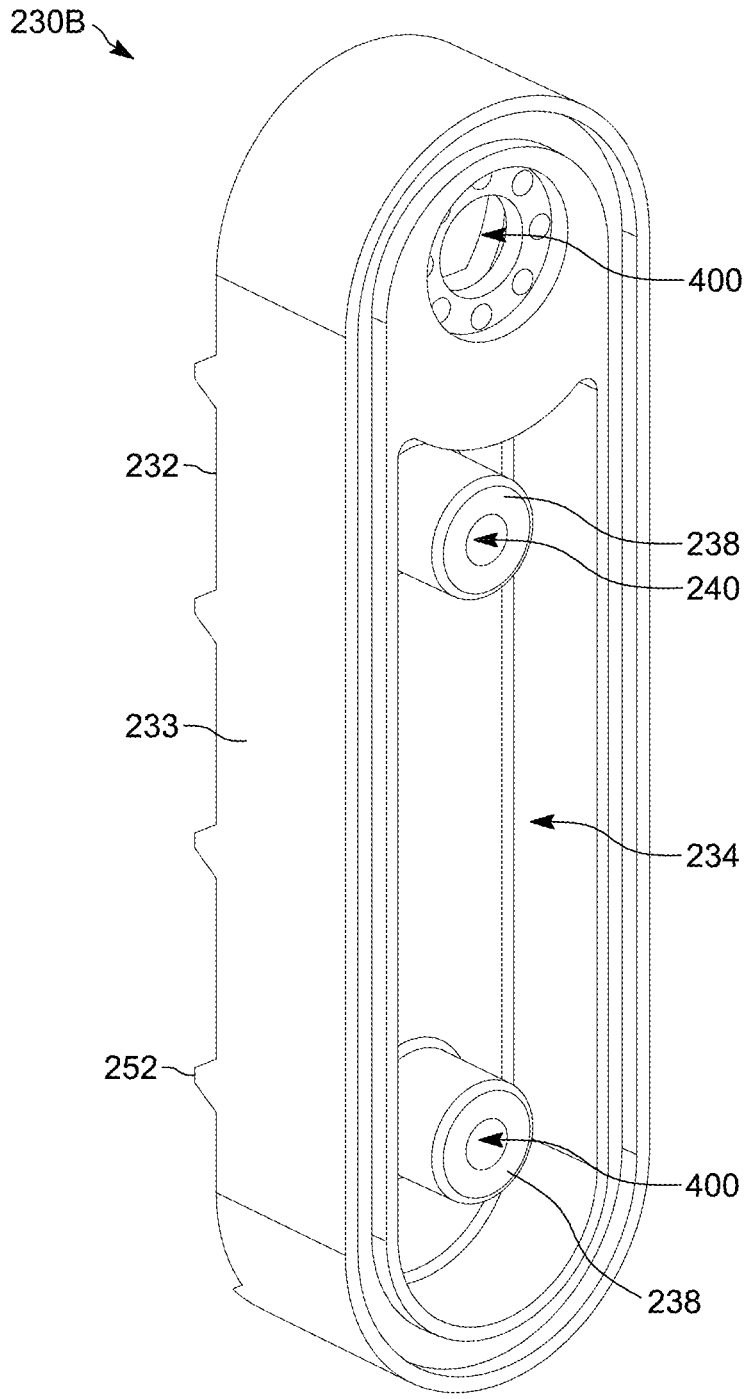
FIG. 30B is a rear perspective view of an alternate construction of a viewing lens.

In some embodiments, the sight glass 230 includes a double check valve 400 that is press molded into the sight glass 230 (FIG. 30B). The double check valve 400 defines a breather system that includes an umbrella valve and a duckbill valve. Both the umbrella valve and the duckbill valve are one-way valves, and are oriented in opposite directions (i.e., the umbrella valve allows fluid flow in a first direction and the duckbill valve allows fluid flow in a second direction that is opposite the first direction).

Figure 31A:
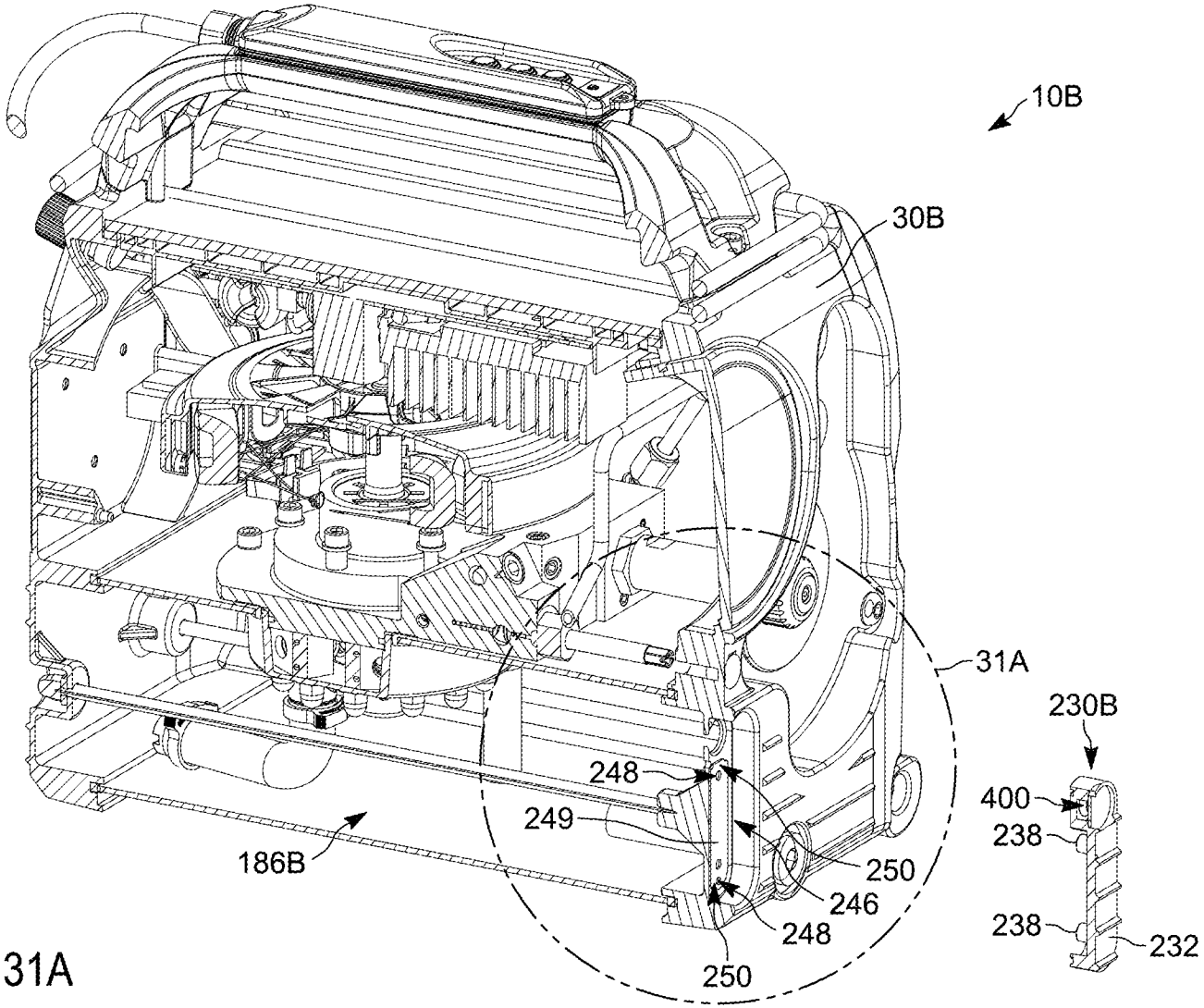
FIG. 31A is a cross-sectional view of the pump shown in FIG. 29 taken generally along line 31-31.
Figure 31B:
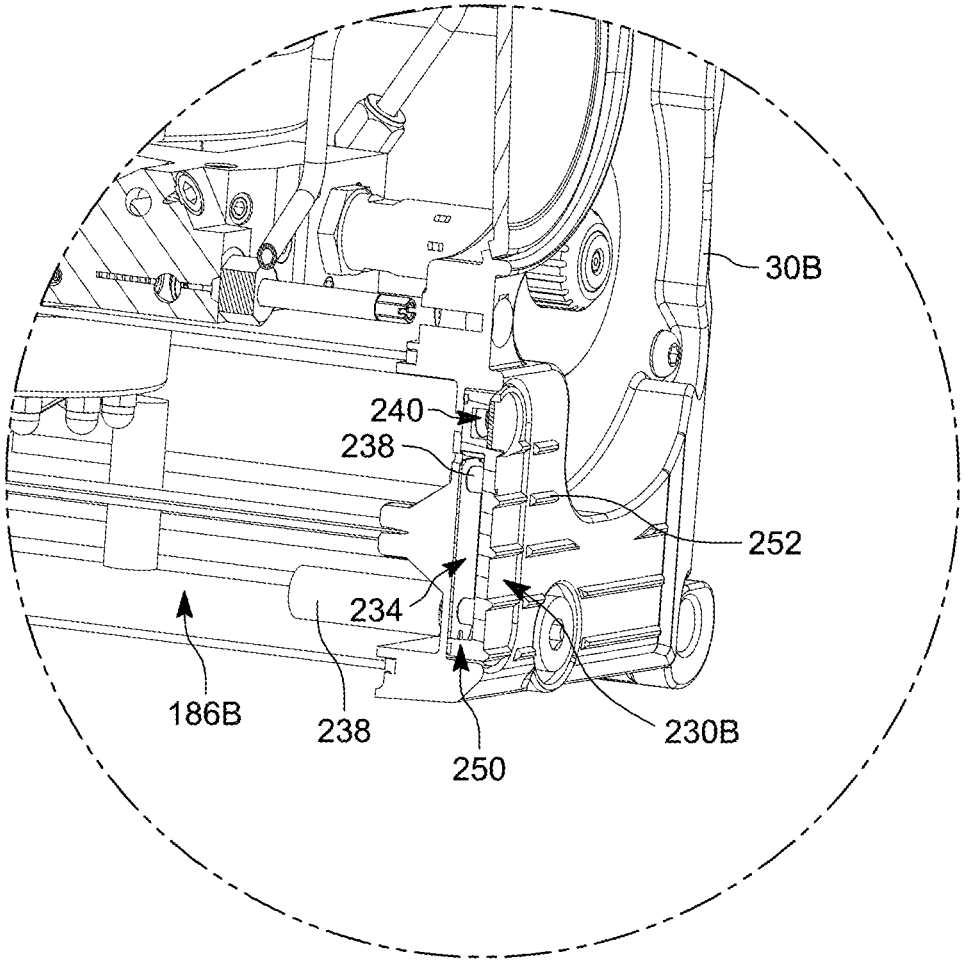
FIG. 31B is an enlarged view of the pump shown in FIG. 31 taken generally along 31B.

As shown in FIGS. 31A and 31B, the pump 10B has a recess 246 which receives the sight glass 230. In the illustrated embodiment, the recess 246 of the pump 10B is slightly larger than the sight glass 230 to allow the sight glass 230 to fit snugly within the cavity 246. In the illustrated embodiment, the cavity 246 of the pump 10B has two fastening apertures 248 and two fluid apertures 250. Each boss 238 of the sight glass 230 aligns with the one of the fastening apertures 248. A fastening member (e.g., a threaded screw—not shown) may be inserted from within the reservoir 186B, through one of the fastening apertures 248, and into one of the bosses 238. The fastening member secures the edge 242 against a plate 249 positioned in the base of the recess 246 to seal the cavity 234, thereby securing the exterior face 232 of the sight glass 230 flush with a surface of the pump 10B.

The fluid apertures 250 allow fluid from the reservoir 186B to flow into the cavity 234 of the sight glass 230 when the pump 10B and sight glass 230 are coupled together. Hydraulic fluid fills the cavity 234 proportional to a fluid level in the reservoir 186B. In the illustrated embodiment, the exterior surface 232 of the sight glass 230 is a viewing window and includes measurement markers 252 (FIG. 31B), which may provide a visual indication to a user regarding an amount (e.g., a percentage) of fluid that is in the reservoir 186B. In some embodiments, the plate against which the sight glass 230 is secured may include a reflective surface.

The duckbill valve and the umbrella valve provide fluid communication between the reservoir 186B and the external environment. A fluid (e.g., air) in the external environment can flow through the duckbill valve and into the reservoir 186B to ensure that there is sufficient air within the reservoir 186B. Air can flow from the reservoir 186B and through the umbrella valve to the external environment to relieve pressure within the reservoir 186B.

Figure 32:
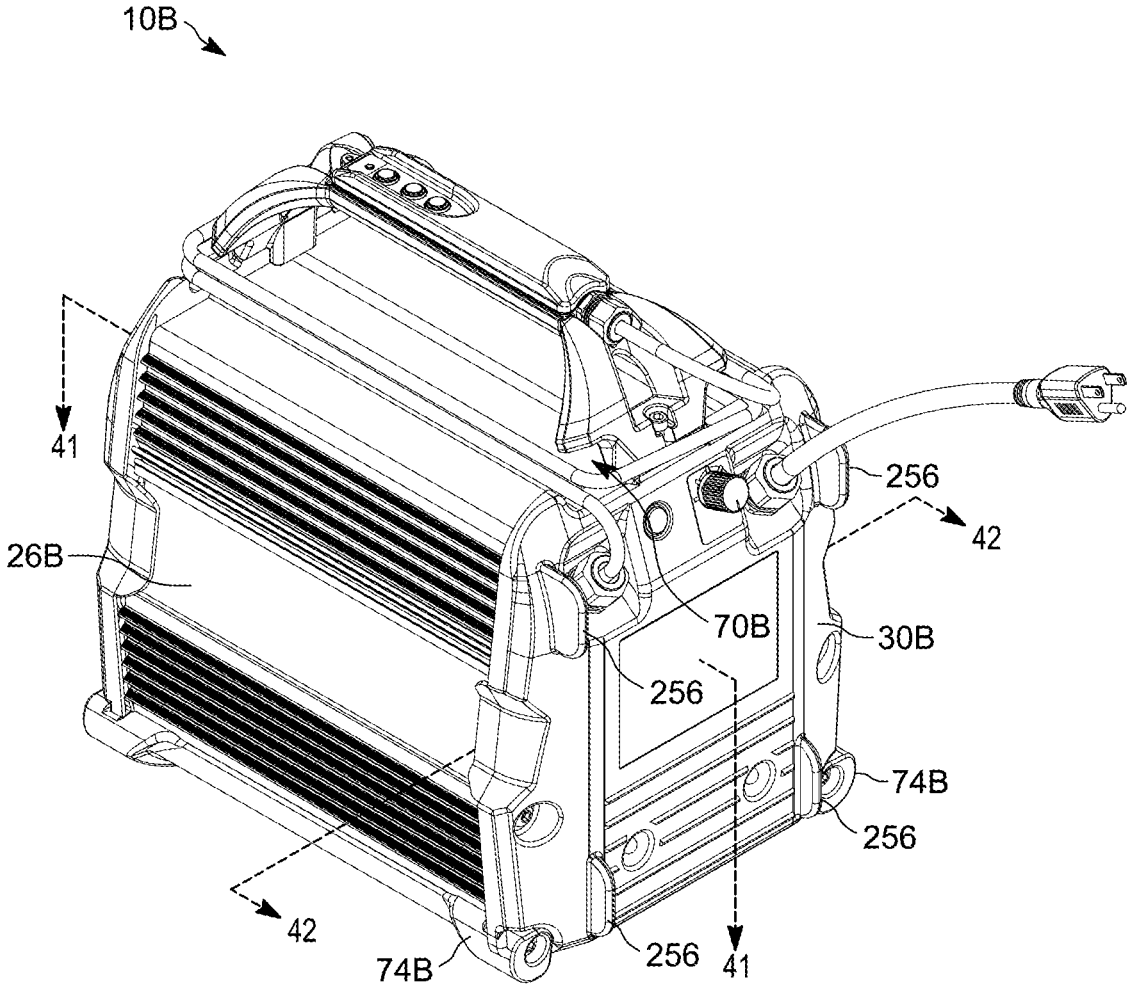
FIG. 32 is a rear perspective view of the pump of FIG. 29.

FIG. 32 illustrates feet 256 of the pump 10B positioned on the rear end cap 30B. In the illustrated embodiment, each foot 256 is positioned proximate a corner of the rear end cap 30B.

Figure 33:
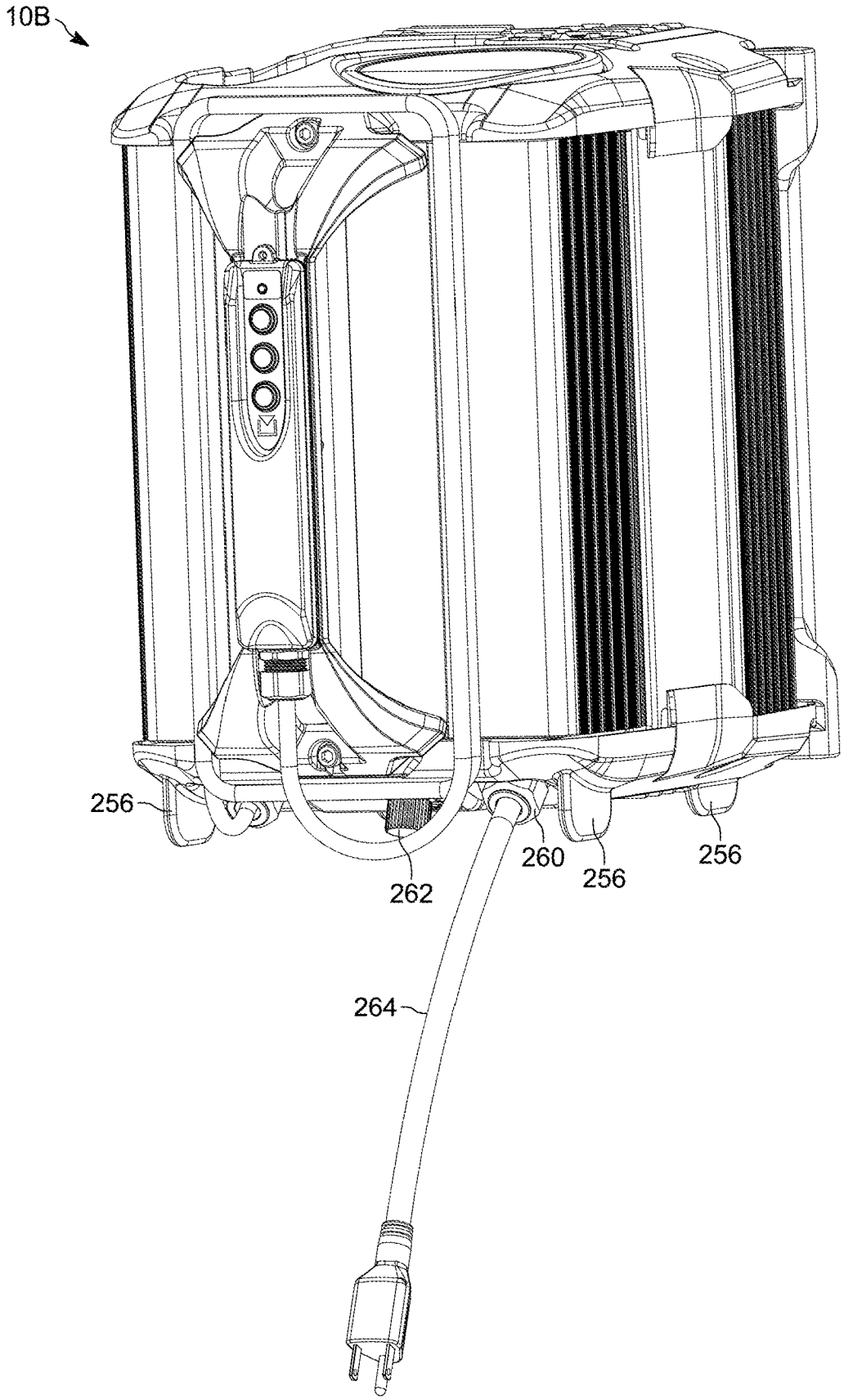
FIG. 33 is a rear perspective view of the pump of FIG. 29, in a second orientation.
Figure 34:
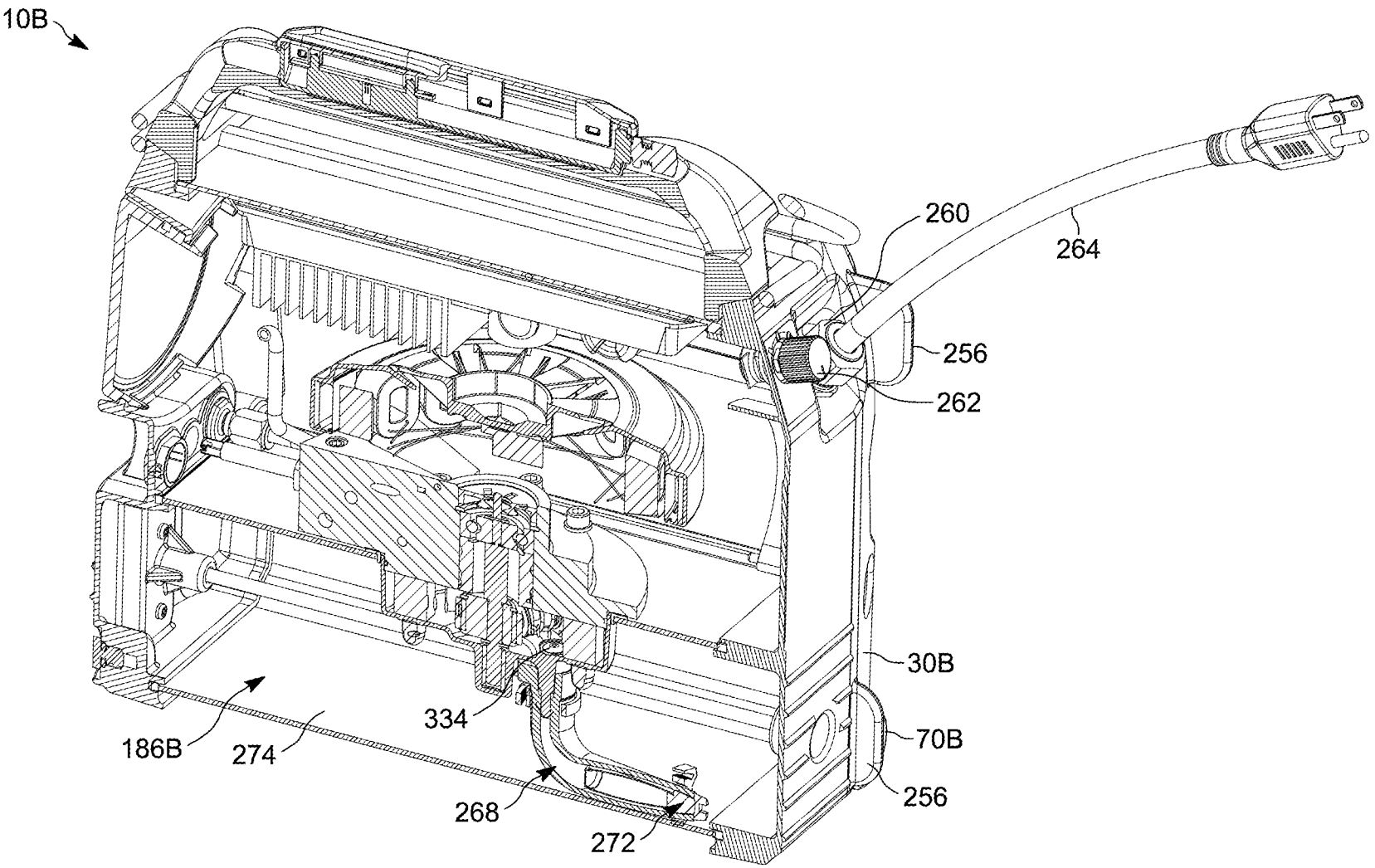
FIG. 34 is a cross-sectional view of the pump shown in FIG. 29 taken generally along line 34-34.
Figure 35:
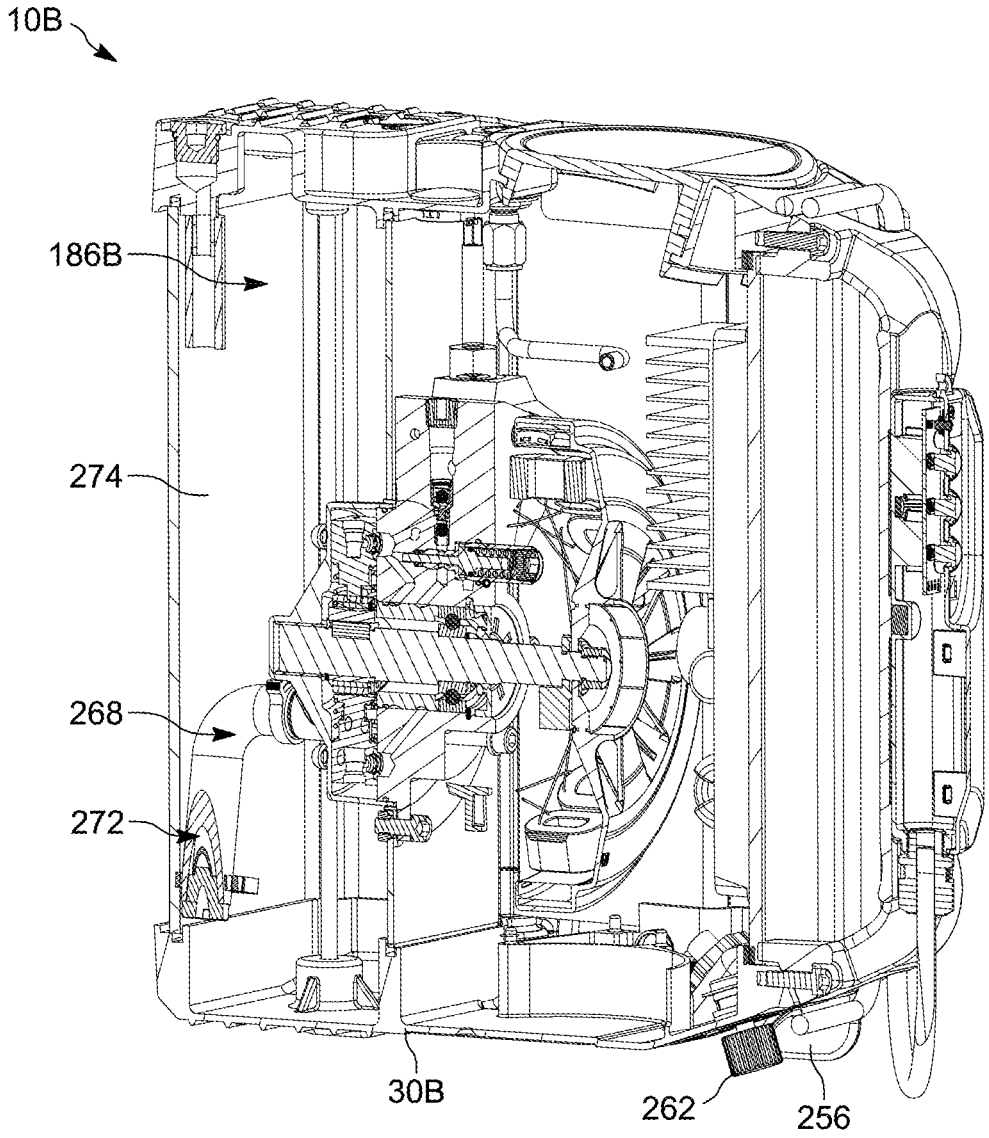
FIG. 35 is a cross-sectional view of the pump shown in FIG. 29 in a second orientation, taken generally along line 34-34.

As shown in FIG. 33, the pump 10B may be oriented so that the rear end cap 30B is positioned proximate the ground or other support surface (not shown), and the feet 256 engage the ground. The feet 256 extend away from the rear end cap 30B so that the rear end cap 30B is spaced apart from the ground. Electrical components like conduit couplings 260 for electrical conduit (e.g., power cords) and control knobs 262 extend away from the rear end cap 30B and are oriented at an oblique angle (e.g., a non-parallel angle such as 45 degrees) with respect to a surface of the rear end cap 30B. Stated another way, the features such as the conduit couplings 260 and control knobs 262 are oriented at an oblique angle relative to a plane defines by the end surface of the feet 256. This angled orientation prevents the couplings 260 and the knobs 262 from being pressed between the pump 10B and the ground while the pump 10B is supported by the feet 256. The obliquely angled conduit couplings 260 allow electrical conduit 264 to extend away from the rear end cap 30B without bending or creasing while the feet 256 support the pump 10B.

The positioning of a pump intake 268 allows the pump 10B to operate in either a first or second position (e.g., while the pump 10B is supported by 74B, or while the pump 10B is supported by feet 256). As shown in FIGS. 100 and 101, an opening 272 of the pump intake 268 is positioned within the reservoir 186B and proximate an edge or junction between the rear end cap 30B and a lower side 274 of the support frame 26B (FIG. 32). In other words, the opening 272 is positioned proximate a lower end of the reservoir 186B when either set of feet 74B, 256 rest on the ground. The positioning of the opening 272 facilitates fluid flow into the pump inlet 268 from the reservoir 186B in multiple orientations of the pump 10B. Also, the feet 74B, 256 are formed from a polymeric or synthetic rubber material (e.g., TPU), thereby acting as vibrational isolators to reduce wear on the pump housing.

Figure 36:
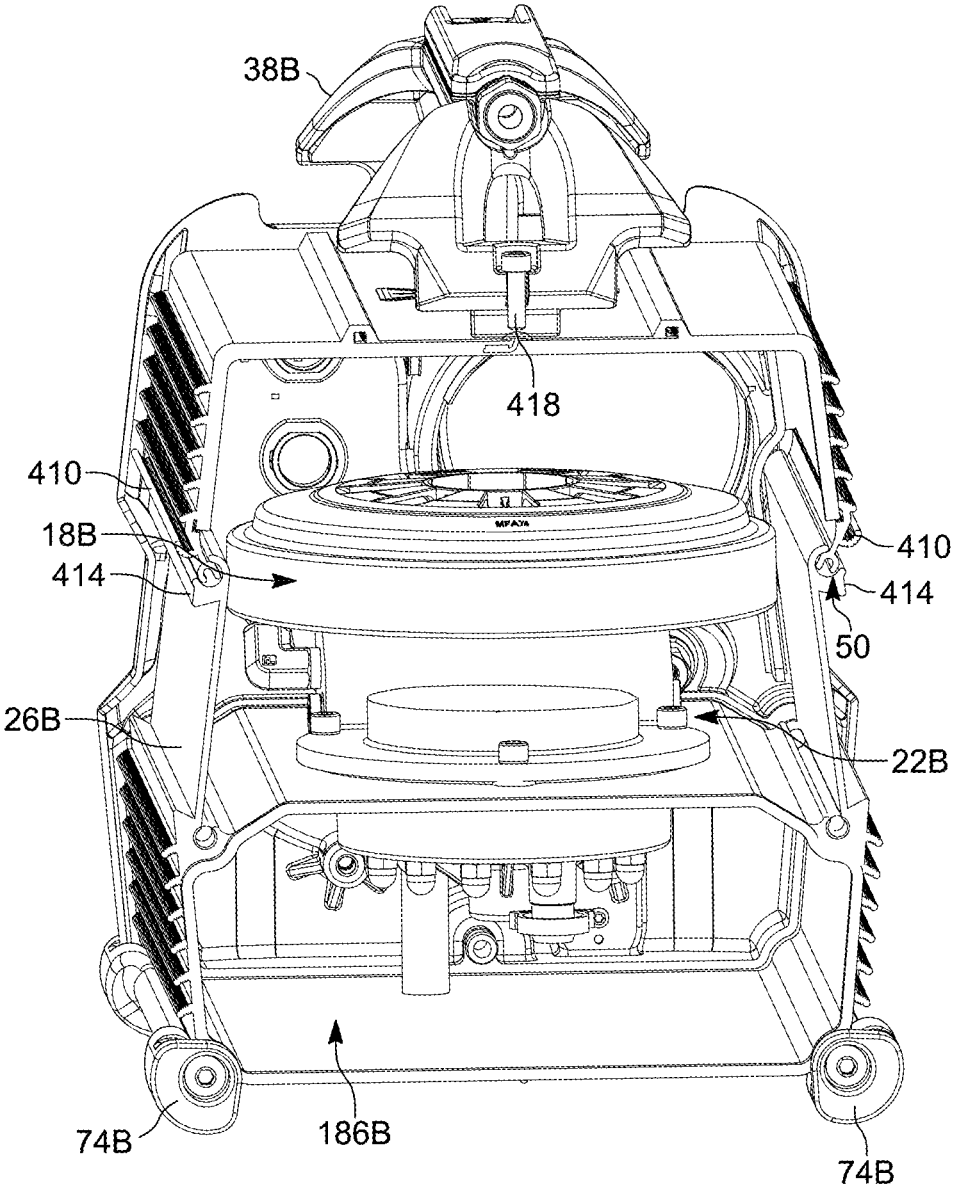
FIG. 36 is an end view of the pump shown in FIG. 29, with an end plate removed.
Figure 37:
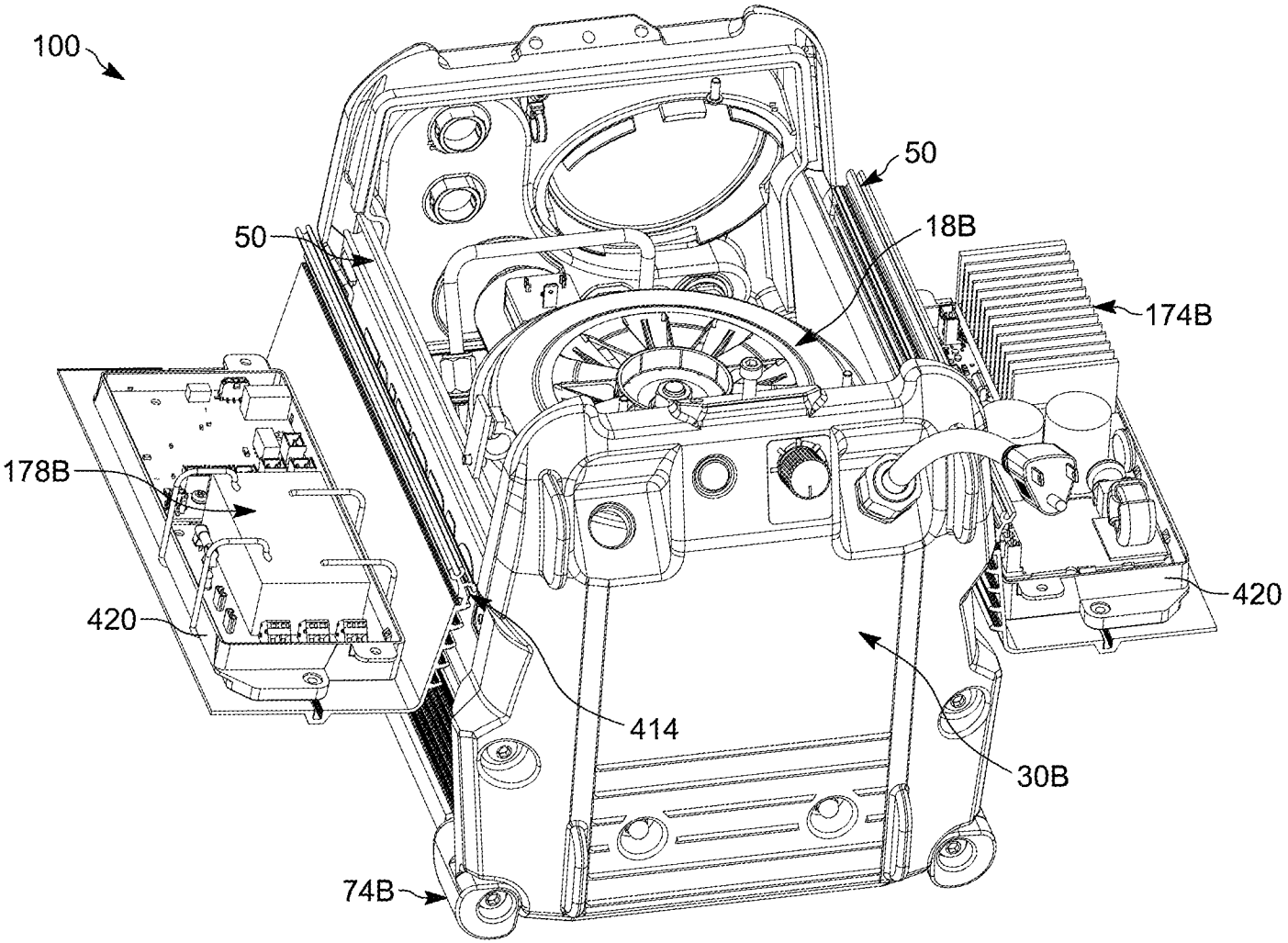
FIG. 37 is a perspective view of the pump shown in FIG. 29, with doors of the pump open.

As shown in FIGS. 36 and 37 of the illustrated construction, each door 34 is movably supported (e.g., pivotable) about a pivot 50 defined between the door 34 and a portion of the support frame 26. Each door 34 includes a rib 410 oriented toward the support frame 26. In the illustrated embodiment, the ribs 410 are hanging ribs and are receivable within a slot 414 on the support frame 26. The hanging ribs 410 provide a second pivot 414 and allow the doors 34 to pivot to a fully opened position (i.e., an outer surface of the doors 34 are adjacent outer surfaces of the support frame 26).

A handle 38 is a cast piece connected between the end caps 30. The handle 38 covers the interface between the doors 34 and may protect components of the pump 10. In the illustrated embodiment, the handle 38 locks the doors 34 in a closed position (i.e., the doors 34 enclose the compartment for the motor assembly 18 and pump assembly 22). The handle 38 is coupled to the end caps 30 or doors 34 by fastening members 418 (e.g., threaded screws). The doors 34 are unable to pivot open while the handle 38 is secured between the end caps 30, thereby preventing access to components within the frame (e.g., while the pump is operated). A user can uncouple and remove the fastening members 418 and the handle 38 from the frame assembly 14 in order to pivot the doors 34.

Figure 38:
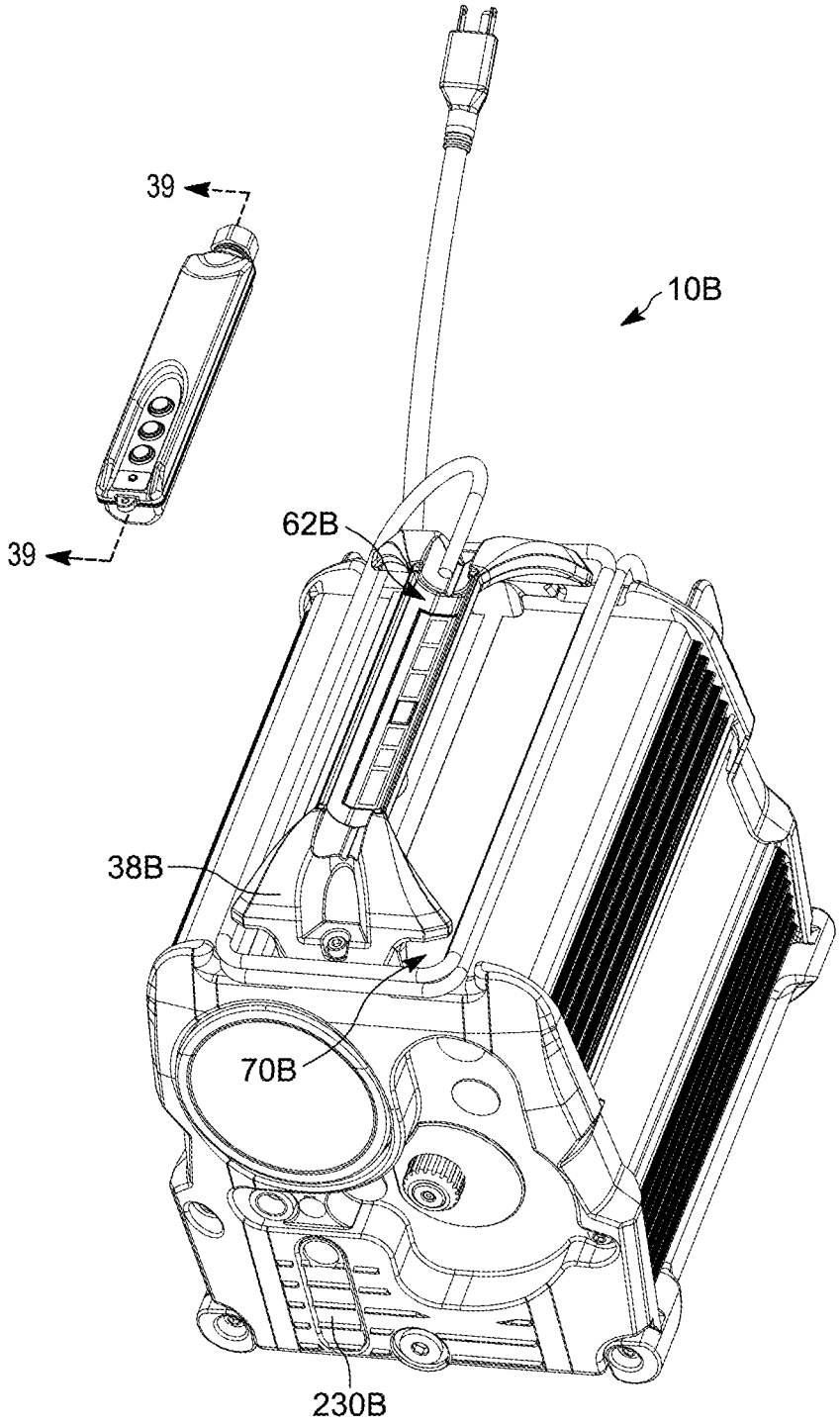
FIG. 38 is a partial exploded view of the pump of FIG. 29, illustrating a controller.
Figure 39:
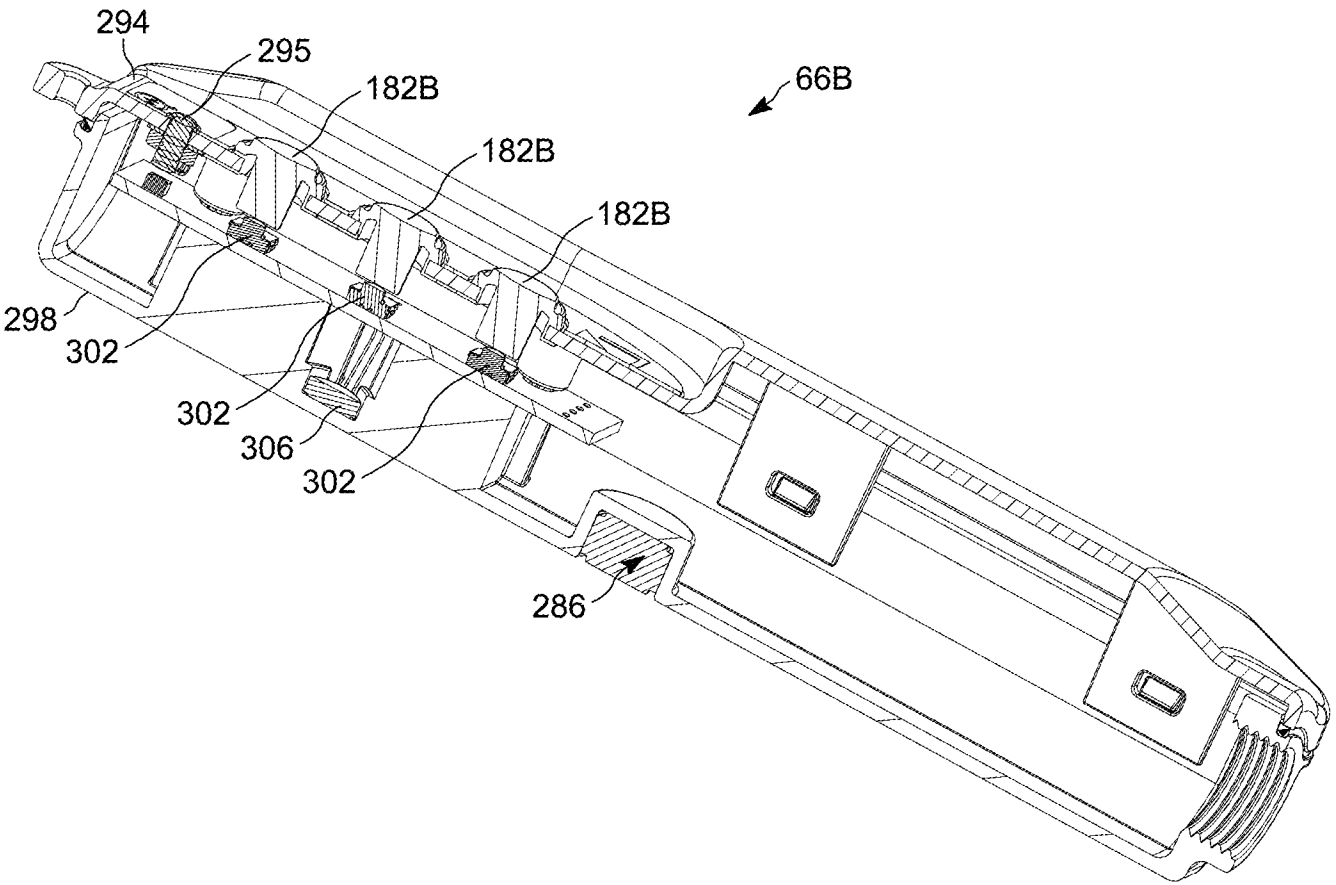
FIG. 39 is a cross-sectional view of the controller shown in FIG. 38 taken generally along line 39-39.

As shown in FIGS. 38 and 39, a pendant 66B is removably coupled to a receptacle 62B positioned on the handle 38B. In the illustrated embodiment, the pendant 66B includes a member 286 for coupling the pendant 66B to the handle 38B. In some embodiments, the member 286 includes a magnet or another type of coupling member. As shown in FIG. 39, the pendant 66B includes the magnet 286 that is substantially flush with the surface of the pendant, and the receptacle 62B (FIG. 38) includes a metallic surface. When the pendant 66B is coupled to the handle 38B, the magnet 286 is coupled to the magnetic surface. In addition, the magnet 286 may be used for coupling the pendant to a metallic surface (e.g., a metallic frame portion) near the location of the pump 10.

As shown in FIG. 39, the pendant 66B is formed from a first portion 294 and a second portion 298. In the illustrated embodiment, the first portion 294 and the second portion 298 snap together and create a liquid resistant seal. The first portion 294 includes switches or buttons 182B. In the illustrated embodiment, the first portion 294 includes three buttons 182B that are made from rubber (or a similar synthetic material). The buttons 182B are overmolded onto the first portion 294. A user input (e.g., pushing one of the buttons 182B) actuates an associated control switch 302, sending a signal to a controller 170A (FIG. 10).

The pendant 66B includes at least one haptic motor 306. The haptic motor sends feedback (e.g., vibrations) when the switches 302 are actuated. The haptic motor 306 may be able to send more than one type of feedback (e.g., a different number of pulses or different intensities of vibrations). A user holding the pendant 66B may sense the feedback and be alerted to changes in pump 22B/motor 18B operation. In some embodiments, the pendant may include a light-emitting device (e.g., an LED) 295 to provide visual feedback to the user.

Figure 40:
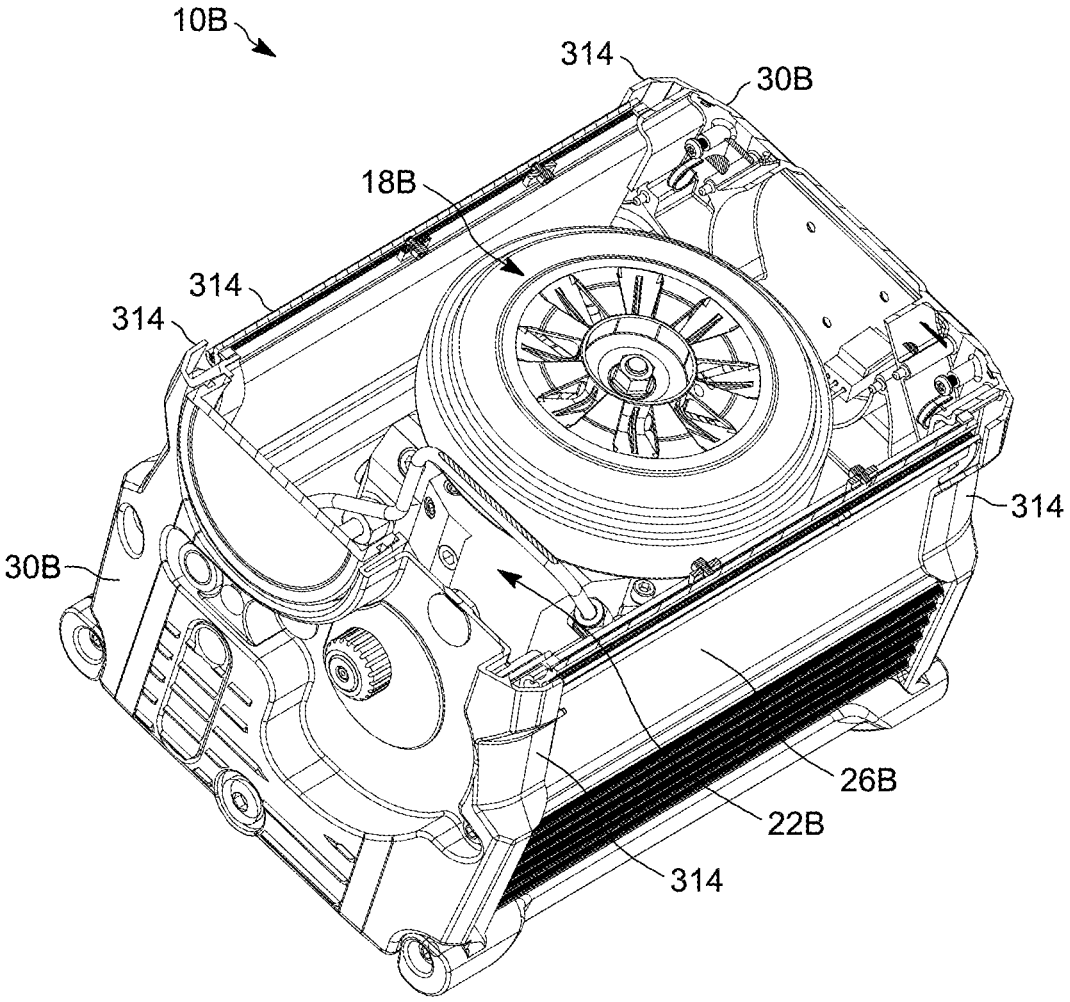
FIG. 40 is a cross-sectional view of the pump shown in FIG. 29 taken generally along line 40-40.
Figure 41:
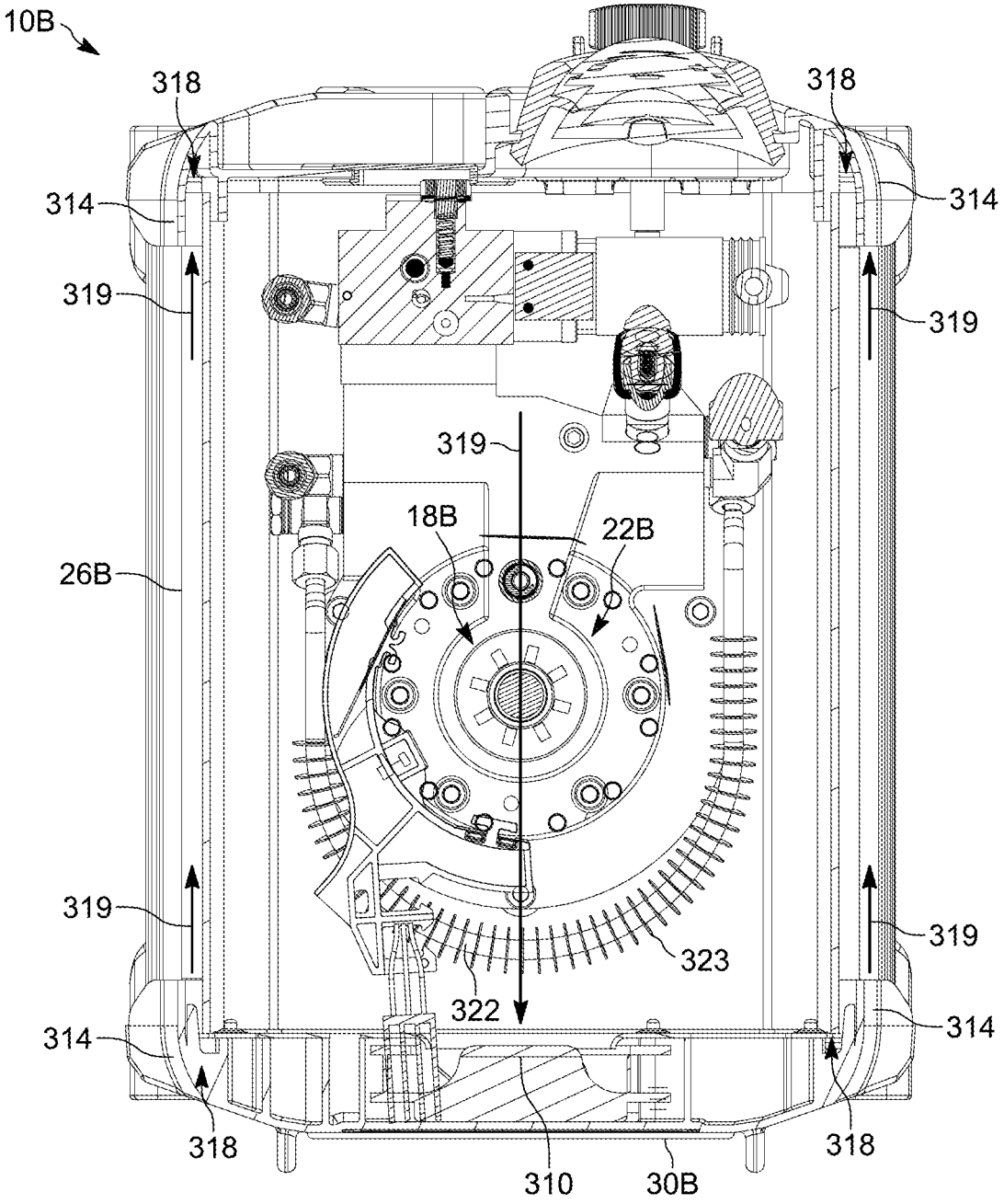
FIG. 41 is a cross-sectional view of the pump shown in FIG. 32 taken generally along line 41-41.
Figure 42:
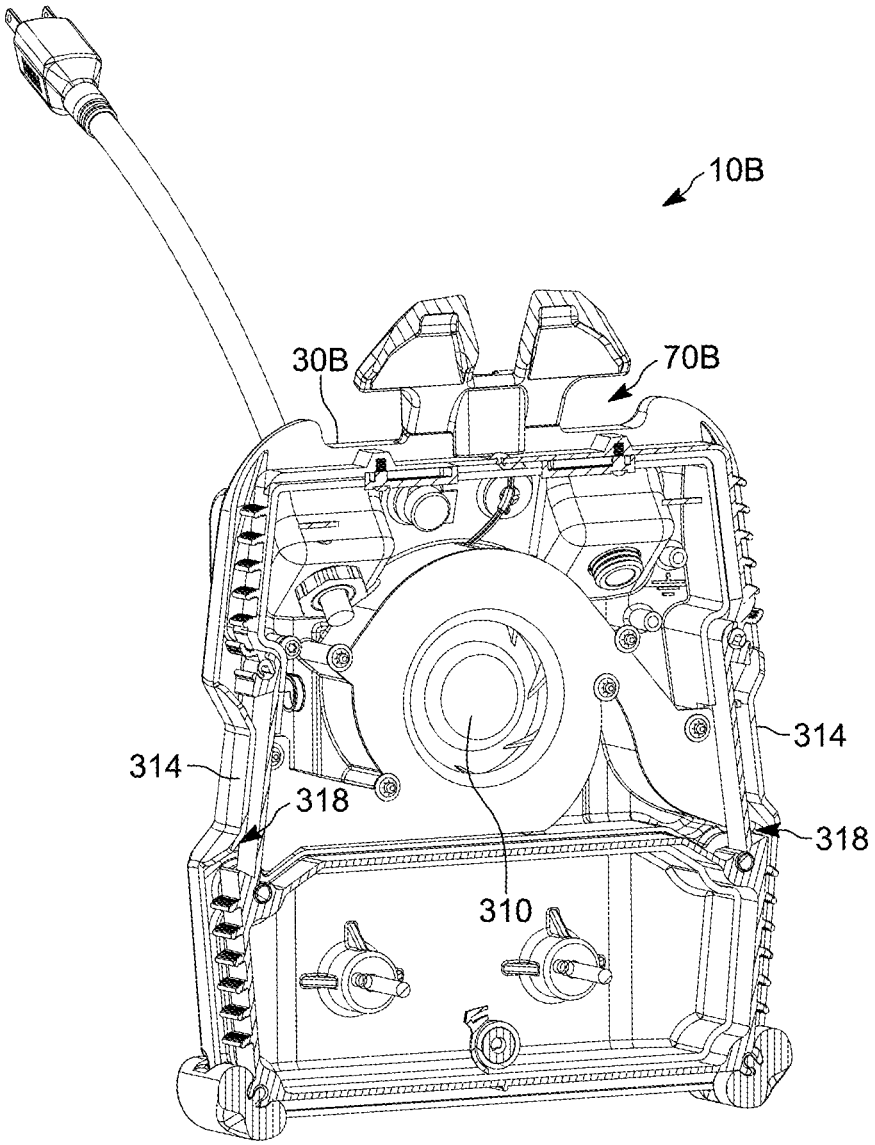
FIG. 42 is a cross-sectional view of the pump shown in FIG. 32 taken generally along line 42-42.

The pump 10B may be used for high torque applications (e.g., operating a torque wrench—not shown). The pump 10B generates a substantial amount of heat during the high torque application, and requires cooling to maintain optimal operating conditions. FIGS. 40-42 illustrate a radial fan 310 positioned proximate the rear end cap 30B. In the illustrated embodiment, the front end cap 30B and the rear end cap 30B each include curved portions 314 that protrude beyond the outer side surfaces of the support frame 26B when the front end cap 30B and the rear end cap 30B are coupled to the support frame 26B. In the illustrated embodiment, each of the end caps 30B includes a first curved portion 314 proximate a first side of the support frame 26B and a second curved portion 314 proximate a second side of the support frame 26B. In other embodiments, each end cap may only include one curved portion 314. As illustrated in FIG. 41, the curved portions 314 are spaced apart from the support frame 26B so that a gap 318 exists between the curved portion 314 and the support frame 26B. One curved portion 314 extends over each of the gaps 318 on the support frame 26B.

The gaps 318 provide inlet ports and exhaust ports for air to cool the motor 18B. As illustrated in FIG. 42, the gaps 318 proximate the radial fan 310 are outlets. As illustrated in FIG. 41, the radial fan 310 draws air 319 (e.g., arrows illustrate airflow path) from an external environment, through inlet gaps 318 proximate the front end cap 30B. The air 319 then travels across the motor assembly 18B and the pump assembly 22B and through the fan 310. The movement of the air 319 across the motor assembly 18B and the pump assembly 22B lowers a motor temperature and a pump temperature through forced convection. Heat is transferred from the surface of the motor assembly 18B and from heat fins 323 of a heat exchanger 322 of the pump assembly 22B to the air 319, thereby reducing the temperature of the motor assembly 18B and the pump assembly 22B. The air 319 passes through the compartment of the frame assembly 14B and is exhausted through either of the outlet gaps 318 proximate the radial fan 310 and back into the external environment.

Figure 43:
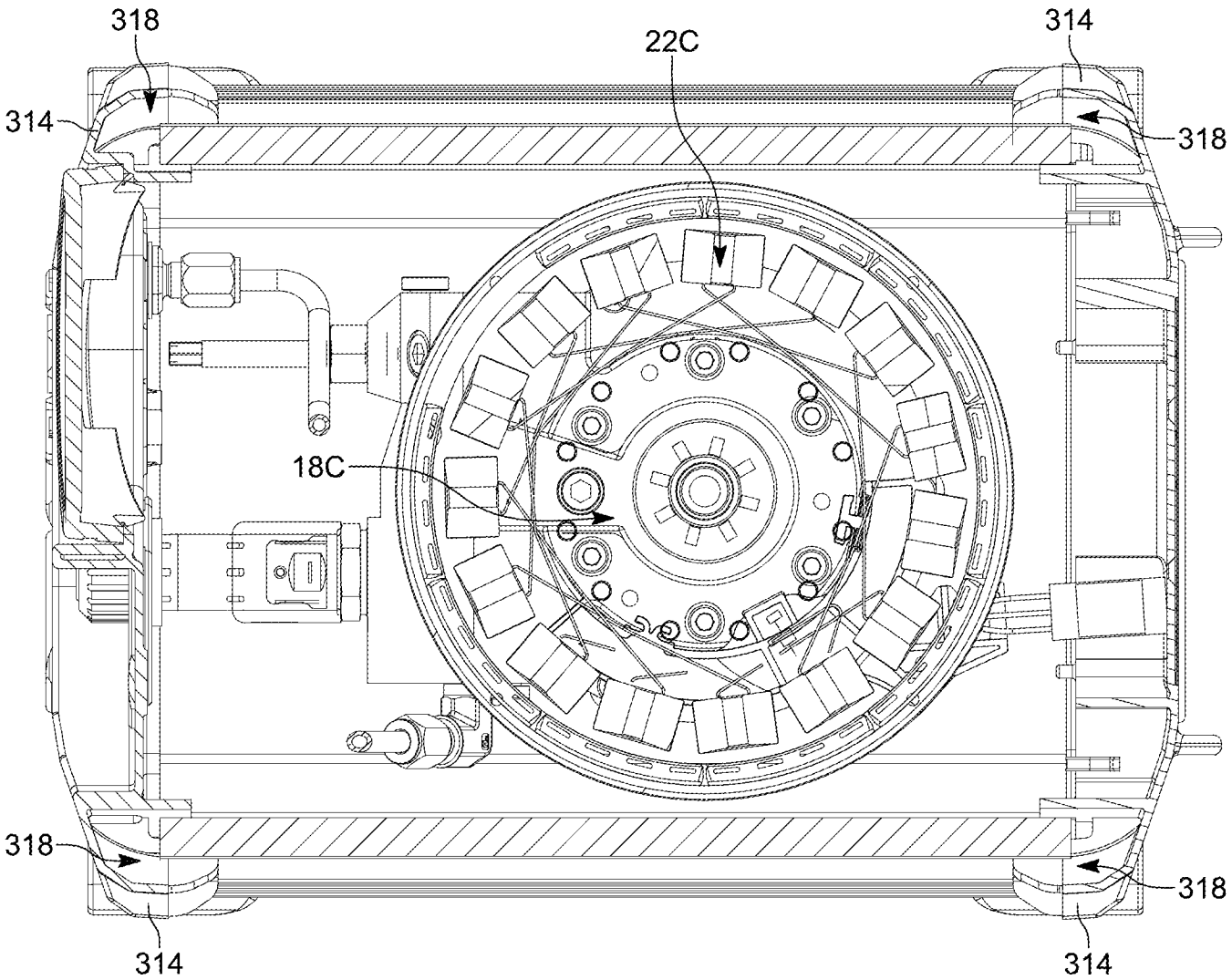
FIG. 43 is a cross-sectional view of the pump shown in FIG. 32 without a fan and a heat exchanger, taken generally along line 42-42.

The pump 10B may also be used in lower torque applications. In the lower torque applications, the motor assembly 18B, the pump assembly 22B, and the fluid within the pump assembly 22B do not generate the same amount of heat as the pump 10B in the high torque application, and the fan and heat exchanger are not necessary (FIG. 43). Pumps 10B that are intended to be used for low torque applications may still include a fan and/or a heat exchanger in order to cool the pump 10B.

Figure 44:
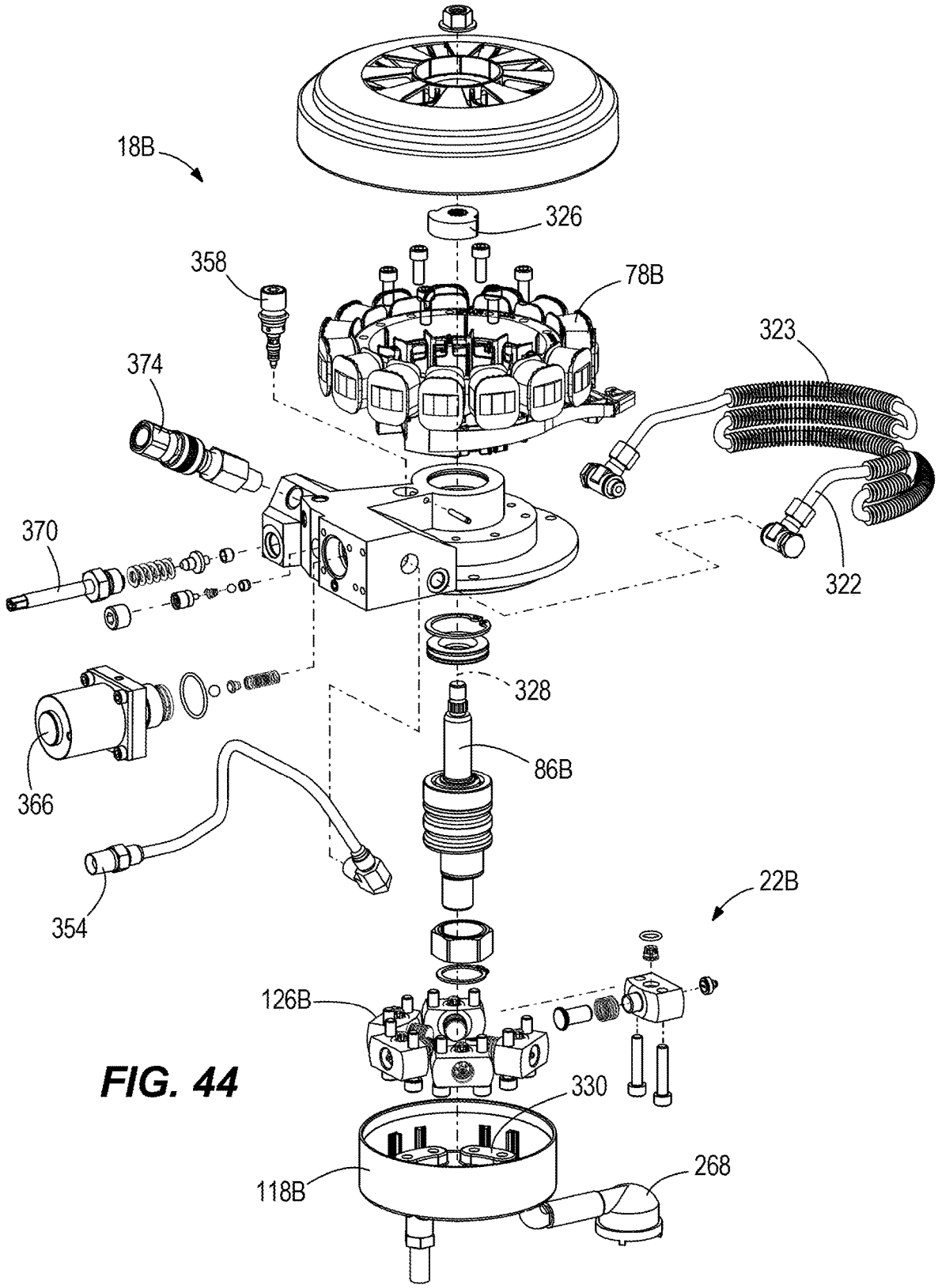
FIG. 44 is an exploded view of a pump assembly and a motor assembly.

As shown in FIG. 44, the motor shaft 86B includes a counter-weight 326 proximate the stators 78B. In the illustrated embodiment, the counter-weight 326 is splined to the motor shaft 86B. Positioning the counter-weight 326 proximate the stators 78B, rather than lower on the motor shaft 86B (i.e., inside of the pump assembly 22B), facilitates easier assembly and disassembly of the pump and motor.

The pump 10B is a radial piston pump and includes six piston and cylinder assemblies. In the illustrated embodiment, the piston and cylinder assemblies are arranged in a circular orientation about a shaft axis, with each piston oriented to move in a radial direction relative to the shaft axis 328. Similar to pump 10, the pump assembly 22B includes a two-stage pump assembly. In the illustrated embodiment, three of the piston and cylinder assemblies are first piston and cylinder assemblies and three of the piston and cylinder assemblies are second piston and cylinder assemblies. The piston and cylinder assemblies are positioned so that each first piston and cylinder assembly is positioned directly in between two second piston and cylinder assemblies. In other words, the piston and cylinder assemblies alternate between first pistons 126B and second pistons 126B around the shaft axis.

The piston and cylinder assemblies of the pump assembly 22B rest in the lower housing 118B. In the illustrated embodiment, the lower housing 118B is positioned partially within the reservoir 186B (FIG. 31A) and is in fluid communication with the reservoir 186B. Hydraulic fluid is drawn from the reservoir 186B, through the fluid intake 268, and into a plenum or bowl 330 of the lower housing 118B so that the bowl 330 is substantially filled with hydraulic fluid. Each piston and cylinder assembly draws in the hydraulic fluid from the bowl 330 through a separate port. As hydraulic fluid leaves the bowl 330 and flows into the first and second pistons 126B, additional hydraulic fluid is drawn into the bowl 330 from the reservoir 186B.

A valve 334 positioned within the fluid intake. In some embodiments, the valve 334 is an umbrella check valve (FIG. 45) positioned adjacent an opening into the bowl 330. The umbrella check valve 334 is a one-way valve that is moveable between a first position and a second position and allows fluid to pass from the reservoir 186B and into the bowl 334, but prevents fluid from flowing in the reverse direction (i.e., from the bowl 334 to the reservoir 186B). This keeps hydraulic fluid within the bowl 330, even when the pump 10B is not operating (i.e., after it has been powered down). When the pump 10B is started, hydraulic fluid is already present in the bowl 330. This keeps the pump primed and reduces the likelihood of a dry start (i.e., when the pistons 126B intake air instead of hydraulic fluid), which helps to prolong the service life of the pump assembly 22B and its components.

In a first stage of operation, the pump assembly 22B drives all of the pistons 126B of the first and second piston and cylinder assemblies to dispense fluid at a relatively high flow rate (e.g., about 220 $in^3$/min) and relatively low pressure (up to about 3,000 psi to about 4,000 psi). In a second stage of operation, the pump assembly 22B continues to drive all of the pistons 126B, but the hydraulic circuit 106 (FIG. 23) is controlled to unload (e.g., dump to the reservoir 186B) the three pistons 126B of the first piston and cylinder assemblies. The three pistons 126B of the second piston and cylinder assembly then dispense fluid at a lower flow rate (e.g., initially, about 60 $in^3$/min to about 70 $in^3$/min, decreasing to about 35 $in^3$/min as pressure increases) and higher pressure (e.g., from about 3,000 to about 4,000 psi up to about 10,000 psi). In the illustrated construction, the pump assembly 22B thus uses common pistons 126B in both stages.

Figure 45:
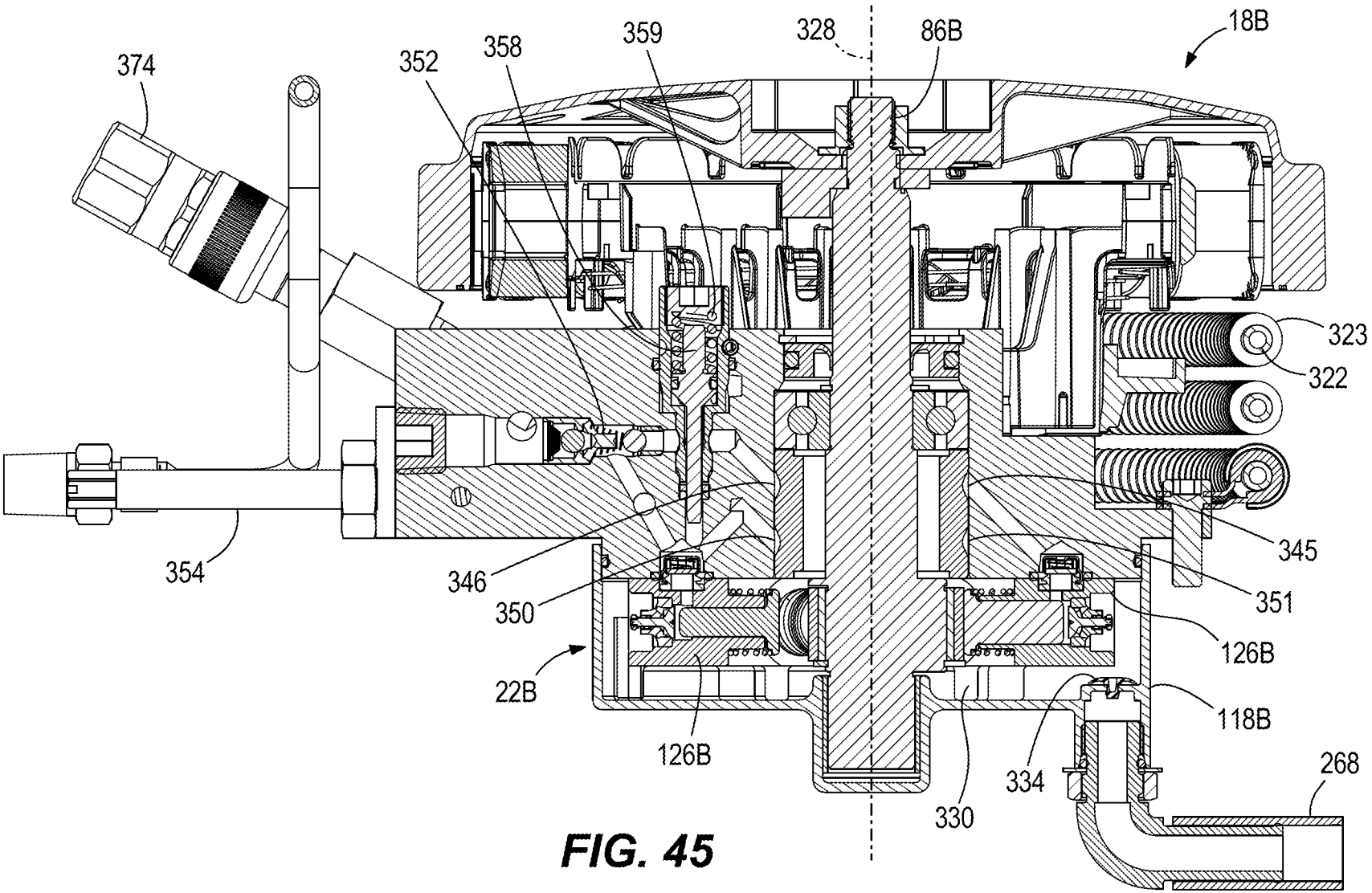
FIG. 45 is a cross-sectional view of the pump assembly and the motor assembly shown in FIG. 44.

As shown in FIG. 45, each of the piston and cylinder assemblies is in fluid communication with an associated passageway. In the illustrated embodiment, each of the first piston and cylinder assemblies 126B is in fluid communication with a first or low pressure passageway 346. Each of the second piston and cylinder assemblies is in fluid communication with a second or high pressure passageway 350. The first passageway 346 and the second passageway 350 are each formed on an outer surface central hub 351 extending around the shaft. In the first stage, while the pump 10B operates at a relatively low pressure, the low pressure passageway 346 and the high pressure passageway 350 are each in fluid communication with an outlet 352 of the pump assembly 22B. In other words, fluid dispensed by the first and second piston and cylinder assemblies flows through the outlet 352 of the pump assembly 22B in the first stage.

In the second stage, only the pistons 126B of the second piston and cylinder assemblies are in fluid communication with the outlet 352 of the pump assembly 22B, and therefore, only the high pressure passageway 350 is in communication with the outlet 352 of the pump assembly 22B. A pilot or spool valve 358 is positioned between the low pressure passageway 346 and the outlet 352. In the illustrated embodiment, the spool valve 358 is biased by a biasing member or spring 359 toward an extended position, and an end surface of the spool valve 358 is subjected to the fluid pressure in the high pressure passageway 350. In another embodiment, a solenoid valve (not shown) may be used instead of the spool valve 358. The solenoid valve is configured to be in electrical communication with sensors (not shown) and is configured to be electronically actuated (i.e., opened or closed) in response to parameters measured by the sensors.

In the first stage, the spool valve 358 is in a first position and fluid leaving the first piston and cylinder assemblies may pass through the spool valve 358, and into the outlet 352. As the fluid pressure increases, the pressure in the high pressure passageway 350 exerts a force to the spool valve 358 to overcome the biasing force and move the spool valve 358 to a retracted position (e.g., upwardly toward the motor assembly 18B in FIG. 45). The spool valve 358 then blocks the flow of fluid from the low pressure passageway 346, redirecting the fluid back into the reservoir 186B. In other words, fluid dispensed by the pistons 126B of the first piston and cylinder assemblies returns to the reservoir 186B and does not leave the pump 10B while the pump operates in the second stage. In some embodiments (e.g., pumps 10B used in high torque applications), the fluid may also flow through the heat exchanger 322 before returning to the reservoir 186B. Blocking the fluid flow with the spool valve 358 allows only the high pressure fluid from the pistons 126B of the second piston and cylinder assemblies to leave the pump in the second stage of operation.

The provision of multiple second pistons 126B (i.e., pistons of the second piston and cylinder assemblies) reduces the torque and the flow ripple.

Figure 46:
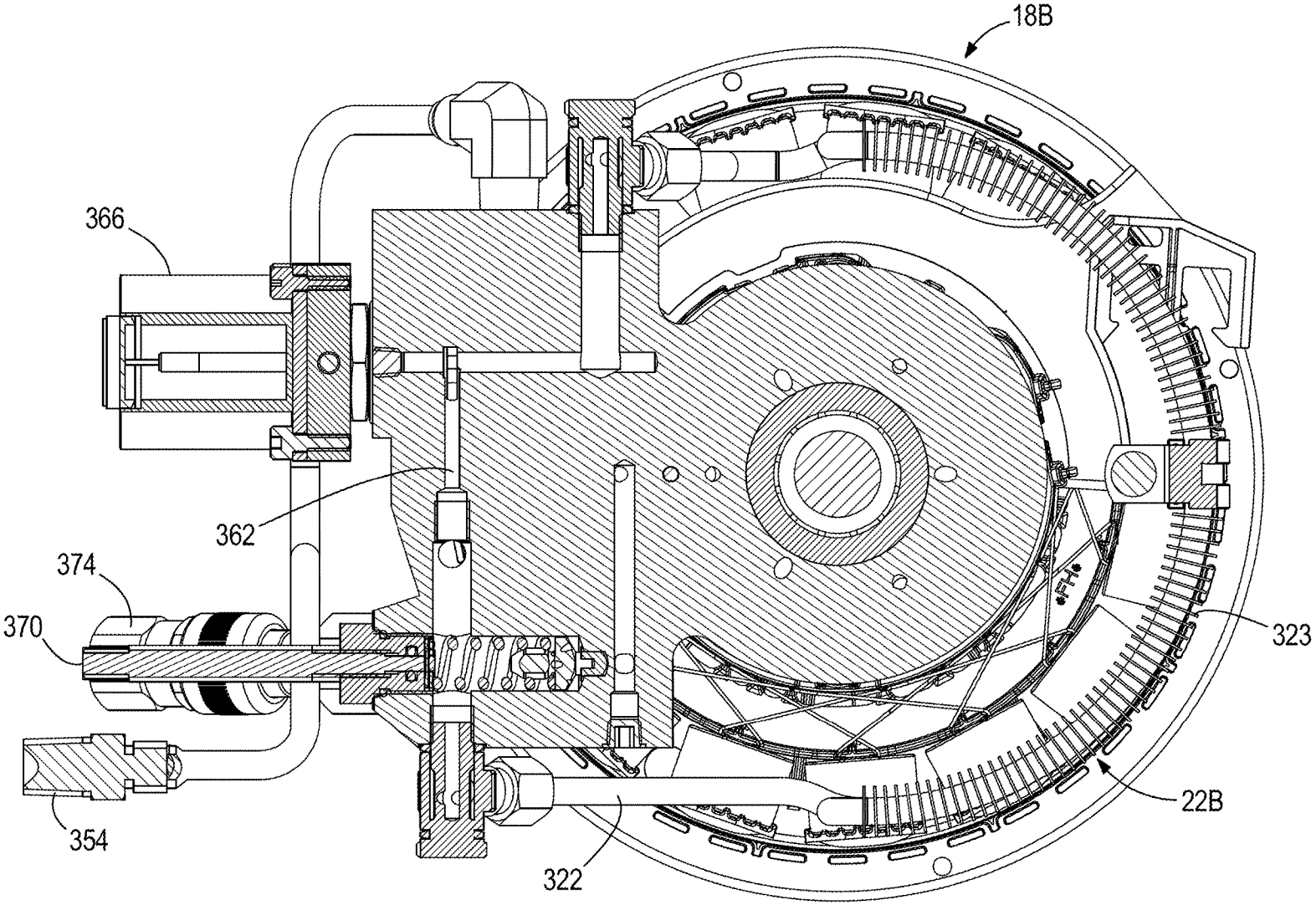
FIG. 46 is a cross-sectional view of the pump assembly and the motor assembly shown in FIG. 44.
Figure 47:
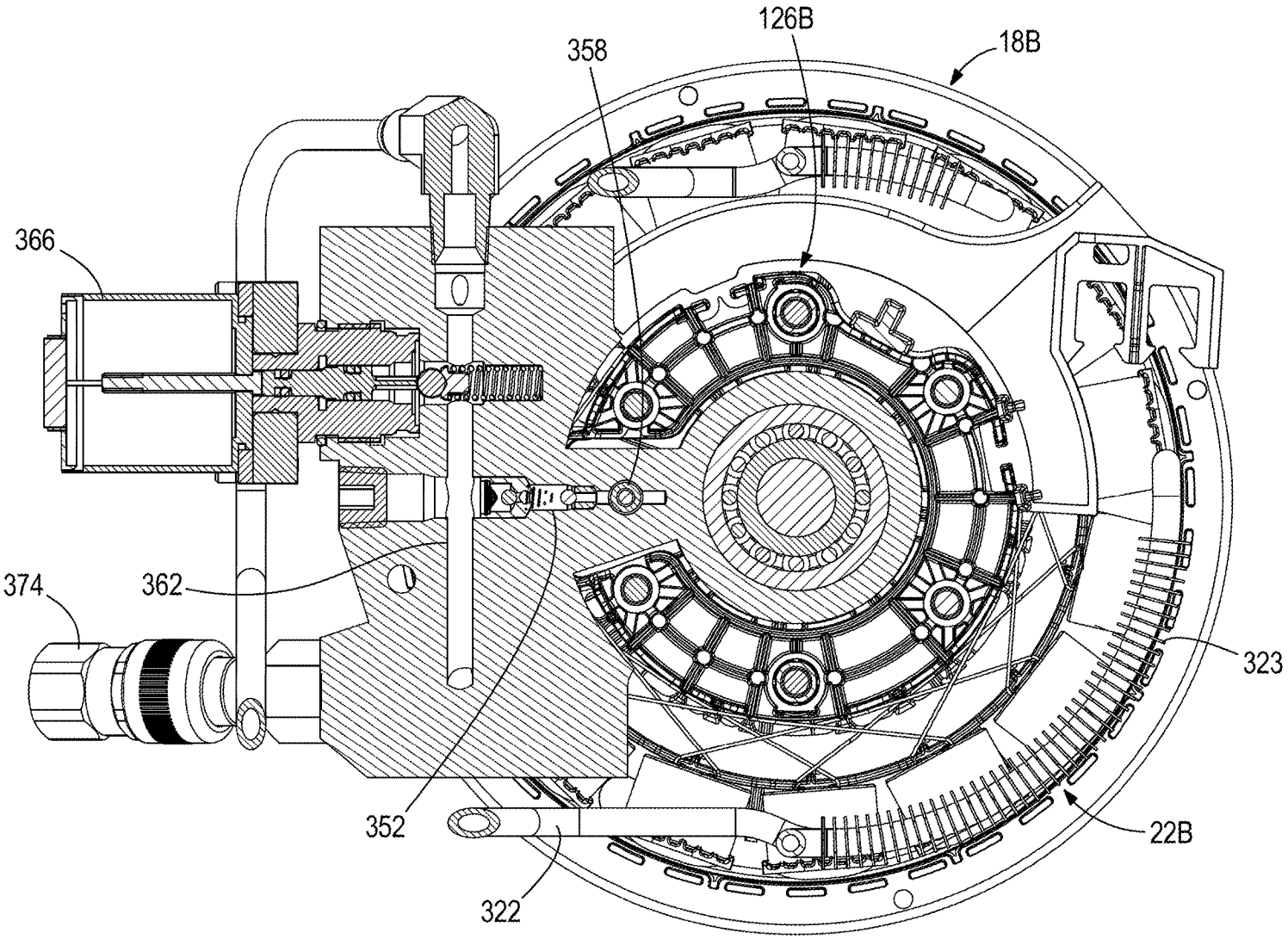
FIG. 47 is a cross-sectional view of the pump assembly and the motor assembly shown in FIG. 44.

As shown in FIGS. 46 and 47, fluid leaving the outlet 352 may be diverted into passageway 362, which is in communication with the outlet 352 and extends in two orthogonal directions with respect to the outlet 352. The first side of the passageway 362 includes a first valve 366 and the second side of the passageway 362 includes a second valve 370. In the illustrated embodiment, the first valve 366 is a three way, two position normally open solenoid valve. In other words, the first valve 366 has an open position that allows fluid to pass through the pump outlet 352 and a closed position that prevents fluid from reaching the pump outlet 352. In the illustrated embodiment, the pendant 66B may actuate the first valve 366 between the open and closed positions. Other embodiments may include different valves 380-382 in place of the first valve 366. The second valve 370 is an adjustable relief valve, which allows a user to control a maximum pressure that the pump 10B may achieve. In the illustrated embodiment, adjustable relief valve 370 opens to the heat exchanger 322 so that fluid may pass through the heat exchanger 322 before returning to the reservoir 186B. In the illustrated embodiment, the adjustable relief valve 370 does not have a handle or knob.

While the first valve 366 is closed, fluid travels from the outlet 352 of the pump assembly 22B to a pump outlet 354. Alternatively, while the first valve 366 is open, toward the heat exchanger 322 and back to the reservoir 186B. As shown in FIG. 46, the heat exchanger 322 of the illustrated embodiment includes multiple tubes arranged in a stacked coil around a periphery of the pump and motor. The tubes include heat fins 323 for transferring heat from the fluid to the air and the heat exchanger 322 transports the fluid back to the reservoir 186B.

Figure 29:
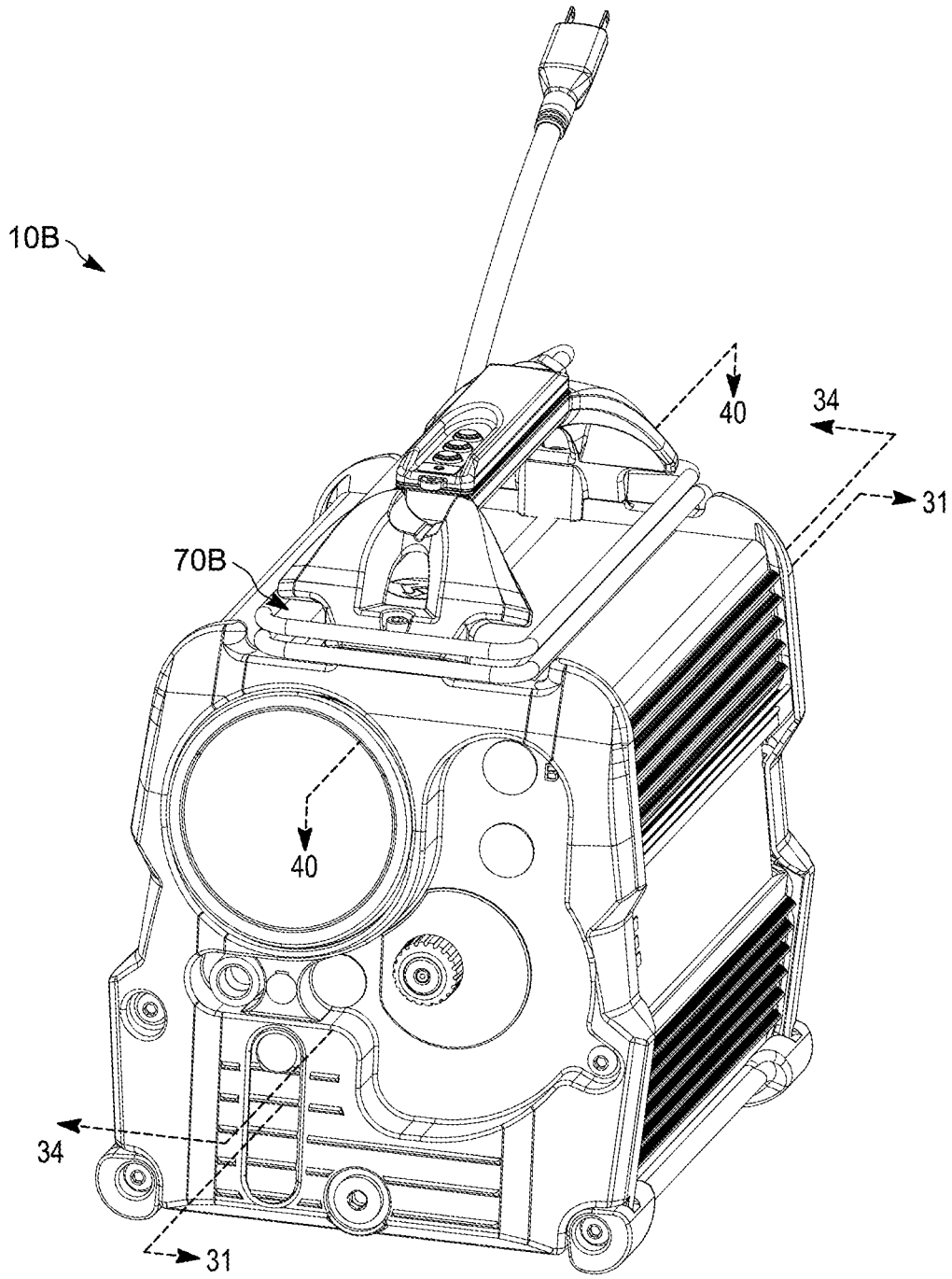
FIG. 29 is a front perspective view of another alternative construction of a pump.

As shown in FIG. 29, in some embodiments the pump 10B includes a pressure gauge 338. The pump 10B can also include a display (not shown). The display can be positioned on the front end cap 30B and include LED indicators. The LED indicators can be configured to indicate the outputs of internal diagnostics/sensors to monitor operation of the pump 10B. The pump 10B also includes a pressure operated valve 342. The pressure operated valve 342 is configured to be adjusted by a user. The pressure operated valve can be rotated in either a first direction or in a second direction in order to adjust the tolerances of the pump 10B.

Figure 48:
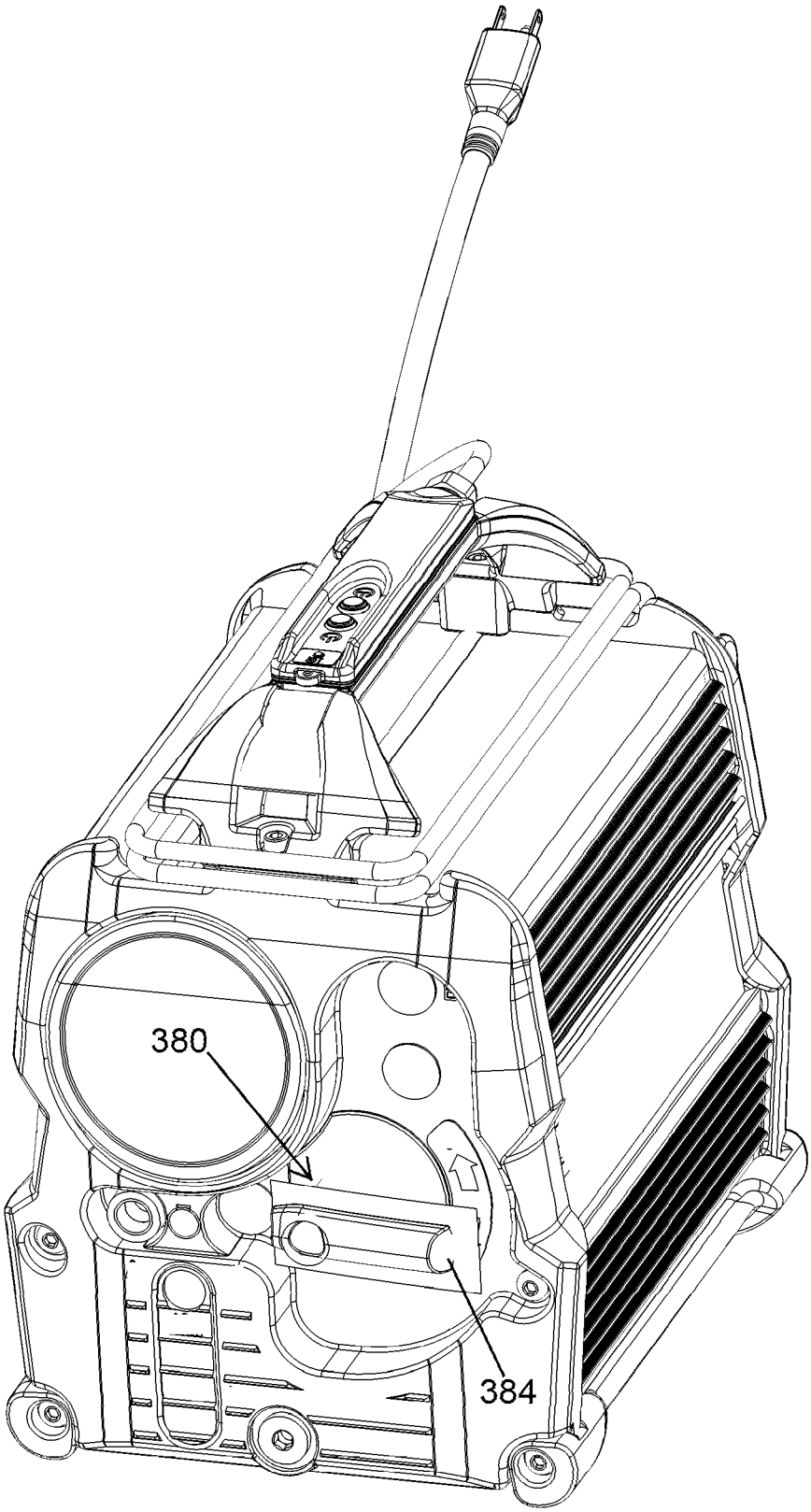
FIG. 48 is a perspective view of another alternate construction of a pump.
Figure 49:
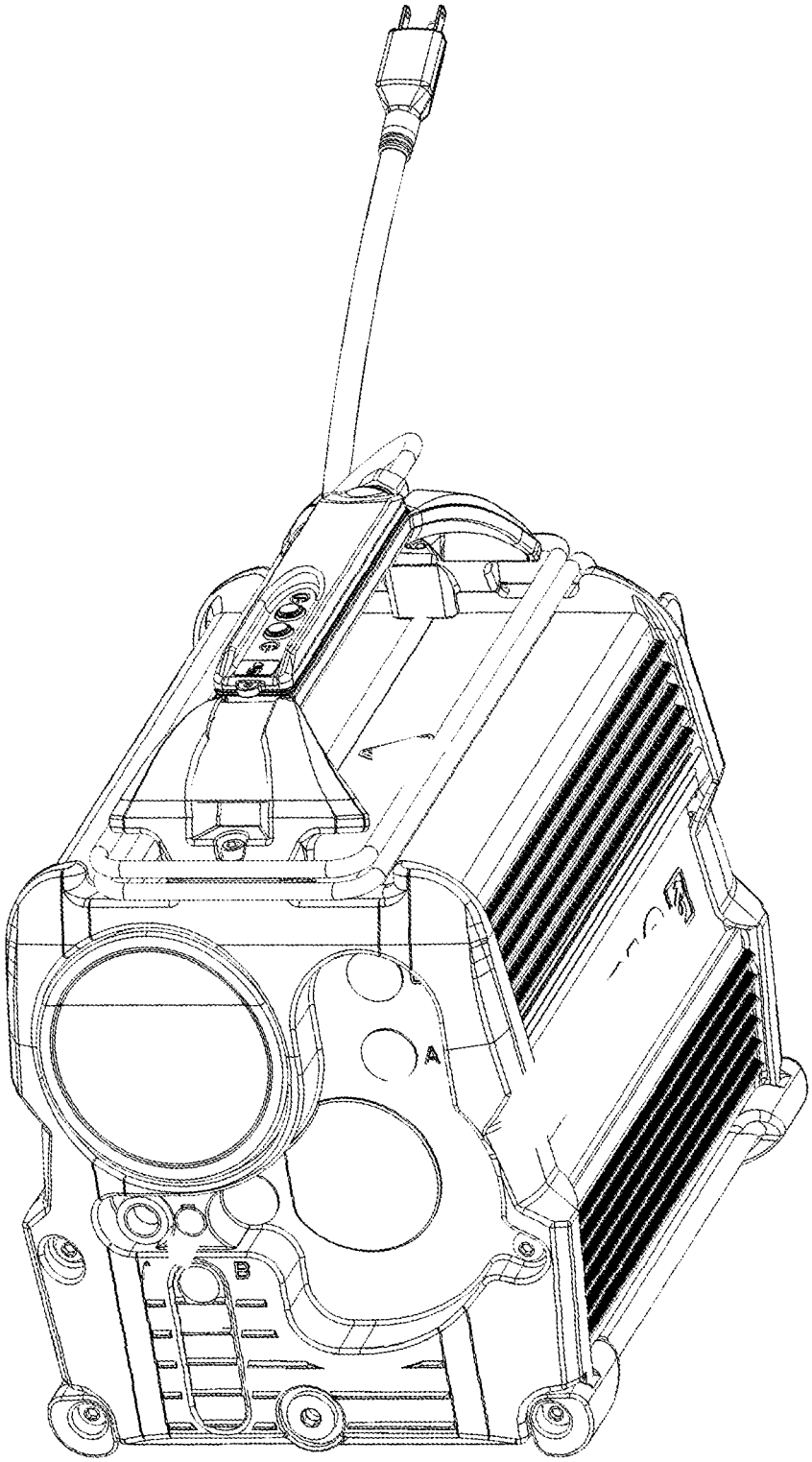
FIG. 49 is a perspective view of another alternate construction of a pump.
Figure 50:
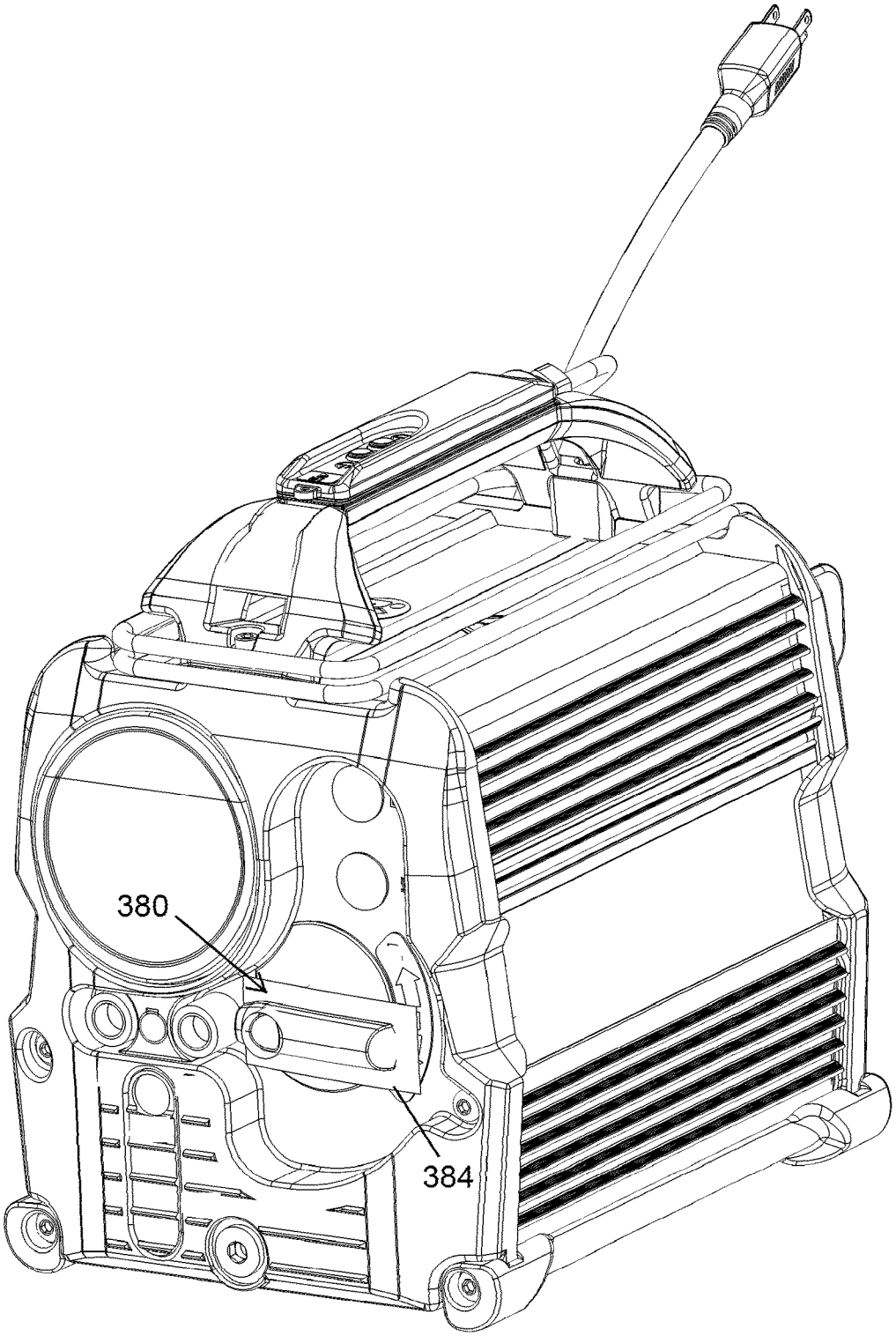
FIG. 50 is a perspective view of another alternate construction of a pump.

FIGS. 48-50 illustrate additional alternate constructions of a pump. The pumps shown in FIGS. 48-50 are substantially similar to pump 10B. These pumps include alternate valves 380, which replace the first valve 366 (FIG. 108). Valves 380 (FIGS. 112 and 114) are manual valves as opposed to automatic valves like the first valve 366 in the pump 10B, although the manual valves 380 perform a substantially similar task. In various embodiments, the valves 380 may be, but are not limited to, a three way two position manual valve that may be used in single acting tools and cylinders or a four way three position tandem center manual valve that may be used in double acting tools and cylinders. Each manual valve 380 includes a handle 384. A user may actuate the handle 384 in order to change the position of the valve 380. Additionally, the pump may be a four way three position valve. Although not illustrated, further alternate constructions of a pump may include a three way two position normally closed pilot operated valve, which may be used in crimping tools or presses. The normally closed pilot valve automatically retracts when a motor is turned off. In a further alternate construction, a pump may include no valves. Instead valves may be externally mounted to the pump as needed. FIG. 23 illustrates a 3 way two position valve although any valve 366 will work in the valve sub-assembly 154.

Preferred embodiments have been described in considerable detail. Many modifications and variations to the preferred embodiments described will be apparent to a person of ordinary skill in the art. Therefore, the disclosure should not be limited to the embodiments described. One or more independent features and independent advantages may be set forth in the claims.

What is claimed is:

1. A pump comprising:

a frame including a reservoir configured to store hydraulic fluid;

a motor assembly supported by the frame;

a pump assembly operably driven by the motor assembly, the pump assembly being in fluid communication with the reservoir and configured to dispense hydraulic fluid out of the frame, the pump assembly including a first piston and a second piston;

a hub having an outer surface defining a first passageway communicating with the first piston and a second passageway spaced from the first passageway and communicating with the second piston, the first passageway and the second passageway being in communication with a pump outlet; and a first valve having a first position in which the first passageway and the second passageway each communicate with the pump outlet, and a second position in which the first passageway is prevented from communicating with the pump outlet while the second passageway is communicating with the pump outlet.

2. The pump of claim 1, wherein the first piston includes a plurality of first pistons, and the second piston includes a plurality of second pistons, and wherein each of the first pistons is positioned between two second pistons.

3. The pump of claim 1, further comprising a shaft connected to the pump assembly, the shaft being configured to be driven by the motor assembly, and wherein the hub is positioned around the shaft.

4. The pump of claim 3, further comprising an eccentric member coupled to the shaft proximate the pump assembly, the eccentric member selectively engaging at least one of the first piston and the second piston, and wherein the hub is positioned between the eccentric member and the motor assembly.

5. The pump of claim 1, wherein the hub is cylindrical and the outer surface is curved.

6. The pump of claim 5, wherein each of the first passageway and the second passageway extends around the periphery of the outer surface.

7. The pump of claim 1, wherein the first piston is configured to dispense hydraulic fluid to the pump outlet through the first passageway, and wherein the pump assembly further comprises an outlet valve positioned between the first passageway and the pump outlet, the outlet valve being configured to selectively inhibit hydraulic fluid from flowing from the first passageway to the pump outlet and to redirect hydraulic fluid from the first passageway to the reservoir.

8. The pump of claim 1, wherein the pump assembly has a one-piece shaft that is shared with the motor assembly and that is rotatable by the motor assembly and has an eccentric outer surface for driving the pump assembly.

9. The pump of claim 1, further comprising first feet positioned on a first surface of the frame and second feet positioned on a second surface of the frame, the second surface substantially orthogonal to the first surface, wherein the pump is operable when supported by either the first feet or the second feet, and wherein the hydraulic fluid is communicated with the reservoir when the pump is supported by either the first feet or the second feet.

10. The pump of claim 1, wherein a shaft is configured to receive rotational output from the motor assembly, the shaft including an eccentric member at an end of the shaft.

11. The pump of claim 10, further comprising a bushing positioned around the eccentric member of the shaft, the bushing selectively engaging at least one of the first piston and the second piston.

12. A pump comprising:

a frame including a reservoir configured to store hydraulic fluid; a motor assembly supported by the frame;

a pump assembly operably driven by the motor assembly, the pump assembly being in fluid communication with the reservoir, the pump assembly including a first piston, a second piston, and a valve, the first piston being configured to dispense hydraulic fluid out of the frame, the second piston being configured to dispense hydraulic fluid out of the frame, the valve being configured to selectively inhibit hydraulic fluid dispensed via compression by the first piston from flowing out of an outlet of the pump assembly to thereby reduce a flow of the hydraulic fluid out of the outlet as compared to when uninhibited by the valve; and a heat exchanger including a tube and a plurality of fins each disposed around the tube, the tube receiving hydraulic fluid dispensed by the first piston when the valve inhibits hydraulic fluid dispensed by the first piston from flowing out of the frame, the hydraulic fluid traveling through the tube to the reservoir.

13. The pump of claim 12, further comprising:

a radial fan configured to cool the motor assembly, the radial fan being positioned proximate one end of the frame;

a fan inlet positioned adjacent an opposite end of the frame; and a fan outlet positioned adjacent the one end of the frame; and wherein air flows through the fan inlet, across the heat exchanger, through the radial fan, and radially through the fan outlet.

14. The pump of claim 12, wherein the valve is an outlet valve, and wherein the pump assembly further comprises a housing supporting the first piston and the second piston, and an inlet valve configured to allow flow from the reservoir to the housing and to prevent flow from the housing to the reservoir.

15. The pump of claim 12, wherein the frame further includes a frame valve having an open position, in which hydraulic fluid is configured to travel toward the reservoir through the heat exchanger, and a closed position, in which hydraulic fluid is configured to travel from the outlet of the pump assembly to an outlet of the frame.

16. The pump of claim 15, further comprising an actuator configured to adjust the frame valve between the open position and the closed position.

* * * * *